US008287345B2

(12) United States Patent
Gross et al.

(10) Patent No.: US 8,287,345 B2
(45) Date of Patent: Oct. 16, 2012

(54) SYSTEM AND METHOD FOR PLAYING ON-LINE POKER AUGMENTED WITH DYNAMIC AND SITUATIONAL INFORMATION

(75) Inventors: E. Mark Gross, White Plains, NY (US); Leon Stankowski, Narberth, PA (US); Avram Jamie Aronoff, New York, NY (US); Brian Z. Lando, West Orange, NJ (US)

(73) Assignees: E. Mark Gross, Monsey, NY (US); Brian Z. Lando, West Orange, NJ (US)

( * ) Notice: Subject to any disclaimer, the term of this patent is extended or adjusted under 35 U.S.C. 154(b) by 965 days.

(21) Appl. No.: 11/994,201

(22) PCT Filed: Jun. 14, 2006

(86) PCT No.: PCT/US2006/023151

§ 371 (c)(1),
(2), (4) Date: Jul. 30, 2008

(87) PCT Pub. No.: WO2007/040675

PCT Pub. Date: Apr. 12, 2007

(65) Prior Publication Data

US 2008/0318651 A1 Dec. 25, 2008

Related U.S. Application Data

(60) Provisional application No. 60/695,129, filed on Jun. 29, 2005, provisional application No. 60/739,023, filed on Nov. 23, 2005.

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS

| | | | | |
|---|---|---|---|---|
| 2,025,966 | A | 12/1935 | Williams | |
| 6,332,839 | B2 * | 12/2001 | Walker et al. | 463/13 |
| 8,142,283 | B2 * | 3/2012 | Lutnick et al. | 463/29 |
| 2003/0070178 | A1 | 4/2003 | Boyd et al. | |
| 2003/0096217 | A1 | 5/2003 | Adams | |
| 2003/0109310 | A1 | 6/2003 | Heaton et al. | |
| 2011/0065490 | A1 * | 3/2011 | Lutnick | 463/16 |
| 2011/0275432 | A1 * | 11/2011 | Lutnick et al. | 463/25 |

* cited by examiner

*Primary Examiner* — Pierre E Elisca
(74) *Attorney, Agent, or Firm* — Law Offices of Mitchell P. Novick

(57) ABSTRACT

A computer-controlled system and method for providing information to selected players participating in an on-line poker game with other players, the selected players typically paying a fee for the service. A database of information is maintained pertaining to the play styles of all players, the database containing information gathered during both play in previous poker games even with different players and play in the poker game in progress. The poker game in progress is continuously analyzed with respect to both the cards as they are dealt and play of the players. Information is provided on the display unit of a selected player that pertains to predicted continued play of a hand as it develops, predicted betting of the other players, and advantageous betting by the selected player, the information provided being derived from the database that includes updates that are made as the game progresses. The kind of information that is provided when closed cards are dealt to the players before community cards are exposed is different from the kind of information provided when community cards are subsequently exposed.

20 Claims, 40 Drawing Sheets

2 Brick

3 Busted Draw

9 Sheriff

10 Sheriff Deputy

12 Average Hand Strength of Opponent

14 Bet Folds

15 Big Blind

16 Small Blind

17 Bluffer Steals Pot

18 Calling Station

19 Check Fold

20 Check Raise

21 Collusion Alert

22 No Continuation Bet

23 Continuation Bet

24 Defends Blinds

25 Folds Blinds

26 Disconnect Protect Alert

29 New Player

30 Out of Element Down

FIG. 10

31 Out of Element Up
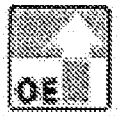
33 Pot Committed, Likely Caller
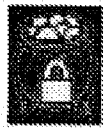
34 Pot Committed, But May Fold
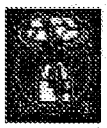
35 Raise Folds
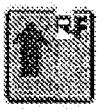
37 Re-raises Often Pre-flop
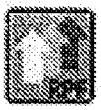
38 Short Stack Alert
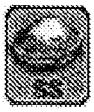
40 Tilt Alert, Opponent
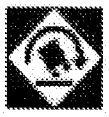
41 Time Show Strength
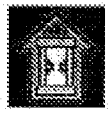
42 Time Show Weakness
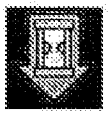
43 Unknown
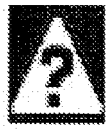
44 Untilt / Cowed
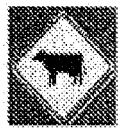
45 X-plosive Alert
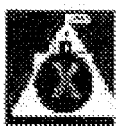
49 Average Hand Strength
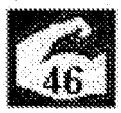
52 Nut Hand
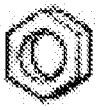
53 'Pure' Nut Hand
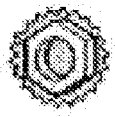
54 Pot Committed
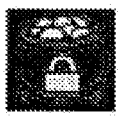
57 Tilt Alert, Self
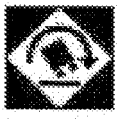
60 Average Table Hand Strength
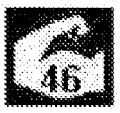
FIG. 11

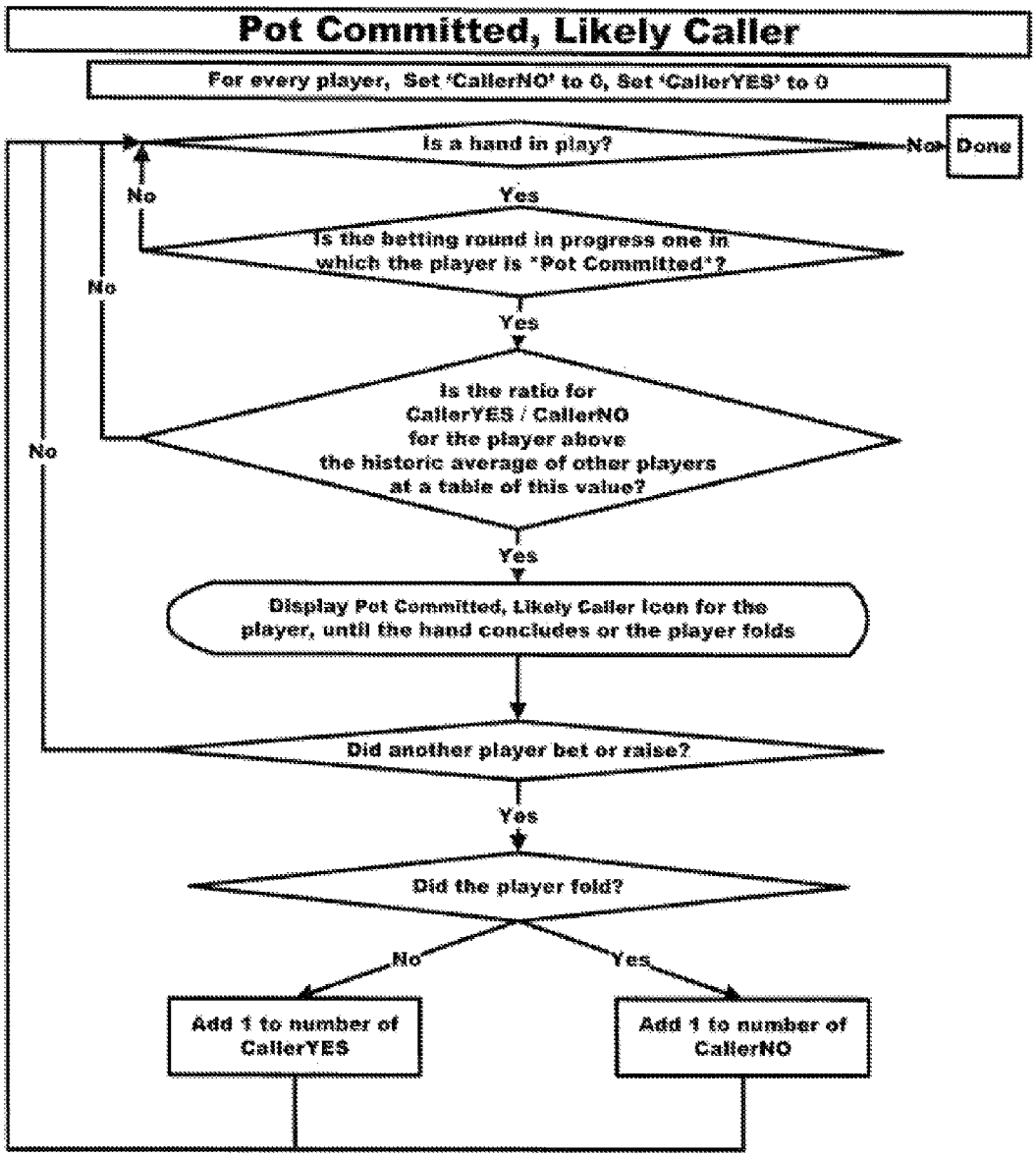

"Pot Committed" means either: (1) the player has 70% or more of his chips at the table already in the hand's pot; (2) the amount he must call (on a bet made) is less than 30% of the amount he has already put in the pot, and there can be no other bets in the hand (e.g., the only other contending player is 'all in'), or (3) the player has already in this or prior rounds invested in the pot (through betting or calling) for 5 or more bets – this third criteria only applies in a limit betting game.

FIG. 25

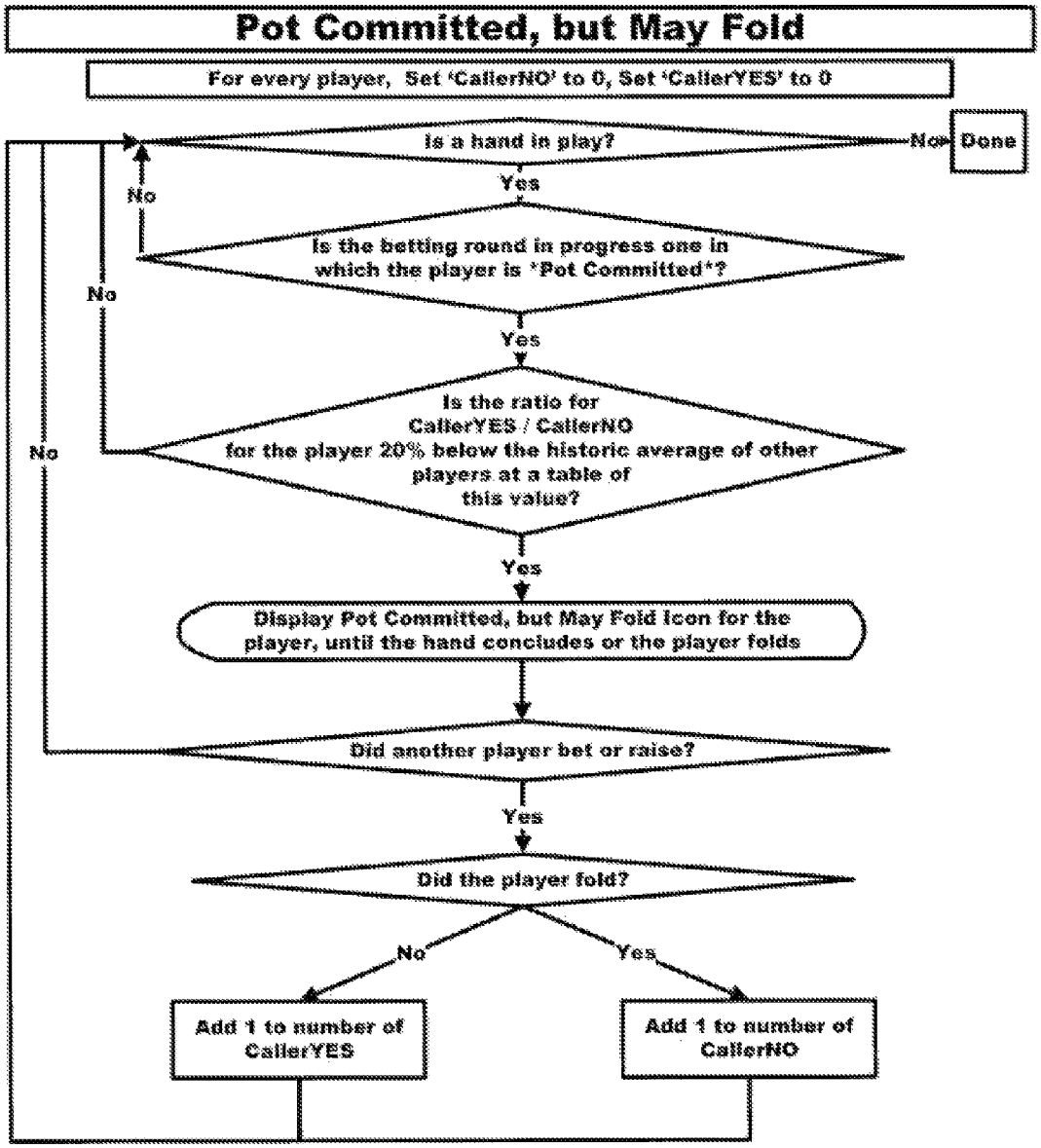

*Pot Committed* means either: (1) the player has 70% or more of his chips at the table already in the hand's pot; (2) the amount he must call (on a bet made) is less than 30% of the amount he has already put in the pot, and there can be no other bets in the hand (e.g., the only other contending player is 'all in'), or (3) the player has already in this or prior rounds invested in the pot (through betting or calling) for 5 or more bets – this third criteria only applies in a limit betting game.

FIG. 26

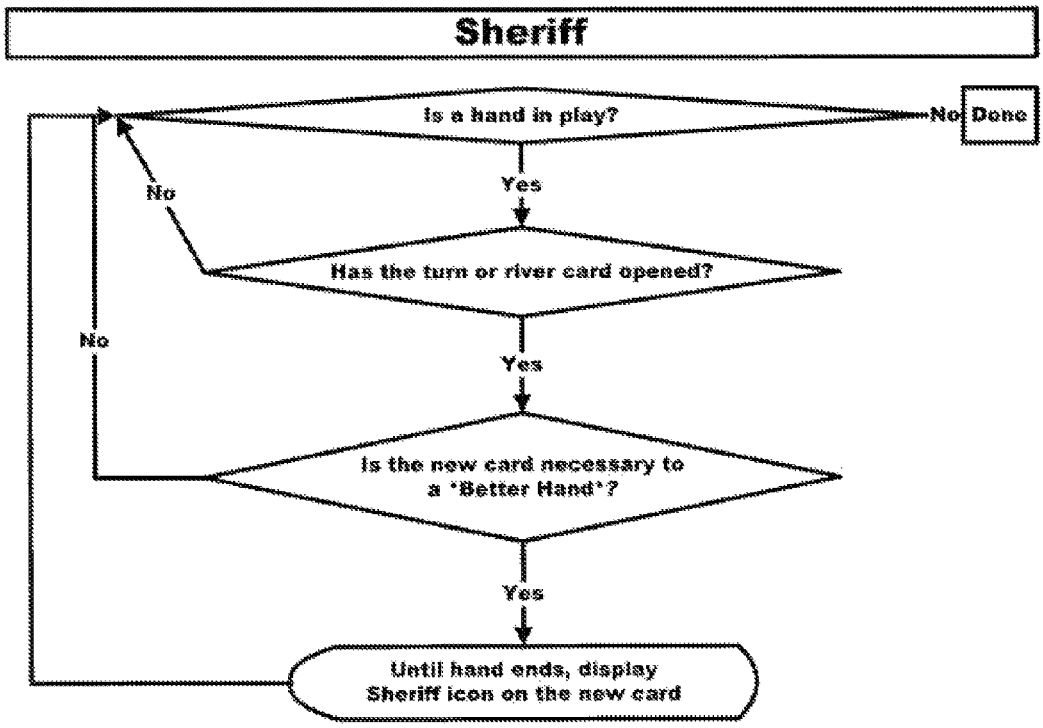

'Better Hand' means a hand that (A) uses the new card, the earlier opened board cards and any hypothetical optimal hole card or cards, and that is better than the best possible hand comprised of the earlier opened board cards and any hypothetical optimal hole card or cards; (B) is better than 3 of a kind; and (C) can be bettered by any hypothetical optimal hole card or cards held by a player.

FIG. 30

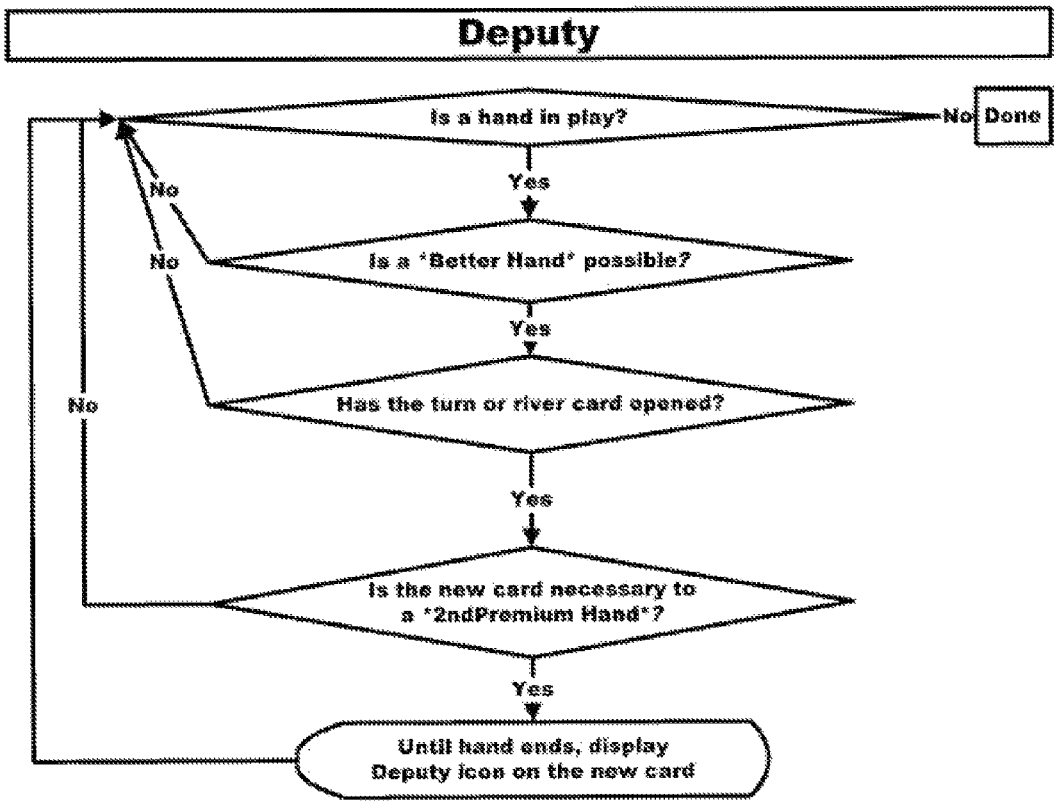

"Better Hand" means a hand that (A) uses the new card, the earlier opened board cards and any hypothetical optimal hole card or cards, and that is better than the best possible hand comprised of the earlier opened board cards and any hypothetical optimal hole card or cards; (B) is better than 3 of a kind; and (C) can be bettered by any hypothetical optimal hole card or cards held by a player.

"2ndPremium Hand" means a hand that (A) is inferior to the Better Hand; and (B) is better than 3 of a kind.

FIG. 31

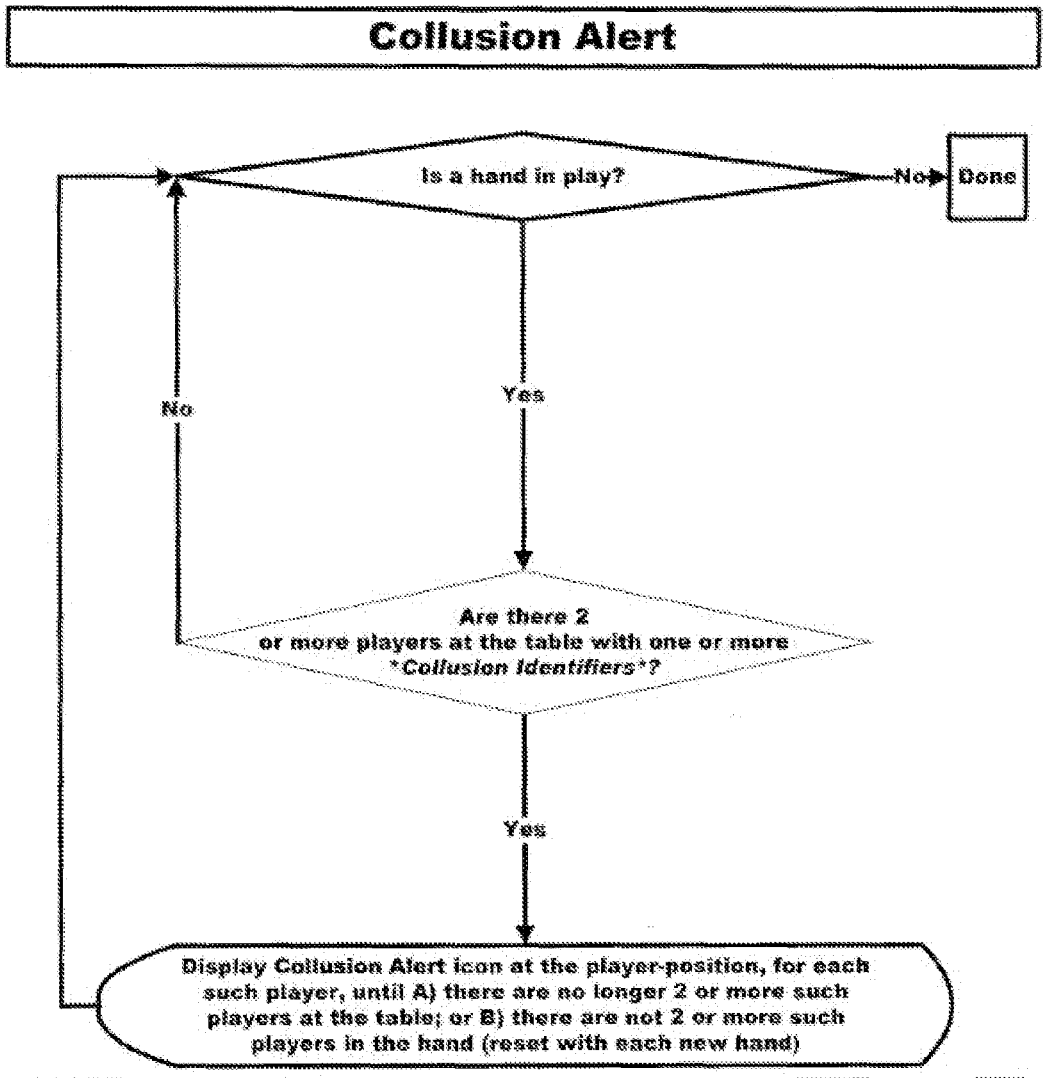

*Collusion Identifiers* means: 1. Players who play with each another over 60% more frequently than typical players at the type of table being played; 2. Players who play with each other over 25% more frequently than typical players at the type of table being played and raise one another over 30% more frequently than typical players at the type of table being played; 3. Players who play with each other over 25% more frequently than typical players at the type of table being played and fold to one another – after all other players have folded – over 20% more frequently than typical players at the type of table being played; or 4. Players who play with each other over 25% more frequently than typical players at the type of table being played and raise one another on the river over 30% more frequently than typical players at the type of table being played, with one holding less than the top pair supported by the board.

FIG. 32

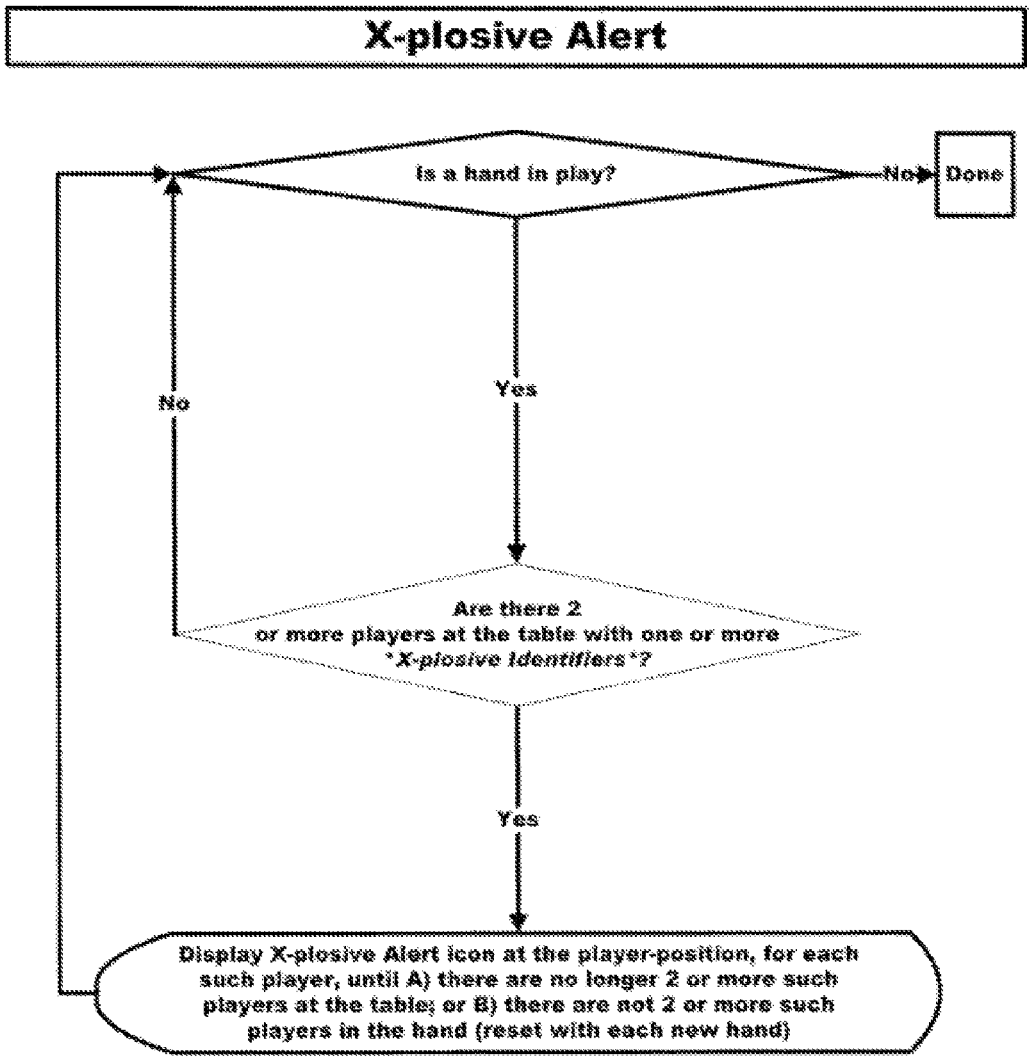

*X-plosive Identifiers* means: 1. Players who play with each other 125% or less frequently than typical players at the type of table being played and raise one another over 30% more frequently than typical players at the type of table being played; 2. Players who play with each other 125% or less frequently than typical players at the type of table being played and fold over 20% more frequently than typical players at the type of table being played; or 3. Players who play with each other over 125% or less frequently than typical players at the type of table being played and raise one another on the river over 30% more frequently than typical players at the type of table being played, with one holding less than the top pair supported by the board.

FIG. 40

SYSTEM AND METHOD FOR PLAYING ON-LINE POKER AUGMENTED WITH DYNAMIC AND SITUATIONAL INFORMATION

RELATED APPLICATIONS

This application claims the priority of U.S. provisional application Ser. No. 60/695,129 filed on Jun. 29, 2005 and U.S. provisional application Ser. No. 60/739,023 filed on Nov. 23, 2005.

FIELD OF THE INVENTION

The present invention relates to on-line poker play, and more particularly to providing to selected players, who may be required to pay a fee, dynamic and situational information that helps to increase their winnings, decrease their losses and improve their game skills.

BACKGROUND OF THE INVENTION

While chance is an important factor, over time superior poker skills will determine who wins and who loses. A good poker player understands the possibilities created by the cards, the tendencies and characteristics of his opponents, how he is perceived by others (opponent reaction to a player influences decision-making), and how to optimally select the game/table at which to play (i.e., choose to play with weaker players). In a real setting, players reach conclusions from what is seen and perceived on the card table and in the play area. In a virtual (on-line) setting, the area in which information may be conveyed is limited to the area on the display on the player's computer hardware or a portion thereof—some game tables do not occupy the entire space, typically a PC although displays may be on enhanced cellular telephones and in other circumstances to support play. An on-line game is even more difficult because software determines game policies, and decisions must often be made in a matter of seconds.

To aid on-line poker players, prior art systems have provided graphical, text and iconic information, but usually only after a specific request for it. The resulting information has been of very limited utility because it has not facilitated rapid decision-making. To type out a request or otherwise request information about a specific opponent who has yet to act (e.g., made a bet) or has just acted (e.g., made a bet) and then to understand the information returned and to react on it is impractical in the time allotted. Furthermore, the information provided has been static and has not taken into account the shifting nature of the poker hand in progress. For example, data concerning an opponent who was betting in the previous hand is not useful in the current hand if that opponent has folded. Finally, often too much information has been provided with no automated logic-supported basis upon which to provide prioritization of the information supplied. In those systems that provided static information displays, there have been no serious attempts to triage the utilization of limited display space effectively and efficiently. These and other deficiencies of prior art systems compromise their usefulness and render them of little help.

SUMMARY OF THE INVENTION

It is recognized that information is often best presented by employing graphical symbols or icons. In the case of aiding on-line poker play (the illustrative embodiment of the invention), simple icons (as below defined) are the only way to bring home a message in the time allowed for a decision to be made. Late delivery of information renders it useless.

The problem of efficiently and quickly presenting information becomes more difficult when presentation space is limited. Displaying useful information becomes even more complicated when a situation is changing rapidly as bets are made and players fold. Decision making has to be accomplished in seconds. Typically, about 70 hands, each involving multiple decisions by often up to ten people, are played in a single hour. When it is a player's turn, he must act almost immediately. The consequence of not making a timely decision is often that the game software automatically folds the delaying player's hand, resulting in the loss of any 'chips' that player has bet into the pot. Chips as used herein may represent actual money (e.g., a 5 chip=$5), tournament chips (e.g., a player enters a tournament for a fee [some have a real money or other prize structure] or gratis and receives a fixed number of chips such as 2,000), or play funds with no value. Any reference to money/amount herein and in the drawings may be understood likewise as a reference to chips to accommodate tournament, play-money tables, etc. The invention works in all of these contexts, and more.

The invention provides for the prioritization of information that is displayed. For example, it is very helpful to know that a particular player is an aggressive bettor, but this information is of no help if that player has folded and is no longer in the current hand. A typical on-line poker display is cluttered and there is little available space. What space is available should not be wasted with data about a player who is no longer in a hand. Ideally, and with limited exceptions, information related to player tendencies should be provided only as to the other players still in the hand. Moreover, information specific to a player's typical conduct, not to mention the hand in progress as a whole, should be a function of the instantaneous stage of the hand which changes moment to moment. Even priorities change over time and in specific situations.

The invention satisfies an existing need for a technique in which iconic information is dynamically reprioritized as events occur and situations change. This technique handles the display of icons for multiple entities simultaneously. It allows for separate iconic prioritization of information about individual entities and information about the group. Finally, it allows for optimizations of iconic displays as the priorities of monitoring individual entities change. The entities in the illustrative embodiment of the invention are virtual poker players, but the principles and techniques of the invention are useful in other applications as well.

In the poker context, the iconic/summary text information is a function of the conduct of the player for whom information is being provided (referred to as a 'selected' player to distinguish him from other players), the conduct of the other players in the hand who are at remote locations and playing virtually at the player's table, and the cards that are being dealt. The cards that are 'known' are the 'hole' cards dealt to the selected player, and the community cards are the cards that are 'open' and seen by all players.

The methodology prioritizes information which anticipates possible conduct that is situationally specific and relevant. By way of example, consider a player who is the third person to act (after two initial 'blinds,' to be described below—players who place bets before they receive any cards) at a 10-player table and who is considering calling a bet where he has nothing invested and holds a speculative hand of 8 and 9 of the same suit, as distinguished from a made hand such as two Kings. Such a player would be well advised to know that several of the players who will act after him routinely raise and re-raise if they like their hands. Calling might simply be throwing away chips, because he will fold to a possible raise.

As another example, consider the same player, with the same hand, who is now seated so that he is the last non-'blind' player to act at the same table after seeing that so far all other players have folded with the exception of the two people who posted 'blind' bets. He would now be well served to know if either player who posted a blind bet often defends his blind bets. A defender will call just to see if the cards coming will help him even if he does not have a good hand. Against such a player many believe a call should be made with 8 and 9 of the same suit. Conversely, some players do not defend blinds—against these players many believe a raise should be made in the above situation with 8 and 9 of the same suit, as the players who posted blind bets may likely fold, thereby forfeiting their chips to the raiser.

Prioritization allows for focus on important decision-making elements, over those of lesser significance or even irrelevance, increasing the possibility of optimal decision-making. The invention includes a unique methodology of supplying situational prioritization of information to remedy what can be termed 'information overload.' Space for essential information is always made available because information of lesser import—absent available time and space to display it—is not provided. Once information is no longer germane, its display is removed, with the information being re-presented on the selected player's display only on its becoming relevant again.

In the poker context, the invention is a computer-controlled method of providing information to each of a plurality of selected players participating in an on-line poker game with other players, in which the players observe table play on display units and make bets by operating data entry devices. A display unit can be a monitor, cellular telephone screen, or any other device that can communicate and display information that it receives. Similarly, any of many available data entry devices (a mouse, a trackball, etc.) may be used. A database of information pertaining to the playing habits of players is maintained, the database containing information gathered during both play in previous poker games and play in the poker game in progress. During a poker game in progress, a central server continuously analyzes both cards as they are dealt and play of the players, and continuously updates the database as the game progresses. The server provides information for display on the display unit of a selected player that pertains to predicted continued play of the hands in the poker game in progress as they develop, predicted betting of the other players in the poker game in progress, advantageous betting by the selected player in the poker game in progress, on-going play of the poker game in progress, or on-going successive poker games played at the table, the information provided being derived from the database that includes updates that are made as the game proceeds. The analysis allows for the provisioning of information taking into account session-specific atypical conduct by a player (sometimes referred to as 'tilt'). If the service is provided on a subscription basis, it is expected that a fee for the service will be charged. On the other hand, an on-line poker site may provide the service to all players, in which case all players would be 'selected' players and the fee might be considered part of the earnings of this site.

The database of information pertains to the ways players at the table have played both at the table at which they are now playing and tables at which they played in the past with other players. One departure from the prior art is in collecting data from players even when they are playing with all non-subscribers. (In other words, data is collected on players who are not being provided with information on other players.) The information can be broken down to characterize a player's play when he was at a table with the same players with whom he is now playing or a subset of those players. This information may be useful if it is suspected, for example, that players at the table are playing collusively with each other, play more aggressively with one another or, play particularly poorly when seated together and competing against each other. The database is continuously updated pertaining to the ways players at the table are presently playing even at other tables (if they are playing simultaneously at multiple tables, which is possible in on-line games). The database of information further pertains to the ways players at the table have played both (a) at the table at which they are now playing and (b) at tables at which they played in the past with other players even when they played at such tables at which no selected player was playing. This allows a selected player to be given information that is indicative of how at least one other player at the table played a number of times in the past when the games in which that other player was playing had situations similar to the current situation at the table. The database of information further pertains to the ways players at the table have played at tables of the same economic level as the one they are now playing (e.g., a no limit table of a certain buy-in and with a certain blind structure, a limit table with certain structured betting, etc.), and can supply information unique to observed historical play at many types of tables. Similarly, the database of information may supply information about the ways players at the table have played at a table of the same number of opponents (e.g., a table with just five), and may supply information unique to observed historical play at such a type of table.

An important feature is that the information that is displayed is changed automatically as the game situation changes without intervention by a selected player. A selected player does not have to ask for information of a specific type. The most relevant information he can use is dynamically prioritized and automatically presented to him. The type of the information that is displayed changes automatically (e.g., potential outcomes, suggestions for betting, player traits, etc.) as well as the instance of information (e.g., changing potential outcomes as the cards are progressively dealt). If there is insufficient room on a display unit to display all of the possibly applicable information that would otherwise be displayed, only the most important information is displayed in accordance with a predetermined hierarchical scheme. An example of such most important information would be advantageous betting recommendations that are based on cards dealt in the game in progress and playing habits of other players at the table as represented by information in the database.

Preferably, information is in the form of pictures (or possibly expressions) representing terms-of-art (e.g., 'Busted Draw' to be described below) with hover-over hints providing their definitions. In most cases there is no accompanying numerical information. Hereinafter, such pictures or expressions are referred to collectively as icons.

Although the invention has been described thus far in terms of a central server and what might be referred to as a 'client' display (typically a PC), the invention is broader in that it embraces a data stream (such as might be found on the Internet) containing information for players participating in an on-line poker game with other players in which the players view table play on displays and make bets by operating data entry devices. The data stream is derived from a database of information pertaining to the playing habits of players, the database containing information gathered during both play in previous poker games and play in the poker game in progress, and the database being continuously updated during the poker game in progress in accordance with an analysis of both cards that are dealt and play of the players. The data stream contains information for display on the monitor of a player that pertains to predicted continued play of the poker game in progress, predicted betting of the other players, advantageous betting by the selected player, on-going play of the poker game, or on-going successive poker games played at the table.

The Rules of Texas Hold'Em

The invention is not about a particular poker game or even poker in general. Nevertheless, the invention must be described in an illustrative context. To appreciate the nuances of the invention, the basic rules of Texas Hold'Em must be understood. The below rules are specific to a virtual setting. Play uses physical properties when non-virtual play occurs.

The game is played with a virtual version of a standard 52-card deck, with four suits—Clubs, Diamonds, Hearts and Spades—each having 13 cards—2, 3, 4, 5, 6, 7, 8, 9, 10, Jack, Queen, King and Ace. Cards are virtually shuffled before each hand, to a degree of complete randomness. When each hand concludes, a new hand disregards the cards previously played and opens with a fresh randomized deck.

Each player receives two cards face down ('hole' cards). Five cards are turned up in the center of the table and used by all players. Players may use any combination of their two hole cards plus the five community cards on the table (also known as the 'board') to make the best five-card poker hand. Ranking of hands is the conventional ranking, with the highest hand being 10, Jack, Queen, King and Ace on-suit (the highest straight-flush) and the lowest potential winning hand being high cards (when there is no pair or better hand). Two or more players may tie, in which event each receives an equal share from the pot created by the betting. All suits are equal in value in determining a winner.

When the table play starts, a face up card is dealt from the virtual deck to each 'seated' player, and the high-card recipient (as to card value, Club, Diamond, Heart, Spade is the ascending order of value, Ace of Spades being the highest card) is designated the first 'button' (dealer) position with 'blinds' (to be described below) clockwise from this position.

Actions may be taken by a player only when it is his turn to act. In structured games, betting limits double after the 'turn' (to be described below) is dealt. At any time, to 'call' a player must put in either the amount of chips of the bet(s) made in that betting round prior to his turn, or his entire amount of chips ('stack') at the table. If ever a player bets his whole stack—which is less than the bet(s) prior to or after his turn—another player's exposure to that player is equal only to the amount of that player's whole stack invested in the pot. As to such a player, known as 'all in,' and the player(s) he competes with through the 'river' (to be described below), players who later fold not being considered, the hand will always be fully dealt out, with a winner declared, using all board cards. After a player or players go 'all in,' betting can continue by other players. When this happens, separate 'side' pots can be created for the players who continue betting and calling one another. These side pots are won by the continuing players, and in these hands two or more players can be declared winners (even if the 'all in' player makes the best hand, the continuing player with the highest hand will win the side pot). Depending on the site rules, a player or player may have the above 'all in' rules apply to him (even if he has chips), in instances where he benefits from a 'disconnect protect.' A disconnect protect allows a player to avoid being folded from an on-line game if the game server perceives that he has been disconnected from the server.

In 'no limit' games, any player can bet his stack or any portion of it, but with a minimum 'call' of the lesser of the bet(s) made in that betting round prior to his turn or his stack. All raisers can raise their entire stacks or any portions of them but with a minimum of the lesser of the entire stack or the amount of chips of the bet being raised (e.g., a prior raise of $20 can be re-raised by an amount of $40 or more). If ever a player bets his whole stack, side pots are created as described above.

In 'pot limit' games, a player can bet up to the amount of chips in the pot to that point (including previous bets made in that round), or any portion thereof but with a minimum of the lesser of the value of the largest blind in that hand or his stack if his stack is less than the largest blind amount. To 'call,' a player must put in the lesser of either the bet(s) made in that betting round prior to his turn or his whole stack. All raisers can raise their entire stack or any portion thereof but with a minimum of the lesser of the entire stack or the amount of the bet being raised. If ever a player bets his whole stack, side pots can ensue.

The first player to the left of the dealer button must bet 'in the blind' before any cards are dealt. (In some games, two or more blinds are required.) After the blinds are posted, two cards ('hole' cards) are dealt 'down' (unseen by other players, and only to be played as part of the recipient's hand) to each player. After this, proceeding in a clockwise order from the blind bettor(s), each player may call the blind bet(s), raise or fold. Players required to bet 'in the blind' have an option to raise their blind bets on the first round of betting, with the farthest-clockwise-away blind bettor being the last to act in the initial betting round. At any time, a hand will conclude if there is only one remaining player still 'in' (not folded, while all others have folded), and if this happens that sole player is declared the winner and the pot is given to that player.

After the first round of betting, the first three cards are simultaneously turned up (the 'flop') on the board as community cards. Then each player who is still 'in,' starting with the first 'in' player to the left of the button, may check, bet, call, raise, re-raise (re-raises may be limited to three in any round) or fold. The betting round is complete when there are no more parties left to act, or when there are no more bets or raises which have not been called or responded to by an all-in or fold.

A fourth card is then turned up (the 'turn') on the board as a community card, and betting proceeds for the remaining 'in' players as described above. Finally, a fifth and last card is turned up (the 'river') on the board as a community card, and betting proceeds for the remaining 'in' players. After the river round betting is complete, the last bettor's hole cards are opened and 'read' to determine the strength of that hand when combined with the five board cards, and the same reading of hands is then done in clockwise order with respect to the hole cards of each player still 'in.' The winner(s) are declared and the pot is distributed.

After each hand, the virtual-dealer-button revolves clockwise to the next player, placing that player in the virtual dealer position. The next hand then commences.

There are other elements of the game, which are not part of the invention described herein, that are known in the art. Some of these features are shown on the drawings to be described in order that the drawings be consistent with the way that Texas Hold'Em play typically appears on-line. These features are not further described as they are known to the millions of on-line poker players. (Although not included in the illustrative embodiment of the invention, it is contemplated that future options will also allow a user to tailor his screen to display just the information that he desires rather than all of the information to be described below.) An example of a commonly known feature is the 'rake' that is typically displayed, as will be described in connection with the drawings. A poker site does not bet with players. Instead, it charges players a fee for its hosting/supervising the game. There are typically two kinds of fees: entry fees charged in tournaments, and a rake collected from ring game pots (fees vary depending upon the games stakes, how far the hand goes and/or the pot's size). Rake shown in the drawings to be described below is a rake collected from a game pot. Still another example is the 'hand number' that is displayed in the table area. This identifier allows a player to involve the game site in any controversy he has (e.g., "In game xxxxx, I lost but should have won . . . ", or "player 'Pokerchamp' was rude to me," or "I think players 'Pokerchamp' and 'Masterplayer' were playing collusively," etc.).

BRIEF DESCRIPTION OF THE DRAWINGS

Further objects, features and advantages of the invention will become apparent upon consideration of the following detailed description in conjunction with the drawing, in which:

FIGS. 10-11 depict the icons that are used in the illustrative embodiment of the invention in order to convey information, the numbers identifying the icons being tied to the same numbers that reference the icons in a table in the detailed description; and FIGS. 12-40 depict flow charts that illustrate how some of the information provided to a selected player is derived (flow charts are not included for the features for which the processing is straight-forward and which would be readily understood by persons skilled in the art).

THE HARDWARE

Figure 1:
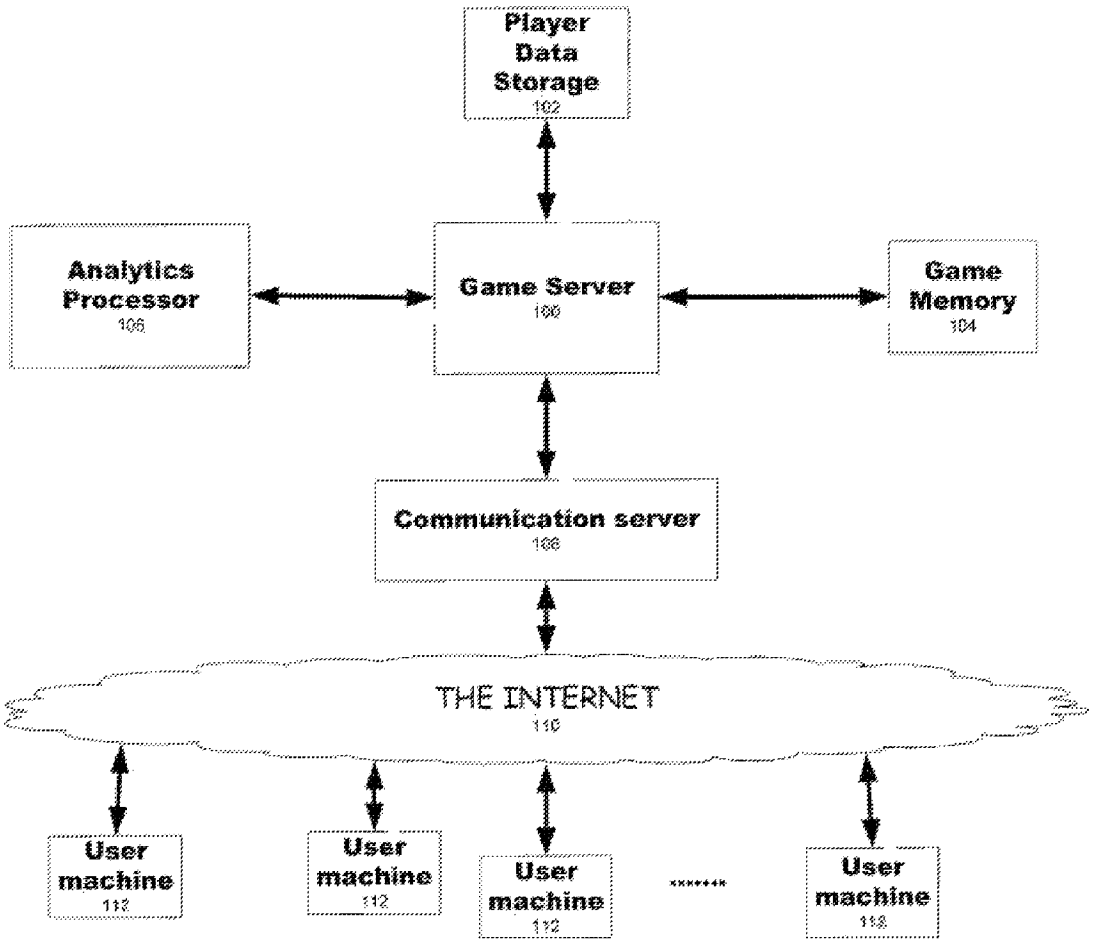
FIG. 1 depicts an overall system including a server machine which hosts an on-line poker game and is equipped to provide the service provided by our invention, and a plurality of user (client) machines.

The heart of the system of FIG. 1 is a game server 100, of which many examples exist in the prior art. The game server (which may be an array of processors) interfaces with two types of memory—player data storage 102 which maintains data pertaining to players who use the poker site, and game memory 104 which records data pertinent to games in progress. (Data collected during the course of games in progress is used to update the player data storage which accumulates long-term information about players.) Analytics processor 106, which need not be a separate unit, performs the analyses to be discussed below and determines the information that is to be provided to selected players.

Communication server 108 transmits data to players and receives data from them, and transfers such data to and from the game server. The Internet 110 is the communications medium that connects user machines 112 to the server host. Although the Internet is the preferred communications medium, any other communication medium that has sufficient technological qualities, e.g., bandwidth, will suffice. There is nothing about the server or hardware that is unique and the hardware at any conventional poker hosting site can be used to implement the system and method of our invention.

Figure 2:
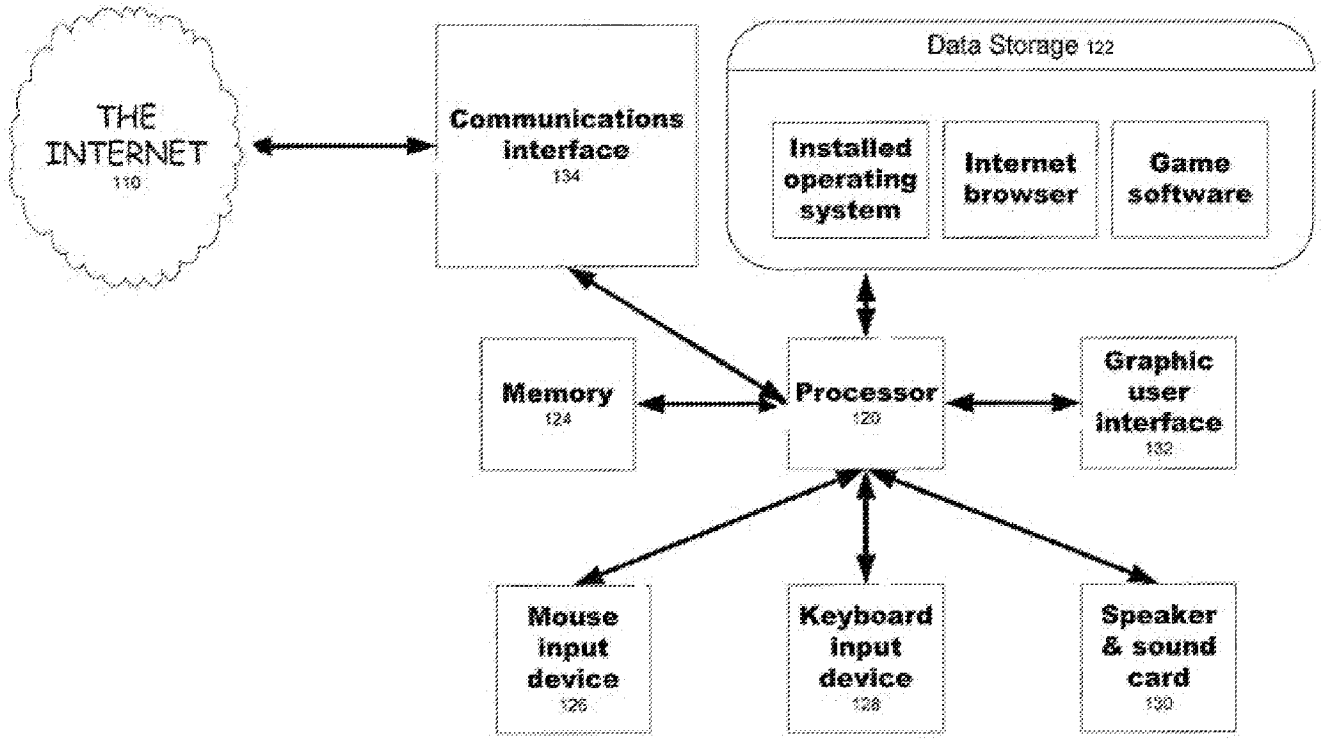
FIG. 2 depicts a user (client) machine which may be used by a subscriber who plays poker on-line and who pays for the service provided by the invention (although it is possible for all players at a poker site to be provided with the service, in which case all players are 'selected' players)

Similarly, the user client machines are also standard equipments, and conventional PCs can be used. A typical client machine, as shown in FIG. 2, includes a processor 120, memory 124 for storing data pertinent to a game in progress, and a conventional graphic user interface. Input/output devices include a mouse input device 126, a keyboard input device 128 and a speaker and sound card 130. In addition to memory 124 which stores temporary data, data storage 122 has the installed operating system, browser software and game software. The client machines are the same as those presently used by millions of people who play on-line poker.

To communicate over the Internet in general and to a game host in particular, the client machine includes a communication interface 134 which is shown connected to the Internet 110. (The invention may also be used in a physical setting, such as a casino, through play being networked and hosted on site. Such an implementation might utilize linked units, much like linked electronic slot machines, with appropriate back-end technology including servers, networking, etc.)

There are numerous features provided for today's on-line poker players. One such example is the ability to chat with other players. Another is the provision of sounds that accompany certain events on the virtual poker table displayed on the monitor of a player (e.g., the sound of a slot machine paying off when a pot is won by a player). While the embodiment of the invention disclosed herein emphasizes only the features necessary to understand the invention, it is to be understood that standard features of on-line gaming are also contemplated.

An Illustrative Game Scenario

Before proceeding to describe all of the types of information that can be provided to a selected player and how this information is determined in the first place, it will be helpful to show the invention in use. (That the reader is familiar with on-line poker play is assumed.) Toward this end, FIGS. 3-9 should be consulted; they depict much of the information to be found on typical 'screen shots' as an illustrative game proceeds. The idea here is to illustrate how a selected player might use the information provided by the invention. In the scenario, a selected player (our player, or 'Me' in the illustrations showing what happens after he joins the table) wants to join a $5/10 table ($2 small blind, $5 large blind, $5 bets on the pre-flop and the flop, and $10 bets on the turn and the river). The following narrative describes actions that take place together with our player's thinking.

Picking a Table

Our player wants to play at a $5/10 table and it would be smart to scout the tables for the best target. In perusing potential tables, he chooses to look for a loose group to play against. His style is tight-aggressive, and it works best against more reckless players.

Figure 3:
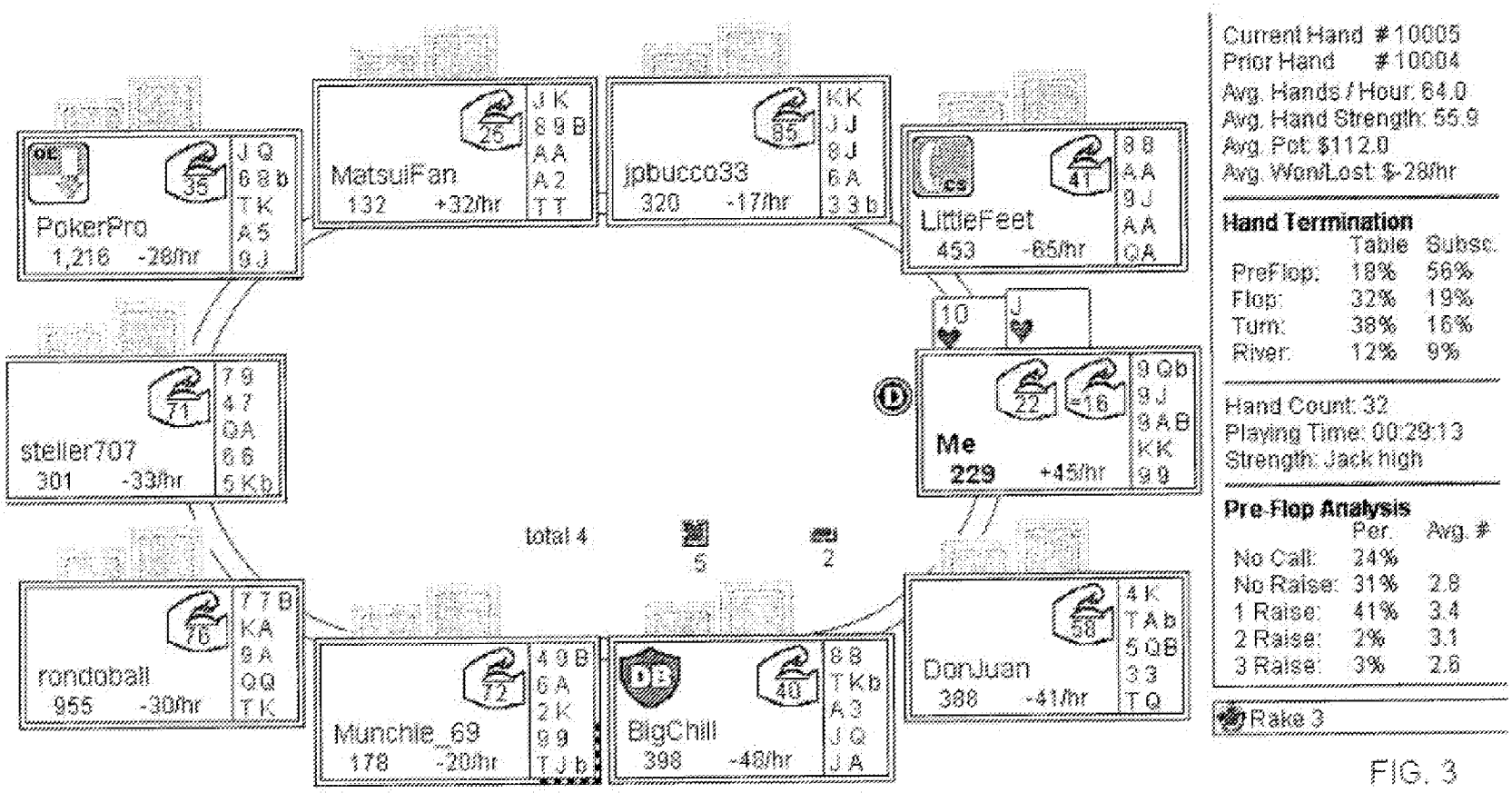
FIGS. 3-9 are illustrations of the type of 'screen shots' encountered during the course of playing a hand of Texas Hold'Em (the screen shots depict many, but not all, of the different types of information that are displayed in accordance with the invention)

FIG. 3 depicts a table during the course of play after our player has joined. But a player can observe table play even if he is not playing. Assuming that our player observes the table shown in FIG. 3 even before he joins, the Table Box on the right side gives him critical information. Not only does it give him the usual data, such as average pot size, but it gives him the average starting hand strength of players who voluntarily put chips in the pot. (This excludes big blinds on non-raised pots who have no choice but to bet and therefore might as well stay in. Small blinds who stay in and see the bet of a big blind—by adding chips to the pot—are considered to have voluntarily put chips in the pot.) The average starting hand strength statistic is very important for a tight-aggressive player to know. There are 169 starting hands in Texas Hold'Em (13×13 [excludes permutations associated with specific suits, as suits are irrelevant to hand strength, but recognizes suited hands such as 8 and 9 of Spades as different from an unsuited 8, 9 hand]—a player starts with two cards), and a big factor in whether a hand wins in the end is how strong it is at the beginning. Knowing how strong a hand a player, on average, requires pre-flop (before any community cards are dealt) in order to voluntarily invest chips in the pot at a particular table is therefore very valuable information.

The table of FIG. 3 has a 55.9 average hand strength. This indicates that at this table the players, on average, are voluntarily putting in chips on relatively weak hands. (The average hand strength is calculated based on the hands of players [other than the selected player] whose cards were exposed either because they won a pot or because they bet all the way through the river card and their cards were exposed at the end of a hand that they lost.) There are other positive aspects to this table. The 'Pre-Flop Analysis' Table Box area of the screen indicates that the pot gets raised and re-raised before the flop on 46 percent of the hands; this is a very high percentage. Also, the average number of players who stay in on the raises is high; for example, on hands where there are two pre-flop raises, an average of 3.1 players stay in. This means that the player's powerful hands will probably get the action he wants. He therefore joins the waitlist to play at this table, studying the individual player profiles while he is waiting.

Before looking at some of the player profiles, it will be helpful to understand all of the information shown in the table box on the right side of FIG. 3. The current hand at the top is the number of the hand being played, and underneath it is the number of the previous hand at this table. They are not necessarily consecutive, as the hand number is the number of the hand played at the poker site as a whole, not just at this table. It is important that every hand be identifiable, for example, so that disputes can be arbitrated at a later date.

The same area in the table box shows the average number of hands played per hour at this table, the average hand strength discussed above, the average pot at this table, and the average historical winnings or losses for all players at the table. (If our player joins, his average winnings or losses are not included in this value, thereby allowing him to compare/contrast his average performance with the other players' average.)

The next area in the table box, referred to as Hand Termination, shows the percentage of hands at this table that ended pre-flop, after the flop, after the turn, and after the river. This information also helps our player decide whether this is the kind of table at which he is accustomed to play. The column on the right shows the same information for hands played at this type of table (e.g., $5/$10) by our player, referred to as a 'subscriber' if he pays for the information service being provided in a pay-for-service application. Of course, the information applicable to our player is displayed only after he joins the game. The term 'subscriber' should be understood to be the same as 'selected player' as that term is used elsewhere herein.

The third area in the table box only comes into play if our player joins; it contains data applicable only to a selected player. (The screen shot, as will be described below, is actually of the table after our player has joined and has been playing for a while.) The Hand Count is the number of hands for which he has already received cards (he may have voluntarily played these beyond the posting of blinds). The Playing Time tells for how long he has been playing. The Strength entry is the strength of his current two-card hand. In the pre-flop game depicted, all our player has is a Jack-high. The entry changes during the course of a hand to reflect our player's hand strength taking into account the community cards.

The Pre-Flop Analysis was described above. The left column shows (1) the percentage of hands in which there were no callers (where even the small blind did not call the bet of the big blind); (2) the percentage of hands in which there were callers but no raisers; (3) the percentage of hands in which there was one raise; (4) the percentage of hands in which there were two raises; and (5) the percentage of hands in which there were three raises. The numbers in the right column represent the average number of players who remained in the hand after the pre-flop stage for each of the five listed situations.

Studying Player Profiles

Referring to FIG. 3, each player has a screen name. Icons and data are shown on the placard area of each player. DonJuan's average hand strength icon (represented by the 'muscle' on his arm) shows his average starting hand strength. With a value of 1 being the strongest hand (Ace-Ace) and a value of 169 being the weakest, a value of 58 shows that DonJuan is loose, playing an average starting hand with a strength of 58. Obviously, he is not too diligent about folding weak hands.

Although not the case for DonJuan, a typical icon that might be shown for a player is the "CB" (continuation bets) blue-colored icon (blue generally means that an icon is informational) that indicates he follows up early bets with later ones, regardless of whether he makes a hand. That kind of opponent is also good for our player's style of play.

LittleFeet's placard shows a telephone icon. This means LittleFeet is a 'Calling Station,' who will call many bets, pulling for 'miracle' cards. Our player wants LittleFeet in his game.

PokerPro's placard has a blue "Out of Element" icon. The down arrow indicates PokerPro usually plays a table with higher stakes, such as $15/30. (An up arrow indicates he usually plays at a table with lower stakes.) Either he is low on cash, waiting for a $15/30 table to open up, or he thinks he can outplay, perhaps push people around, at a $5/10 table. Whatever the reason, our player suspects that PokerPro will play looser than his norm. This may partly explain the action level at this table.

MatsuiFan has an arm-strength icon with a muscle reading 25. This means that his average starting hand is $25^{th}$ best out of 169. He is a cautious player. Our player also just saw him play a hand where on a later betting round his placard showed a "CR" warning arrow, indicating a check-raise tendency. MatsuiFan is a player to be wary of, especially if he acts before our player and checks (because if our player bets, MatsuiFan may raise and it may cost our player more than he wishes). The CR warning icon, like most cautionary icons, is colored yellow like a warning road-sign.

Play After Joining

It is assumed that our player has joined the table and has been playing already for 29:13 minutes (see FIG. 3). In fact, he is now the dealer, shown by the D-in-a-circle on the table directly to his left. His placard (indicated as 'Me' on the table) shows his remaining stake ($229), just as every other player's placard shows his remaining stake. Also shown for each player is his historical winnings or losses per hour at this type of table. Our player wins on average $45 per hour when playing at a $51/$10 table, while Munchie_69 on average loses $20 per hour.

In the current hand, our player was dealt a 10-J of Hearts on the button. (A player 'on the button' means that he is the last to act for each decision in the hand with the exception of pre-flop [where he acts third to last] the small blind sits to his left and the big blind sits two seats to the left of him.) Our player's placard includes two hand strengths. One is his historical average, just as the placard of every other player includes such an historical average—the average strength of a hand for which the player voluntarily puts chips in the pot. The rightmost hand strength icon (the one with the '=') for our player is something different. It represents the hand strength of his current hand, 10-J of Hearts, which in this case is 16.

On the right side of each player placard is a display of the last five hands played past the flop by the player (with 'b' and 'B' notations, where appropriate, to indicate small blind and big blind, respectively). The two cards of a hand are shown in the same way if they were suited; if they were of different suits, they are shown in different colors or shadings.

It should be noted that DonJuan is the small blind (to the left of the dealer) and a half-square (blue) chip is shown to indicate this, together with the number 2 to show that he has bet $2. The full square (blue) chip next to BigChill shows that he is the large blind, having bet $5 whether he wanted to or not. The bottom right of the screen shows a Rake of $3, the amount that the poker site takes for its services. That is why the middle of the table shows a pot total of only $4 instead of $7, the actual amount initially bet by the two blinds. In general, the middle of the table has two numbers (see FIGS. 4-8). The upper number is the pot total before the current round of betting. The bottom number is the current pot total, with this number increasing continuously as the players call and raise during the betting round. There is no upper number in FIG. 3 because at the pre-flop stage there was no prior pot total.

Figure 4:
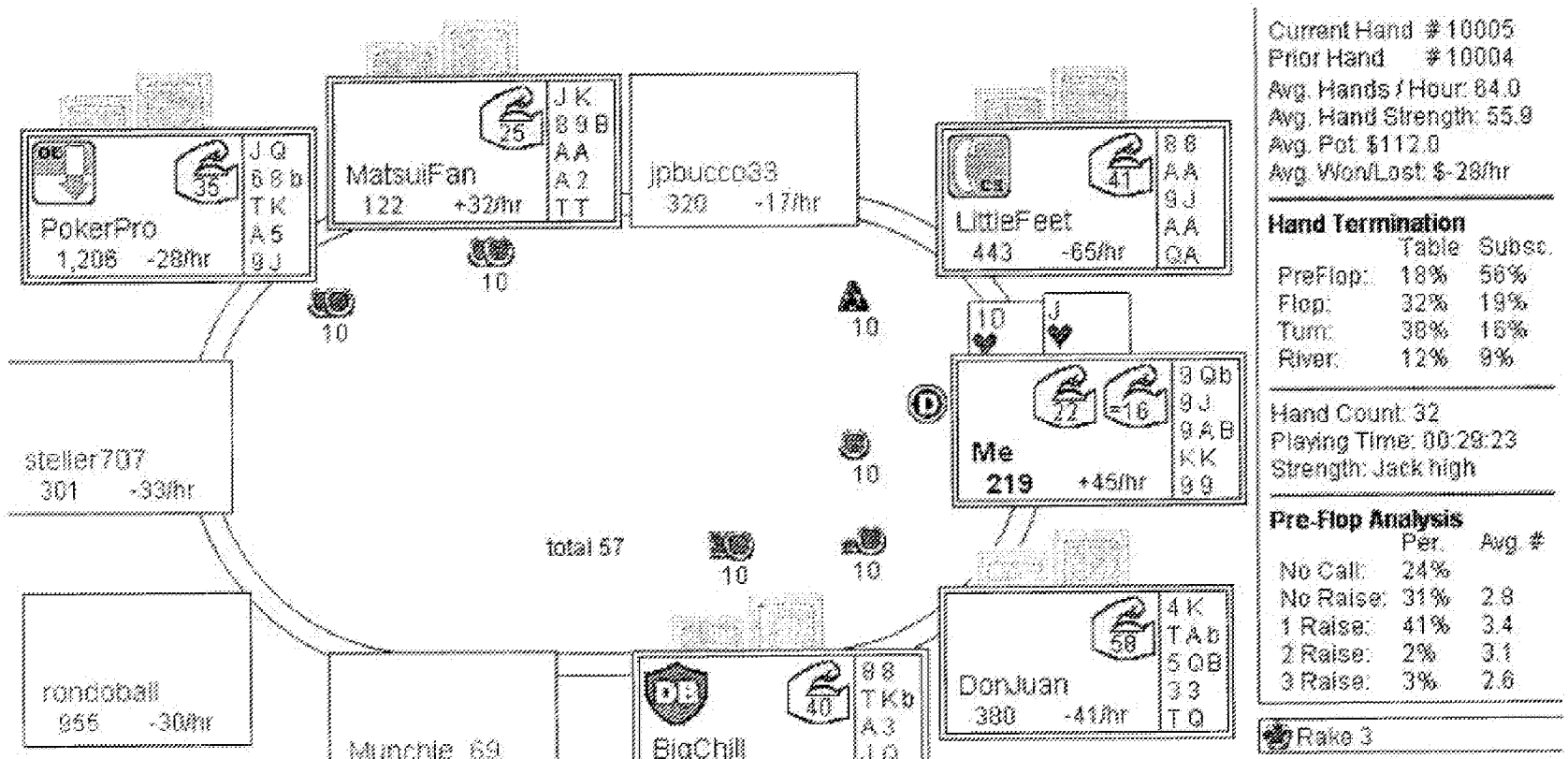

Referring to the next screen shot of FIG. 4, three players folded and then PokerPro and MatsuiFan called BigChill's blind bet. A call is shown by a round (green) chip. Then, LittleFeet raised $5, shown by a dark (red in color) triangular chip, and our player called $10 (the big blind's initial $5 and LittleFeet's raise). DonJuan, the little blind, BigChill, PokerPro and MatsuiFan also called the raise, which is why a second chip is shown for each of them. (A single chip is shown for each action, no matter how much the amount put into the pot.) LittleFeet is the only player with a red chip since no one else raised his bet. (As will become apparent, a light (yellow in color) triangular chip represents a bet, of which there can be at most one per betting round. LittleFeet has a red triangular chip because he raised the blind bets; he did not originate betting on the round for which a yellow triangle would have been displayed.) At the end of the round, there are six players who bet $10 each, and the amount bet by each player is shown on the table next to the chip(s) that symbolize his bet. The placards of players who have folded are de-emphasized. In the black-and-white drawings, different shadings and shapes have been used to represent different colors.

BigChill, the big blind, has a placard with a "DB" (defends blinds) icon. This means he routinely defends his blinds by calling raises without a particularly strong hand. So he could have any two cards and his call does not necessarily represent strength.

At this point our player is most worried about MatsuiFan, who usually does not play weak hands, and LittleFeet, a 'Calling Station' who raised. The fact that LittleFeet raised indicates that he could have Ace King or another premium hand like Jack Jack.

Figure 5:
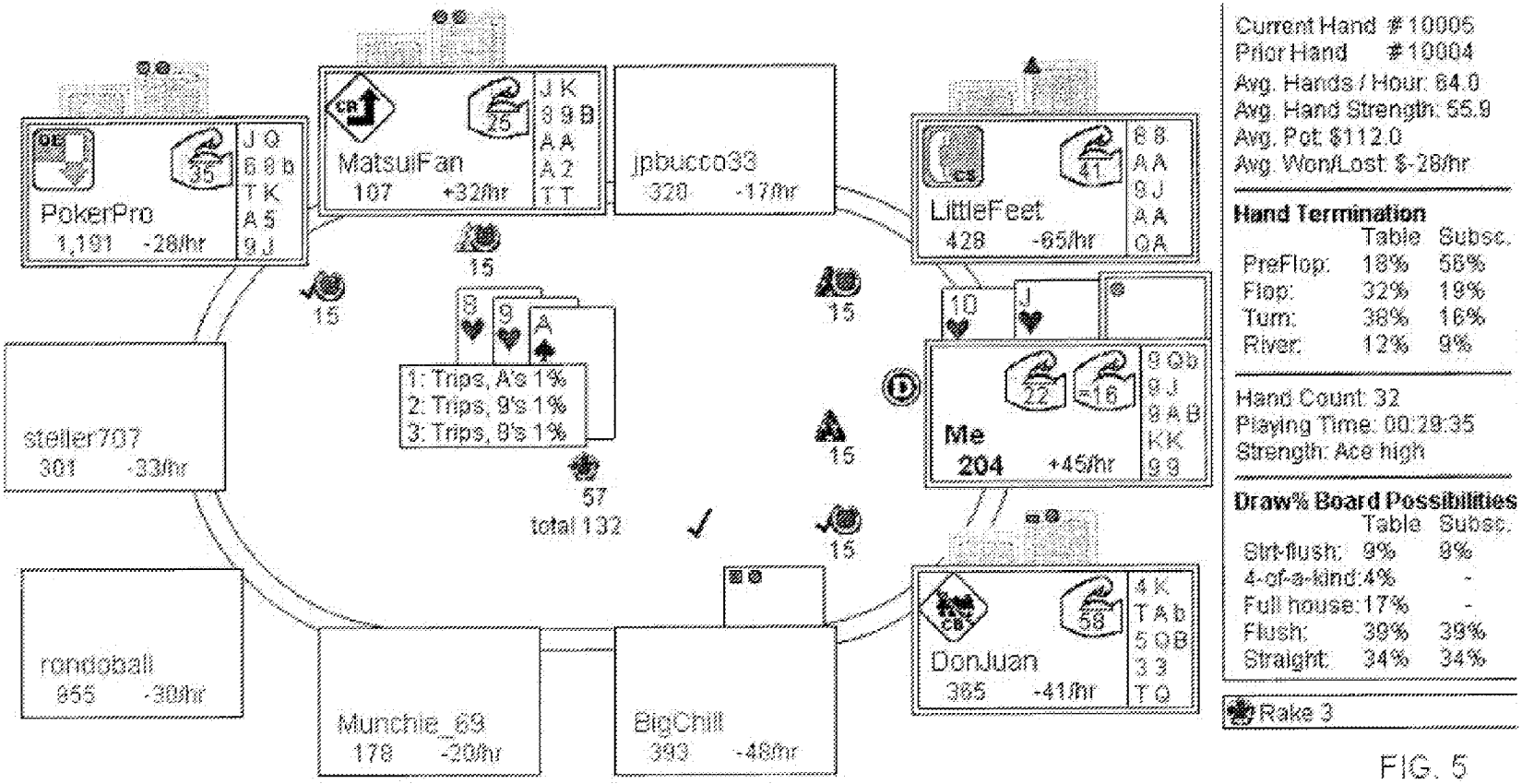

During a round of betting, the blue, red, yellow and green chips on the table indicate what is going on. (The sequence is represented clockwise from the three position). After a round of betting, when one or more community cards are dealt, the past betting is shown on the player cards. FIG. 5 shows the three flop cards. But it also shows what the betting was in the previous round. The (red) triangle on LittleFeet's rightmost card indicates that he raised. The (green) circles on each of our player's rightmost card, and DonJuan's, PokerPro's and MatsuiFan's rightmost cards, indicate that they called LittleFeet's raise. The half square on DonJuan's card indicates that he is the small blind. A third card is shown for our player to display his history of betting in the game because there is no room on his hole cards which, unlike the hole cards of the other players, include card values (10-J of Hearts).

The hexagonal (purple) chip in the middle of the table near the pot total simply indicates how many rounds of betting there were. Another such chip is added in each round.

Play After the Flop

Continuing with FIG. 5, the flop is displayed as 8h, 9h, As. (The random card generator used by the game server might have selected the cards in another order such as 8h, As, 9h, but for a selected player the flop cards are shown in an order that makes it easy to see the straight and flush possibilities of the 10 and J of hearts in the current hand.) Our player has 8h, 9h, 10h and Jh. The flop cards gave him quality straight and flush draws, and better yet, a straight flush draw. (However, his current hand strength is still only 16 since all he has is a Jack-10.)

On the table box it will be seen that there is no longer a Pre-Flop Analysis. That is because the flop has already occurred. In its place is a list of 'Draw % Board Possibilities,' for both any opponent (left column) and for our player (right column). Draw hands are displayed with their percentage probabilities. The difference between the two columns is that the calculations for our player take into account his hole cards. (Note that it will not be possible for our player to achieve 4-of-a-kind or a full house so these possibilities are shown still available only for the other players at the table.) In the probability calculations, 5-card hands that may already exist when taking into account the two hidden cards of each player are not counted. The draw hand probabilities relate to 5-card hands that may result when further community cards are opened. At the stage shown in FIG. 5, the possibility of a flush at the table is 39% and the possibility of a flush by our player is also 39%. As a tight player, our player bets this kind of hand for value despite not having a made hand.

Under the flop cards, a selected player is also given the three best possible hands that can be derived from the board's cards and the two cards of any player, together with the probability that the hand will be drawn. The best possible hands right now are Trips—Aces, 9s and 8s—and the probability of drawing each is 1%. There is a possibility that LittleFeet, the raiser, started with a made hand like a big pair, but in our player's mind he is more likely to hold A-K or some other card with an Ace.

The first three players who are still in checked (shown by check marks), and MatsuiFan bet $5, shown by a light-colored (yellow) triangle, followed by LittleFeet who raised the bet by $5, shown by a dark-colored (red) triangle. While it is possible someone is pulling for the 'nut' (best) flush draw (an Ace-high flush) and has already made a pair of aces, that is unlikely and our player raises the bet to $15—he has good draw possibilities. A dark-colored (red) triangular chip is placed next to his placard, and the number 15 is shown adjacent to it since that is the amount our player has put into the pot. (Whenever a player bets, calls or raises, the amount displayed next to his placard, which is the total amount he has put into the pot on the current round of betting, is immediately increased.) The center of the table continuously displays the increasing pot size after each calling or betting action. It now shows a total of $132 that reflects not only the original $57 pot before the flop was dealt, but also an additional $15 (MatsuiFan's $5 bet, LittleFeet's $5 raise, and our player's $5 raise) from each remaining player (BigChill folded) in the current round. Now our player is sure LittleFeet has just an Ace-high hand. If he was sitting well, he likely would have simply called rather than raise, and gotten a raise in on the higher value turn stage of the play.

While our player is still on a draw, he likes the fact that he now controls the hand as the last raiser. Perhaps someone with A-K now figures him for two pair or a set (thinking he has 8-8 and, with the board, three 8s). Perhaps he can win without even making his hand. He doubts it, given there are four opponents, but he still benefits from controlling the action and acting last.

Play After the Turn

Figure 6:
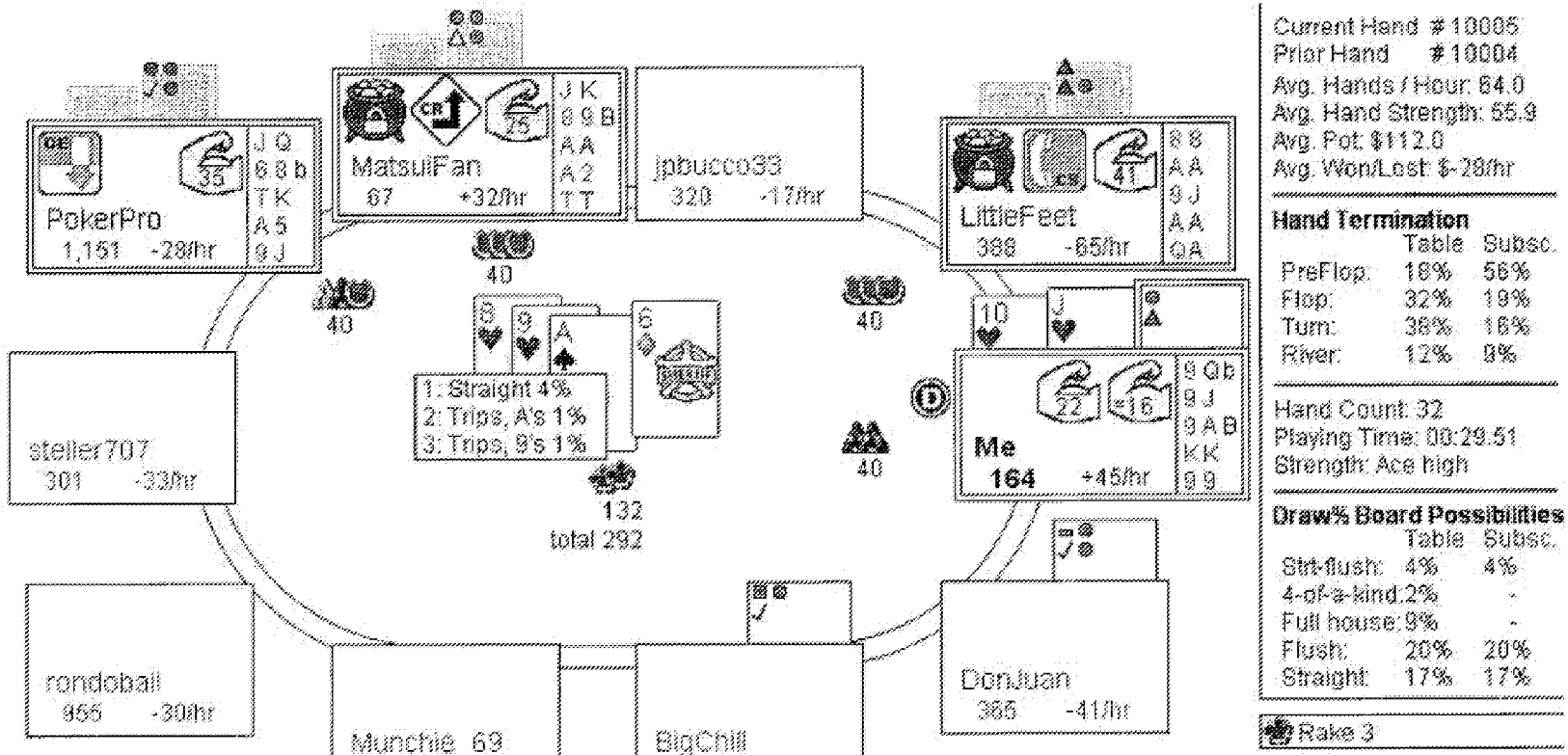

Referring to FIG. 6, the turn brings a 6 of diamonds. The "Sheriff" (blue for informational) icon is placed on the new card. The Sheriff indicates that the latest community card has created a new possibility for the high hand. Instead of A-A in hand (a player would have AAA with the Ace on board), the nut hand is now 7-10 for a straight (with the 6, 8 and 9 being on the board). It is unlikely, however, that someone is actually holding 7-10.

Also, the screen now tells our player, via the Hand Strength Board (feature 5 to be discussed below) under the open cards, that the best possible hand is now a straight (two hands—5-7 and 7-10—support it), and Trip Aces has moved to second place. Our player is not overly worried about a possible 5-7 or 7-10 still being in the game because no one should have played such a bad hand (there has been a lot of betting and raising pre-flop and at the flop, and it is unlikely somebody has called all of those bets with those weak starting hands).

The previous round of betting is shown on the second line of the player cards by (yellow and red) triangles for bets and raises, by (green) circles for calls, and (blue) squares or rectangles for blind bets. The order in which a player made his bets, raises and calls is shown left to right. For example, in the previous round of betting, MatsuiFan and LittleFeet each bet or raised first, and then called. Our player just raised once-PokerPro bets $10, and now our player is really curious about this Out-of-Element player. Has he stayed in with a 5-7 or 7-10 because the chips at this lower level was not significant to him? The bet-call notes (circles and a check mark) on his rightmost card indicate that this is the first time he has initiated a bet. Previously, he was just a caller.

The recent-5-hands list to the right of his placard shows the last five hands that PokerPro played past the flop. He played J-Q off-suit, 8-6 suited, K-10 off-suit, A-5 off-suit, and 9-J off-suit. On the 8-6 suited he was the small blind, but he was not forced into the pot on the other four. So our player concludes that, based on PokerPro's past play, he could very well have called a pre-flop raise and two post-flop raises with 5-7 or 10-7. But even if this is the case, at this point our player still has plenty of chances to overtake him-MatsuiFan called, LittleFeet called and again the action is to our player. Our player has yet to hit his card, but that is not the important issue. He plays to maximize his earnings. The question is, should he call or raise? With three people already in (and likely to call a raise), our player decides it is better to raise and risk losing DonJuan, the only player yet to act. It helps that the screen shows him that MatsuiFan and LittleFeet are pot committed (see below: a pot-committed player, shown by the pot-and-lock icon, is one who is heavily invested in the pot and will, if he has anything but no-draw cards—cards in his hand that cannot possibly let him win the hand no matter what the draw cards are—call if a raise is made). So our player raises to $20, and DonJuan folds (he has his limits).

PokerPro raises to $30, leading our player to believe that he does have 5-7 or 7-10. MatsuiFan calls, LittleFeet calls, and our player caps it at $40. He has gone too far to slow down and he trusts the knowledge the screen gives him.

Everyone calls. There are now four players in the hand and $292 in the pot, with $160 having been added in the last round.

It should be noted how the Draw % Board Possibilities at the bottom of the table box have changed. It is to be recalled that the possibilities listed are possibilities that can come with further community cards, not possibilities that may have occurred already. The straight-flush possibility for our player has decreased—before there were two cards yet to be dealt, one of which might be a 7 or Q of hearts. Now there is only one card yet to be dealt, so the odds of his hitting a straight flush have gone down. Similar remarks apply to the other possibilities. The value of this part of the display in general is that it tells our player that if he bets, other players may fold if they do not have good hands—it does not pay to invest in a pot if the odds of hitting a good hand are poor. (While our player wants everyone to stay in if he hits the straight flush, at the moment he has not done so, the odds of hitting it are not great, although a straight or flush is also possible, and the best thing that could happen to our player in this situation is for all other remaining players to fold.)

Play After the River

Figure 7:
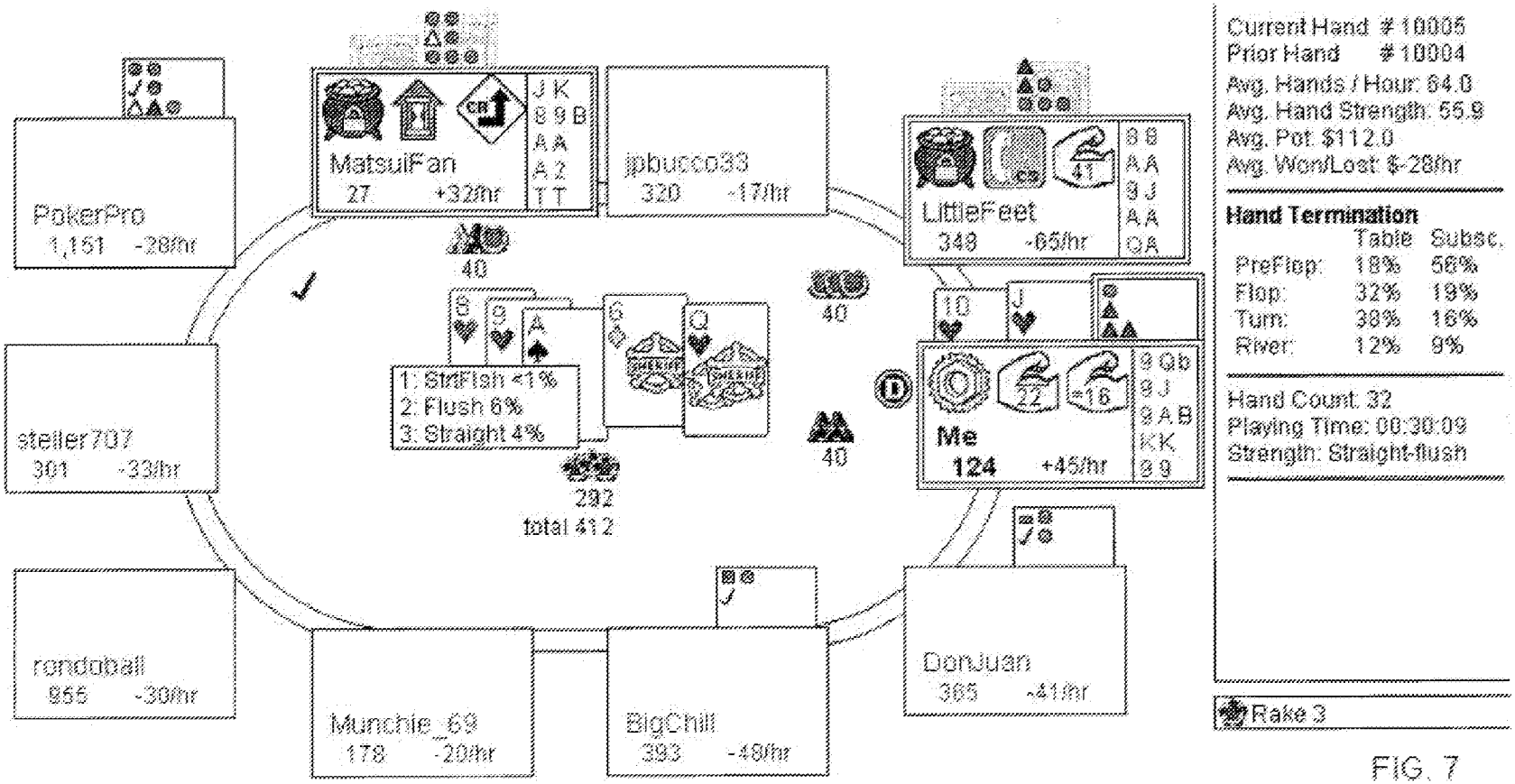

Referring to FIG. 7, the river is a Q of hearts. A new Sheriff icon appears on the board, indicating the best possible hand has changed—it is now a straight flush. A Deputy icon also appears on the new card, indicating that an inferior new possible hand has also been enabled—the regular flush. A gold "nut" appears on our player's placard, confirming that his straight flush cannot be beaten. The Draw % Board Possibilities at the bottom of the table box is no longer shown. They are no longer applicable since they refer to draw possibilities and there are no more cards to be dealt.

PokerPro checks this time, thinking one of the other players has made his flush. MatsuiFan bets $10. LittleFeet, the calling station, refuses to lay down his big Ace (which we will see in a moment that he has), and calls. (Perhaps he has A-Q and has made two pair).

Our player raises it to $20. PokerPro folds quickly. (He might be playing beneath his level, but knows when he is beaten.) Then MatsuiFan deliberates. He delays five seconds and a "Time Show Strength" icon (the middle icon) appears on his placard. This means that the software has analyzed his play and found that he typically dawdles before raising with very strong hands.

MatsuiFan raises to $30, and LittleFeet calls again. Our player caps it at $40, MatsuiFan calls, and LittleFeet follows suit.

Figure 8:
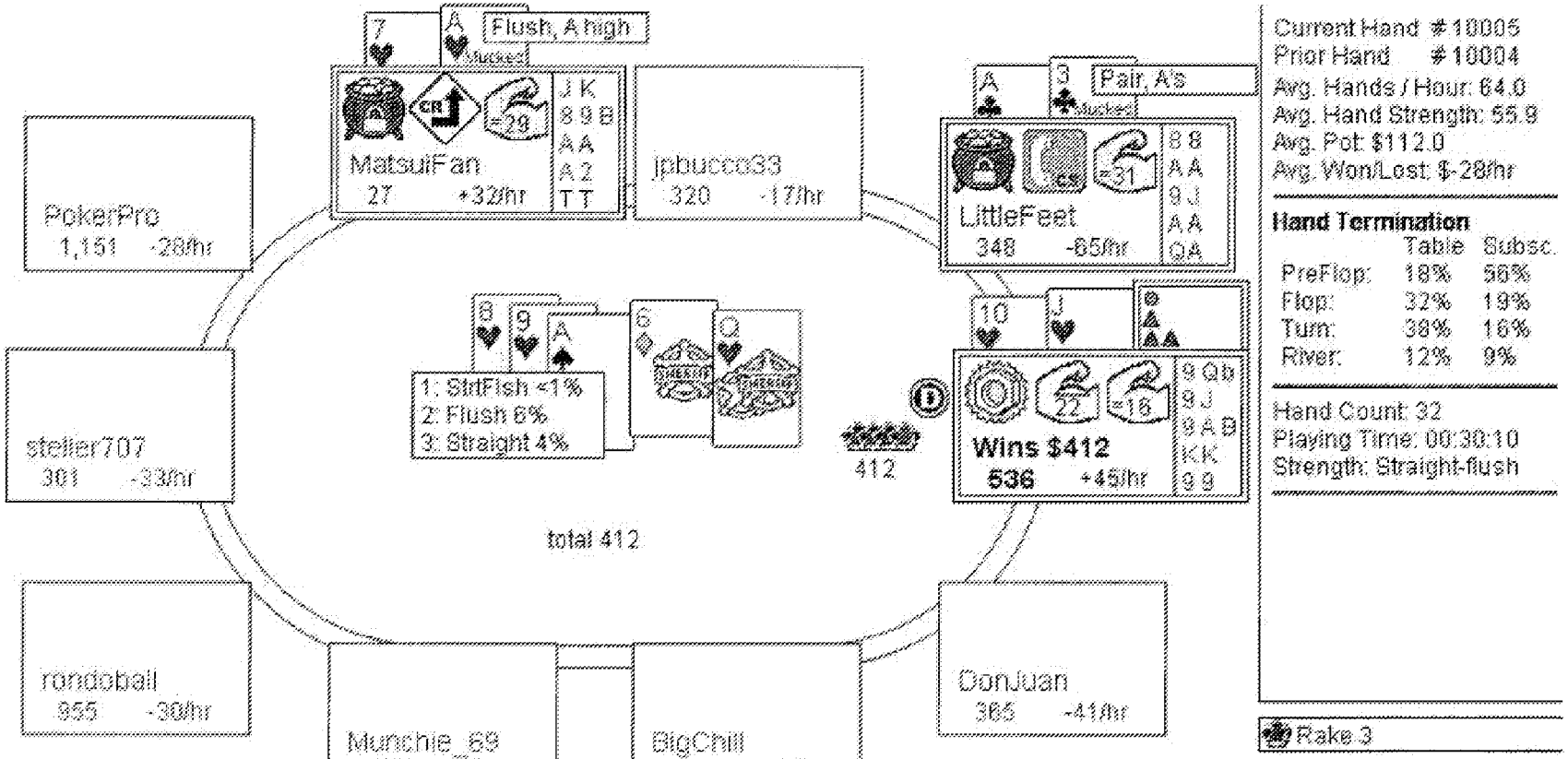

The hand is over and the hole cards are opened, as shown in FIG. 8. Our player's straight flush beats MatsuiFan's Ace-high flush (he has A-7 hearts in his hand). It also beats LittleFeet's single pair (A-3 clubs), proving that LittleFeet really is a reckless player. The on-line poker site pushes the $412 pot our player's way (the turn pot of $292 plus the new $120 of river bets).

Before the pre-flop action of the next betting round, and as shown in FIG. 8, the system shows the opponents' cards our player has been playing against, their 'Mucked' cards, together with their hand strengths (taking into account the board cards). This lets our player learn more about the opponents to help him in future play. For example, it appears that LittleFeet will not lay down high pair hands, even when he should know he is beaten.

The betting on the river round is not shown on the player cards. There is no reason to do so as the hand is over.

Epilogue

Figure 9:
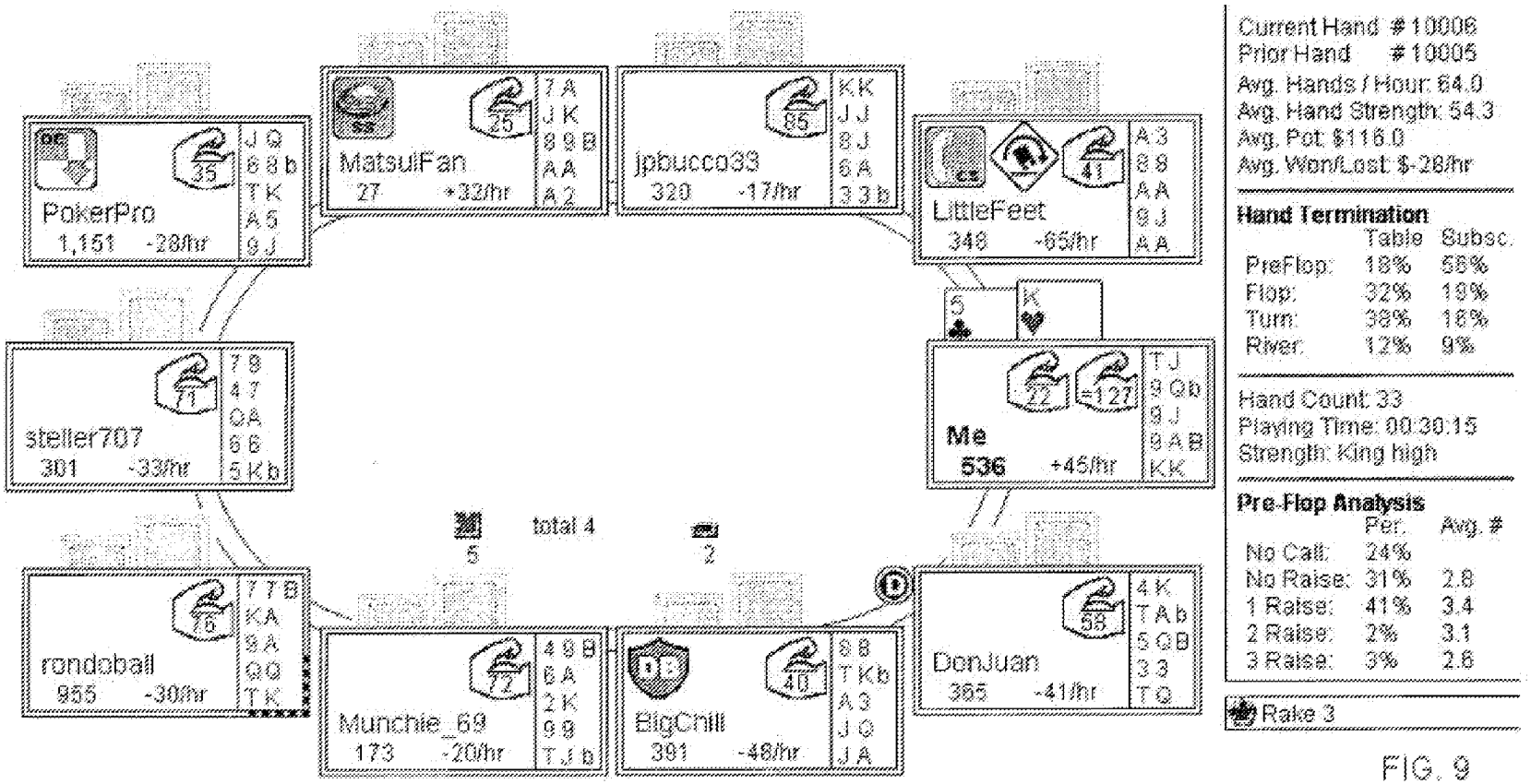

FIG. 9 shows the display at the start of a new hand. The dealer button has rotated one position clockwise to DonJuan. The five most recent played hands of the players are updated to reflect the last hand, but only for those players whose hands were exposed at the end of the hand (shown in FIG. 8).

Immediately, a Tilt Alert icon is applied to LittleFeet. He has taken several beats recently and the software notes that he has crossed over into wild-play land. He will likely continue his reckless play looking for payback.

The software also applies a Short Stack Alert icon to MatsuiFan. He is left with very little, relative to the table's recommended buy-in, after his loss on the latest hand. In a no-limit game (not that of the illustrative embodiment) he may likely try to put all of his limited remaining chips pre-flop into one pot with a lot of other players. That way, he will be 'all-in' and can see the whole board (without committing more chips), hoping to make a hand and multiply his bet by an equal amount from all other players who matched his 'all-in.'

Our player's placard indicates that he now has $536. All placards still show historical (long-term average) winnings/losses for each player—by comparing how much our player earns per hour on average with the historical per-hour-earning figures for the other players, he can decide whether he is playing at a table with players better than he is so that perhaps he should switch tables.

The Individual Iconic Features

Now that an illustrative hand scenario has been described, it will be helpful to list all of the available icons and other information, and to describe what each represents. FIGS. 10-11 show all of the icons (not all of the information provided is in the form of icons). The individual icons are numbered so that in any case where there is an icon, it will be possible to associate its description below with the same numbered icon in the drawing.

The information that is made available falls into four categories—information relating to the board (the hand being played); information relating to an opponent; information relating to the selected player who is being provided with the information; and information relating to the table (not the hand in play, but the table as a whole, e.g., the average pot). In what follows, the first column identifies the information and where it is located, the second column describes the information, and the third column discusses the feature's benefit.

Some of the features relate to historical information. For example, an 'Out of element, Up' icon identifies an opponent playing at a table with higher values than he usually plays (e.g., a $2/4 limit-table player playing a $15/30 limit-table). In general, historical information is based on the most recent 1,000 hands played. (Provided that at least 100 hands were played, information is provided; in most cases, fewer than 100 hands is considered too few for an accurate trait to be ascertained.) Unless indicated otherwise, a trait is assumed if 80% or more of the sample hands bear it out. In the 'Out of element, Up' example, this would mean that 80% or more of the time the player plays at tables where the stakes are lower than they are at the table at which he is now playing.

| Information Relating To The Board | | |
|---|---|---|
| 1. Board Hand Location: Across the board cards | If the board is a complete hand (straight, flush or full house), the board has the word 'STRAIGHT,' 'FLUSH' or 'FULL HOUSE' across its cards. Further, when the board cannot be improved, the gold nut (indicating the 'best' hand) is placed on each of the cards to signify that the board is the nut hand for all players. (This does not apply for quads, as there is a kicker. For example, if the board is AAA, A, 4 (AAA on the flop, A on the turn, and 4 on the river) a player with Q2 beats a player with 78.) | For calling purposes, and for potential bluffs, knowing that the board is a hand to itself, is important. |
| 2. Brick Location: On the card that is the brick | An image of a brick appears on the turn and river cards, if either card appears useless in terms of creating new likely better hands. This is somewhat the opposite of the concept of Sheriff and Deputy. | This lets a player know that there is likely nothing new. If he has a made hand or wants to bluff, he may bet somebody out who appears to be on a draw hand. |
| 3. Busted Draw Location: On the river card | This icon appears on the board after the river card opens, and shows that the likely draw hand from the flop, which an opponent may have been chasing, failed to happen (e.g., flop - 2h, 7h, Js; turn - 4d; river - Qs: no third heart opened to permit a heart flush). | This lets a player know that there is likely nothing new. He should bet if he has a made hand or wants to bluff, as he may bet somebody out who appears to be on a draw hand. |
| 4. Draw % Board Possibilities Location: On table box | On the right side of the board, draw hands are displayed with their percentage probabilities (e.g., pre-turn, given the board shown, the possibility of a flush is 5%). In the probability calculations, 5-card hands that may already exist when taking into account the two possible hole cards of each player are not counted. The draw hand probabilities relate to 5-card hands that may result when further community cards are opened. | This information, on whether a player may make his hand, or an opponent may call expecting to make his hand, suggests whether the player should 'bet for value,' if he feels his hand will be 'made,' or to try and bet in the hope of forcing others to fold. |

-continued

| Information Relating To The Board | | |
|---|---|---|
| 5. Hand Strength Board Location: In the board area | Near the board's cards, the best possible hands derived from the cards which have opened are shown. (Often this will be three possible instances of sets after the flop, with potentially no improvement at the turn and with the creation of straight or flush possibilities after the river.) This may show an opponent's likely hand (e.g., with a board that supports a straight at the turn and a flush at the river, if the opponent started raising at the turn he may have a straight, not a flush). | This lets a player know what possible hands might beat him. He may look to 'bet for value,' if he feels his hand is the best hand, or he may bet in the hope of forcing others to fold. |
| 6. Pot + Bet Location: Near where bets collect in the board area | Near the board cards (at the table's center) where the amount of the pot prior to the betting stage in progress is displayed, a separate display shows the amount of the pot plus the bets already made at the stage of the hand being played. This amount is continually updated. | How a player should act is greatly affected by knowing the amount of the pot. |
| 7. Reorder Flop & Stack 3 Location: Modifies randomly generated three flop cards | The flop is shown with the three flop cards put in ascending order (aids in understanding possibilities) - Ace will be the lowest if there is a 2, 3, 4 or 5 and no T, J, Q or K. Also, if an ascending order can be maintained, suited cards will be beside each other (e.g., randomly generated 5h, 5d, 7h will appear 5d, 5h, 7h). The cards are overlaid on each other (subsequently makes it obvious how the board's five cards opened). | This enhances a player's understanding of the cards he is playing and whether the flop supports any made hands or likely draw hands. |
| 8. Runner Runner Location: On turn card and river cards | Italics "Runner, Runner" go across the turn card and the river card if the best-hand possibility is the result of the turn and river cards (e.g., one diamond on the flop, another diamond as the turn and a final diamond as the river make a diamond flush possible). The only possibilities taken into account are straights, flushes and straight-flushes. | This enhances a player's understanding of the lack of likelihood that another player just made a hand that was unlikely at the time of the flop. |
| 9. Sheriff Location: On a board card | This icon represents that the card that opened creates a possibility of a new high hand (e.g., after a flop of 2d, 6d, 7d, a flush possibility, a new Sheriff card on a turn of 7h signals opening of the possibility of quad 7s and full houses). | Lets a player know that straights and better hands are possible. An opponent may have been waiting for the card that opened, and now that he has made his hand he will bet/raise. |
| 10. Sheriff Deputy Location: On a board card | This icon represent that the card that opened creates a new possibility for another hand that is lower than an already possible hand (e.g., after a flop of Jc, 4c, 7c (a flush possibility), a new Sheriff Deputy card on a turn of 8d signals opening of the possibility of a straight if an opponent has a 5, 6 hand). | Lets a player know that straights and better hands are possible. If there are many players still in the hand, one of them may have been waiting for the card that just opened, in which case he has made his inferior hand. |
| 11. Hand Strength Board likelihood Location: In the board area | The probability that each of the possible board-made best-hands will be achieved. (The probabilities are not necessarily the same for hands of the same kind even at the same stage of play. With 2d, 6d, 7c, Qs, 5c, only a 3, 4 hand makes a straight, but with 4d, 6d, Kc, Qs, 5c, three hands - 2-3, 3-7 and 7-8 - make straights). | Lets a player know not only the best hands that are possible and that the opponents may have, but also the probabilities that these hands will be achieved. Related to feature 5, supra. |

| Information Relating To An Opponent | | |
|---|---|---|
| 12. Average Hand Strength of Opponent Location: On placard | For each opponent, the average strength of hands he played (e.g., 45 for a player whose average Texas Hold'Em hand strength for hands played is 45 out of the 169 possible starting hands) when he voluntarily added chips to the pot. | Assists a player in understanding the quality of hands an opponent plays. |
| 13. Bet/Call Notes for Opponent Location: On his cards | Shows the action at each hand stage for players still in the hand, and for players who folded but who put chips into the pot. | By seeing when a player was betting (with the board cards supporting him) and when he was only calling, it is possible to intuit his hand. |
| 14. Bet Folds Location: On placard | For a player who has shown that he often bluffs by betting and then folds to a re-raise. | Suggests that the player may fold if the bet is raised. |
| 15. Big Blind Location: On placard | If the board is a particularly weak or unusual board (e.g., 338 flop), and there was no pre-flop raise, this warning icon applies to the player in the big blind position. For this icon to apply, every card must be a 10 or less, and the cards cannot be 3 of a kind, cannot be 3 of a suit, and cannot be in sequence. | The weak board probably did not help players with strong hands. But an opponent in a big blind position (who bet because he had to) may have had a weak hand and now may have fallen into a good hand with the weak flop. Thus a warning is given. |
| 16. Small Blind Location: On placard | If the board is a particularly weak or unusual board (e.g., 338 flop), and there was no pre-flop raise, this warning icon applies to the player in the small blind position. For this icon to apply, every card must be a 10 or less, and the cards cannot be 3 of a kind, cannot be 3 of a suit, and cannot be in sequence. This warning icon is slightly different than the Big Blind warning in that it denotes less of a threat since this player had to voluntarily commit more chips pre-flop to play the hand. | The weak board probably did not help players with most strong starting hands. But an opponent in a small blind position (who bet because he had to) may have had a weak hand and now may have fallen into a good hand with the weak flop. Thus a warning is given. |
| 17. Bluffer Steals Pot Location: On placard | Player has shown that he often bluffs on the river card. The icon appears by an opponent who often bet the river card after which it was seen that he had no quality hand. | Suggests that this opponent's betting on the river may be a bluff, and not a demonstration of strength. A call should be considered, even if a player has only a high card hand. |
| 18. Calling Station Location: On placard | Player has shown that he calls often. Strong hands should be bet against him, but bluffs may be ineffective. | This opponent will routinely not fold. Trying to bluff him may be inadvisable |
| 19. Check Fold Location: On placard | At the flop, turn and river, this icon appears by an opponent who has checked before the selected player, if the checker has shown that he either bets his hand on strength or often folds to bettors in instances where he has checked. | Suggests that trying to bluff this opponent may be advisable. He may fold, since he signaled weakness by not betting. |
| 20. Check Raise Location: On placard | At the flop, turn and river, this warning icon appears by an opponent who has checked before the selected player, if the checker has shown that he often calls/checks and then raises. | Suggests that checking may be advisable, and trying to bluff this opponent by betting into him may be inadvisable. He may be looking for the opportunity to raise. |
| 21. Collusion Alert Location: On placard | This icon is applied to players at the same table who often play together and their play has certain indicia of collusion. | The selected player may choose to find another table. |
| 22. No Continuation Bet Location: On placard | At the flop, turn and river, this icon identifies a player who has bet following an earlier round bet, if that player often does not follow up his bet unless he still has a good hand. | Unless the selected player has a very strong hand, folding, or not raising, after a bet by this opponent may be best. His bet likely indicates strength. |

-continued

| Information Relating To An Opponent | | |
|---|---|---|
| 23. Continuation Bet<br>Location: On placard | At the flop, turn and river, this icon identifies a player who has bet following an earlier round bet, if that player often follows up a bet he made at an earlier hand stage, regardless of whether he connected. | Calling or raising after this opponent's bet may be advisable. His bet may be a bluff. |
| 24. Defends Blinds<br>Location: On placard | This icon is applied to a player in a small or large blind position who often defends his blind. | Suggests that this opponent will likely call a raise pre-flop. With a strong hand that a selected player wants to play, a raise will get action. If he only has a draw hand that he wants to play (e.g., suited connector 8h, 9h), he should not raise. |
| 25. Folds Blinds<br>Location: On placard | This icon is applied to a player in a small or large blind position who often folds to a raise. | Suggests that this opponent will likely fold to a raise pre-flop, unless he has a good hand (which is statistically unlikely). If a selected player has anything but a very strong hand, a raise will likely win the blinds, if no one else is in. If he has a very strong hand that he wants to play (e.g., Ah, As), he should not raise as he may win more from the opponent on later bets, if the opponent catches a lower pair on the flop. |
| 26. Disconnect Protect Alert<br>Location: On placard | This warning icon is applied to a player with a higher than average use of disconnect protects. A disconnect protect allows a player to avoid being folded from an on-line game if the game server perceives that he has been disconnected. | A selected player should consider whether he wants to play against such an opponent, or simply find another table. |
| 27. Mucked Cards<br>Location: Where an opponent's cards are shown | Shows the cards of an opponent who played through the river, but whose cards lost. The mucked cards will stay revealed at the player who played them, until the flop opens on the next hand. | Allows for a general understanding of the opponent's play style. |
| 28. Mucked Cards Hand Strength<br>Location: Where an opponent's cards are shown | Reveals the strength of a mucked hand, after factoring in the board cards. | Allows for a general understanding of the opponent's play style. |
| 29. New Player<br>Location:- Above placard | Identifies a player who has joined the table. The icon goes away after several minutes. | Decreases the chance of confusing an opponent with someone else. |
| 30. Out of Element, Down<br>Location: On placard | Identifies an opponent playing a table with lower values than 80% of the tables at which he usually plays (e.g., a $50/100 limit-table player, playing a $3/6 limit-table). | With lower stakes, the opponent may play loosely at this table. |
| 31. Out of Element, Up<br>Location: On placard | Identifies an opponent playing a table with higher values than 80% of the tables at which he usually plays (e.g., a $2/4 limit-table player, playing a $15/30 limit table). | With higher stakes, the opponent may play tightly at this table. |
| 32. Poster Identified<br>Location: Above placard | The word 'poster' is placed near the hand of an opponent who posted a blind out of order (e.g., joined a table's play from the 9-seat). | Decreases the chance of misunderstanding an opponent's likely card quality. The particular opponent may be treated as a big blind. |
| 33. Pot Committed, Likely Caller<br>Location: On placard | This icon identifies a player who is pot committed (e.g., someone who bet 80% of his table chips is highly unlikely to fold to a raiser who forces him to bet his remaining chips). | Suggests that the opponent will likely call a bet at this stage. Bluffing is not advised and a bet should be made only on a likely winning hand. |

-continued

| Information Relating To An Opponent | | |
|---|---|---|
| 34. Pot Committed, But May Fold Location: On placard | This icon identifies a player who seems pot committed, but who has shown a tendency to ignore pot odds and may fold. | Suggests that the opponent may not call a bet at this stage, even though he should, and a bluff should be considered. |
| 35. Raise/Folds Location: On placard | This icon identifies a player who has shown that he often bluffs by raising, but then folds to a re-raise. | Suggests that an opponent may fold to a re-raise. |
| 36. Recent 5 Hands Location: Adjacent to opponent's placard | A display of the last five hands played past the flop by an opponent (with 'b' and 'B' notations where appropriate to indicate small blind and big blind, respectively). | Allows for a general understanding of the opponent's play style. |
| 37. Re-raises Often Pre-flop Location: On placard | This icon identifies a player who acts after the selected player and who often raises. By 'often' is meant that the player re-raises 30% above the historic average of all players at a table of the same type and value. | Suggests that any betting by a selected player may involve a re-raise, and an early position call is inadvisable with a marginal/speculative hand. |
| 38. Short Stack Alert Location: On placard | This icon identifies a player with a short stack relative to the table's stakes (75% below the recommended buy-in amount for commencing play at the table). Such a player often bets heavily on one hand by either going 'all in' pre-flop or by maximally raising pre-flop and post-flop. | Decreases the chance of misunderstanding an opponent's likelihood of calling on a draw hand - it can cost him only the limited amount he has left. |
| 39. Three Bet Pre-flop Location: Adjacent to opponent's placard, opposite side to Recent 5 Hands | If an opponent three bets (raises after a first raise and the blind bets), the display will show what he held, or what the flop was when he folded if that is what he did, the last several times when he three bet (e.g., "88, TT, Fold (AJQ flop), KK, Fold (KQT flop)"). | Allows for a general understanding of the opponent's card type in instances where he three bet. |
| 40. Tilt Alert, Opponent Location: On placard | This icon identifies an opponent who has changed his play style prior to the hand in play by playing more hands than usual. Any hand played which is among the top 25 hands in strength, or that he won, do not count toward calculating tilt. | Suggests that it will be difficult to bluff this opponent, but a quality hand should be played aggressively. Conversely, with a bad hand, folding should be considered. |
| 41. Time Show Strength Location: On placard | Shows if an opponent's length of time to act (e.g., 5 seconds to raise after the flop) suggests he may have a strong hand. | The opponent's delay may indicate great strength, suggesting that a fold may be advisable without a good hand or draw chance. |
| 42. Time Show Weakness Location: On placard | Shows if an opponent's length of time to act (e.g., 5 seconds to raise after the flop) suggests he may be bluffing on a weak hand. | This person's delay may indicate great weakness, suggesting that without a good hand or draw chance a bet/bluff may be advisable if there is no one else in, in the hope that the opponent will fold. |
| 43. Unknown Location: On placard | Identifies an opponent who is new to the game site, and for whom there is inadequate data. | There is no knowledge of this opponent's tendencies. |
| 44. Untilt/Cowed | This icon identifies an opponent who has changed his play style prior to the hand in play by playing fewer hands than usual. | Suggests that the player may fold his blind if it is raised, and that his playing may indicate great strength so a fold may be advisable without a good hand or draw chance. |
| 45. X-plosive Alert | This icon is applied to players at the same table who often play very aggressively against each other, creating large pots but high exposure for those in with them. | Suggests that fewer speculative hands should be played, but quality hands should be played aggressively. |

| Information Relating To A Selected Player | | |
|---|---|---|
| 46. Bet/Call Notes Location: On selected player's cards | If he is still in the hand, the selected player's action at each hand stage. | Show how the other players may understand the play of the selected player. |
| 47. Draw % Board Possibilities Location: On table box | Gives the overall post-flop percentages for the selected player's most likely final hands (e.g., chances of hitting flushes and straights are higher with suited connectors; with a pocket pair, the chance of making two pairs is different than it is with two distinct cards). The overall percentages are updated as the hand develops. (Like feature 4, but for the selected player, not the other players.) | Without a good draw percentage, it may be advisable to fold a hand early. |
| 48. Ghost Cards Location: Above the selected player's placard (where his cards would be) | Even if the selected players folds, his hand is shown, as well as its strength (in the table box) based on the board, with updating as the hand plays out. This will also include draw percentages. (Like feature 47, but only for stages post his folding.) | Assists the selected player in understanding what his final hand would have been had he played his cards. |
| 49. Average Hand Strength Location: On selected player's placard | The strength of the average hand played by the selected player when he voluntarily added chips to the pot. | Assists the selected player in understanding the quality of hands he plays, and how others may be perceiving his play. |
| 50. Actual Hand Strength Location: On selected player's placard | The strength of the selected player's hand in play (e.g., 32 out of 169). In addition, the actual hand strength in narrative form (e.g., flush) is shown in the table box and continuously updated. | Assists the selected player in understanding his present hand. |
| 51. Hand Termination Location: On selected player's info box | An analysis of where the selected player's hands typically end - pre-flop %, flop %, turn % and river %. | Assists the selected player in understanding his game. |
| 52. Nut Hand Location: On selected player's cards | Shows if pre-river the selected player's hand is the nut (best) hand. Does not show at the river. | Assists the selected player in understanding the strength of his present hand. With the best hand, he may want to act differently than with an inferior hand. |
| 53. 'Pure' Nut Hand Location: On selected player's cards | The gold 'pure' nuts icon shows that the selected player's hand can in no way be beaten. This happens at the river and rarely earlier (e.g., a flop of 2h, 3h, 5h, and the selected player holds 4h, 6h). | Assists the selected player in understanding the strength of his present hand. With the best hand, he may want to act differently than with an inferior hard. |
| 54. Pot Committed Location: On selected player's placard | At the pre-river stages, this icon shows at the selected player advising him that mathematically it is advisable for him to call any bet requiring him to commit his remaining chips if he has any draw and his choice is to call or fold. | Helps the selected player to understand his position and the advisability of calling any bet. |
| 55. Hand Count Location: On selected player's info box | Number of hands the selected player has played at the table. | After the selected player has played a certain number of hands, he may wish to move on to another table since the opponents at the table may by now know his game. |
| 56. Time Location: On selected player's info box | The time the selected players has been at the table. | After the selected player has played for a certain length of time, he may wish to move on to another table since the opponents at the table may by now know his game. |

-continued

| Information Relating To A Selected Player | | |
|---|---|---|
| 57. Tilt Alert, Self Location: On selected player's placard | Tells the selected player if he has changed his play style prior to the hand in play by playing more hands than usual. Any hand played which is among the top 25 hands in strength, or that he won, do not count toward calculating tilt. | Alerts the selected player that he may be playing with too much risk and that he may wish to temper his game. |
| 58. Untilt/Cowed, Self | Tells the selected player if he has changed his play style prior to the hand in play by playing fewer hands than usual. | Alerts the selected player that he may be playing with too much caution and that he may wish to open-up his game. Excessive caution can be a game weakness. |

| Information Relating To The Table | | |
|---|---|---|
| 59. Average No. of Hands per Hour Location: On table box | A continually updated display of the number of hands played per hour. | Advises the selected player about the table at which he is playing. |
| 60. Average Table Hand Strength Location: On table box | The average strength of hands played by all other players at the table (e.g., 18 for a table whose average Texas Hold'Em hand strength is 18 out of the 169 possible starting hands). Only includes hands played by players who voluntarily added chips to the pot (excludes big blind hands). | Advises the selected player about the table at which he is playing. |
| 61. Average Pot$ Location: On table box | A continually updated display of the average amount of chips in each pot. | Advises the selected player about the table at which he is playing. |
| 62. Chip Intelligence Location: Where bets are shown in the table area, near player who put the chips in | Chips indicate players actions:<br>A. ½ square blue chip = small blind<br>B. square blue chip = big blind<br>C. hexagonal purple chips in the middle - one per round of betting<br>D. round green chip = call<br>E. triangular yellow chip = bet<br>F. triangular red chip = raise | Assists the selected player in understanding the actions at the table at which he is playing. |
| 63. Disappearing Opponent Info. Location: On faded out placard of folded player | Information about an opponent disappears when the opponent folds from a hand (the opponent's area is changed so it blends into the background, to indicate that he is no longer in). The only hand information shown in the folded opponent's area is information pertaining to his betting. | Assists the selected player in focusing on things that matter by removing distractions at the table at which he is playing. |
| 64. Pre-Flop Analysis Location: On table box | An analysis of the table's pre-flops, showing: (1) the percentage of hands in which there were no callers; (2) the percentage of hands in which there were callers but no raisers; (3) the percentage of hands in which there was one raise; (4) the percentage of hands in which there were two raises; and (5) the percentage of hands in which there were three raises. Also, the average number of players who stayed in the hand in each case is displayed. | Assists the selected player in understanding the actions at the table at which he is playing. |
| 65. Hand Termination Location: On table box | Percentages of different table hand end points (pre-flop, turn, etc.) and comparisons with percentages of the selected player. | Assists the selected player in understanding whether the table at which he is playing is best for him (e.g., a player who bluffs might do better at a table where the percentage of hands ending early is higher). |

-continued

| Information Relating To The Table | | |
|---|---|---|
| 66. Money Won/lost per Hour Feature also works using chips Location: On table box | The historic average amount that has been made or lost in an hour by all of the selected player's opponents at the table, with appropriate chip information if it is not a money game. (The selected player's historic average winnings or losses are not included in the displayed amount.) | Assists the selected player in understanding how he might fare at the table at which he is playing. |

Certain of the features in the above list depend on the extent to which a player deviates from a norm value. For example, the icon associated with feature 14 (Bet Folds) identifies a player who often bluffs by betting and then folds to a re-raise. Obviously, before a player can be characterized this way, there must be a statistically significant number of hands that were examined, for example, 100 instances where a Bet Fold tendency could be observed or not observed. Although not shown in the flow charts to be described below, it is to be understood that characteristics of behavior are determined only after a sufficient number of hands have been analyzed. Also, it is to be understood that what constitutes a significant deviation from a norm (30% is a typical significant deviation as will be seen below) will vary depending on the particular characteristic under consideration. Because there can be different opinions about how far from the norm a value must be before it is considered to represent significantly different behavior, it is possible (although not in the illustrative embodiment of the invention) to allow a selected player to specify the threshold value to be used in each case that triggers an iconic display.

Prioritization of Iconic Displays

It is possible that for some players represented at the table so many icons may be suitable for display (as so much information is available) that there is no room for all of them in the placard space allotted to each player for iconic displays. Also, even if there is sufficient space, there may be inadequate time to consider all pertinent information, regardless of its relative importance, so as to avoid confusing the selected player not all of the icons should be shown. Therefore, in the invention a novel technique is employed for deciding which icons are displayed—the technique takes into account the primacy of space and the value of the information, specific to the moment.

In the poker context of the illustrative embodiment of the invention, at most three icons can be displayed in the placard for each player. It is not possible to simply rank each icon and to display the three with the highest ranks because the rankings are not permanent. Depending on the current situation, the rankings can and do change. For example, the Defends Blinds icon (for a player who is in the small blind or large blind position and who often defends his blind) is obviously one of the most important icons on the pre-flop bet before board cards have opened, but the icon is not important at all post-flop when the icon's information is no longer applicable. So if a ranking technique is employed for deciding which icons should be displayed, there should be a way to change the rankings as a function of the current situation to which the icons are to be applied.

In the invention, each icon is given a ranking for each of different situations. For any given situation (pre-flop, flop, turn, etc.) the rankings for that situation are used to decide which icons should be displayed if there are more icons that should be displayed than there are positions for them. There is an additional aspect to the ranking (positive and negative numbers), but it will be explained after first considering the basic ranking methodology. In the following table, each row represents one of the possible icons that is applied to a player's placard area. In the list of features considered above, not all 63 had associated icons. The only features represented in the following priority code table are those which have associated icons that are placed in a player's placard area and for which there may be a potential conflict.

| Icon | Show When Folded | Reset w/New Hand | Ini | Rdy | PrF | Flp | Trn | Rvr | Cmplt |
|---|---|---|---|---|---|---|---|---|---|
| 12. Average Hand Strength of Opponent | F | F | 0, | 0, | −1, | −1, | −1, | −1, | −1 |
| 14. Bet Folds | F | T | 0, | 0, | 0, | 90, | 90, | 50, | 10 |
| 16. Small Blind | F | T | 0, | 0, | 0, | 80, | 80, | 40, | 10 |
| 17. Bluffer Steals Pot | F | F | 0, | 0, | 99, | 99, | 99, | 99, | 99 |
| 18. Calling Station | F | F | 0, | 60, | 60, | 60, | 60, | 60, | 60 |
| 19. Check Fold | F | F | 0, | 0, | 0, | 30, | 30, | 30, | 30 |
| 20. Check Raise | F | F | 0, | 0, | 0, | 30, | 30, | 30, | 30 |
| 21. Collusion Alert | F | F | 99, | 99, | 99, | 99, | 99, | 99, | 99 |
| 22. No Continuation Bet | F | F | 0, | 0, | 0, | 99, | 99, | 99, | 99 |
| 23. Continuation Bet | F | F | 0, | 0, | 0, | 99, | 99, | 99, | 99 |
| 24. Defends Blinds | F | F | 0, | 0, | 99, | 0, | 0, | 0, | 0 |
| 25. Folds Blinds | F | F | 0, | 0, | 99, | 0, | 0, | 0, | 0 |
| 26. Disconnect Protect Alert | F | F | 0, | 0, | 70, | 70, | 70, | 70, | 70 |
| 30. Out Of Element, Down | F | F | 90, | 90, | 60, | 60, | 60, | 60, | 60 |
| 31. Out of Element, Up | F | F | 90, | 90, | 50, | 50, | 50, | 50, | 50 |
| 33. Pot Committed, Likely Caller | F | T | 99, | 99, | 99, | 99, | 99, | 99, | 99 |
| 34. Pot Committed, But May Fold | F | T | 90, | 90, | 90, | 90, | 90, | 90, | 90 |
| 35. Raise Folds | F | F | 0, | 0, | 90, | 90, | 90, | 90, | 90 |
| 37. Re-raises Often Pre-flop | F | F | 0, | 40, | 99, | 00, | 00, | 0, | 0 |

-continued

| Icon | Show When Folded | Reset w/New Hand | Ini | Rdy | PrF | Flp | Trn | Rvr | Cmplt |
|---|---|---|---|---|---|---|---|---|---|
| 38. Short Stack Alert | F | F | 0, | 90, | 90, | 50, | 50, | 50, | 0 |
| 40. Tilt Alert, Opponent | F | F | 0, | 20, | 20, | 20, | 20, | 20, | 20 |
| 41. Time Show Strength | F | F | 99, | 99, | 99, | 99, | 99, | 99, | 99 |
| 42. Time Show Weakness | F | F | 90, | 90, | 90, | 90, | 90, | 90, | 90 |
| 43. Unknown | F | F | 99, | 99, | 99, | 99, | 99, | 99, | 99 |
| 44. Untilt/Cowed | F | F | 20, | 20, | 20, | 20, | 20, | 20, | 20 |
| 45. X-plosive Alert | F | F | 99, | 99, | 99, | 99, | 99, | 99, | 99 |
| 50. Actual Hand Strength | F | F | 0, | 0, | −2, | −2, | −2, | −2, | −2 |

Features 49, 54, 57 and 58 are applicable to a selected player, but are otherwise the same as respective features 12, 33, 40 and 44 for other players. The row rankings for the four features that are not shown are the same as the respective values for the four features that are shown.

The 'Show When Folded' column specifies whether an icon is displayed after a player has folded. In all cases shown, the entry is False, indicating that the icon is not displayed. The column is included only to show that it represents data that may be necessary in other poker situations or even completely different applications. The 'Reset with New Hand' column specifies whether the icon is automatically disabled when a new hand starts (in case it had been enabled in the prior hand). There are only a few True entries. For these, the icons are displayed only during the course of the hand as they become applicable.

It is the next six columns that determine the hierarchical nature of the icon selection process. For the moment the negative numbers can be ignored, except to state that with regard to features 12 and 50 the principles set forth below (concerning positive numbers) apply. If a choice has to be made among more than three icons, the three with the highest number rankings are selected. But the rankings that are used are those for the particular situation at hand. In the table there are seven such situations—Ini(Initialization—when the table first opens and before the first hand starts), Rdy (Ready—a new hand is about to begin but no cards have been dealt yet), PrF (Pre-flop—two cards dealt to each player but no community cards yet dealt), Flp (Flop—the three flop cards have been dealt, i.e., opened on the board), Trn (Turn—the turn card has been dealt, i.e., opened on the board), Rvr (River—the river card has been dealt, i.e., opened on the board) and Cmpit (Complete—the winner has been declared, but a new hand has not yet been dealt). For example, at the Flop stage, suppose that the applicable icons for a particular player are numbers 17, 18, 19 and 31. Their respective rankings at this stage of play are 99, 60, 30 and 50. Since only three icons can be displayed in the limited space allotted on a player placard, icon 19, with the lowest ranking, is not displayed. Alternatively, the icons can be cycled, e.g., at 2-second intervals, in alphabetical or some other order The hierarchical nature of the icon selection process also allows icon cycling with the more important icons being displayed more frequently.

Negative numbers are used for controlling the order in which the icons are placed. Icons with positive priority values are ordered from the left, with the highest values being given leftmost positions. Icons with negative priority values are ordered from the right, with the most negative values being given rightmost positions. Which icons are selected for display, however, depends on the absolute magnitudes of their priority values. Thus an icon whose priority value is −70 takes precedence over an icon whose priority value is 40. (The absolute magnitudes of the priority values should all be different so there are no precedence conflicts between any of the icons.)

Consider, for example, some arbitrary system in which there are at most five positions for icons to be placed and there are many negative priority values as well as positive priority values. Suppose that for a particular situation, icons with priority values of 20, 30, −40, 80, −60, 50, 70 and −10 are suitable for display. The five priority values with the highest absolute magnitudes are 40, 80, −60, 50 and 70 so their respective icons are the only ones displayed. They are displayed from left to right in an order associated with their respective priority values in accordance with the positive/negative placement rule given above: 80, 70, 50, −40, −60.

Strength of Texas Hold'Em Hands

Throughout this description reference is made to strengths of hands. There are 169 different starting hand strengths. The rankings below are based on one published methodology but alternative methodologies that give rise to other orderings are possible. The letters T,J,Q,K and A refer to a card of value ten, and to Jack, Queen, King and Ace cards. The notation 's' in the table after two cards means that the two cards are of the same suit. The notation 'o' (off-suit) means that the two cards are of different suits—pairs are understood to be off-suit with no notation required.

| Rank | Cards |
|---|---|
| 1 | AA |
| 2 | KK |
| 3 | QQ |
| 4 | AKs |
| 5 | JJ |
| 6 | AQs |
| 7 | KQs |
| 8 | AJs |
| 9 | KJs |
| 10 | TT |
| 11 | AKo |
| 12 | ATs |
| 13 | QJs |
| 14 | KTs |
| 15 | QTs |
| 16 | JTs |
| 17 | 99 |
| 18 | AQo |
| 19 | A9s |
| 20 | KQo |
| 21 | 88 |
| 22 | K9s |
| 23 | T9s |
| 24 | A8s |
| 25 | Q9s |
| 26 | J9s |
| 27 | AJo |
| 28 | A5s |

-continued

| Rank | Cards |
|---|---|
| 29 | 77 |
| 30 | A7s |
| 31 | KJo |
| 32 | A4s |
| 33 | A3s |
| 34 | A6s |
| 35 | QJo |
| 36 | 66 |
| 37 | K8s |
| 38 | T8s |
| 39 | A2s |
| 40 | 98s |
| 41 | J8s |
| 42 | ATo |
| 43 | Q8s |
| 44 | K7s |
| 45 | KTo |
| 46 | 55 |
| 47 | JTo |
| 48 | 87s |
| 49 | QTo |
| 50 | 44 |
| 51 | 22 |
| 52 | 33 |
| 53 | K6s |
| 54 | 97s |
| 55 | K5s |
| 56 | 76s |
| 57 | T7s |
| 58 | K4s |
| 59 | K2s |
| 60 | K3s |
| 61 | Q7s |
| 62 | 86s |
| 63 | 65s |
| 64 | J7s |
| 65 | 54s |
| 66 | Q6s |
| 67 | 75s |
| 68 | 96s |
| 69 | Q5s |
| 70 | 64s |
| 71 | Q4s |
| 72 | Q3s |
| 73 | T9o |
| 74 | T6s |
| 75 | Q2s |
| 76 | A9o |
| 77 | 53s |
| 78 | 85s |
| 79 | J6s |
| 80 | J9o |
| 81 | K9o |
| 82 | J5s |
| 83 | Q9o |
| 84 | 43s |
| 85 | 74s |
| 86 | J4s |
| 87 | J3s |
| 88 | 95s |
| 89 | J2s |
| 90 | 63s |
| 91 | A8o |
| 92 | 52s |
| 93 | T5s |
| 94 | 84s |
| 95 | T4s |
| 96 | T3s |
| 97 | 42s |
| 98 | T2s |
| 99 | 98o |
| 100 | T8o |
| 101 | A5o |
| 102 | A7o |
| 103 | 73s |
| 104 | A4o |
| 105 | 32s |
| 106 | 94s |

-continued

| Rank | Cards |
|---|---|
| 107 | 93s |
| 108 | J8o |
| 109 | A3o |
| 110 | 62s |
| 111 | 92s |
| 112 | K8o |
| 113 | A6o |
| 114 | 87o |
| 115 | Q8o |
| 116 | 83s |
| 117 | A2o |
| 118 | 82s |
| 119 | 97o |
| 120 | 72s |
| 121 | 76o |
| 122 | K7o |
| 123 | 65o |
| 124 | T7o |
| 125 | K6o |
| 126 | 86o |
| 127 | 54o |
| 128 | K5o |
| 129 | J7o |
| 130 | 75o |
| 131 | Q7o |
| 132 | K4o |
| 133 | K3o |
| 134 | 96o |
| 135 | K2o |
| 136 | 64o |
| 137 | Q6o |
| 138 | 53o |
| 139 | 85o |
| 140 | T6o |
| 141 | Q5o |
| 142 | 43o |
| 143 | Q4o |
| 144 | Q3o |
| 145 | 74o |
| 146 | Q2o |
| 147 | J6o |
| 148 | 63o |
| 149 | J5o |
| 150 | 95o |
| 151 | 52o |
| 152 | J4o |
| 153 | J3o |
| 154 | 42o |
| 155 | J2o |
| 156 | 84o |
| 157 | T5o |
| 158 | T4o |
| 159 | 32o |
| 160 | T3o |
| 161 | 73o |
| 162 | T2o |
| 163 | 62o |
| 164 | 94o |
| 165 | 93o |
| 166 | 92o |
| 167 | 83o |
| 168 | 82o |
| 169 | 72o |

Derivation of Individual Items of Information

The game server 100 of FIG. 1 includes software routines for executing all of the features discussed thus far, in addition to the usual on-line poker functions. FIGS. 12-38 are flow charts that depict the processing that provides the more complicated of the functions described above. (The steps required for performing the functions that are not described in this section will be apparent from the descriptions of the more complicated functions. For example, it is not believed necessary to show a flow chart for counting numbers of hands that ended a certain way, or the number of hands played at a table, or the average amount of chips bet per hand, etc. All that is involved in these functions is counting, averaging, etc., steps that hardly require detailed explanation).

Figure 12:
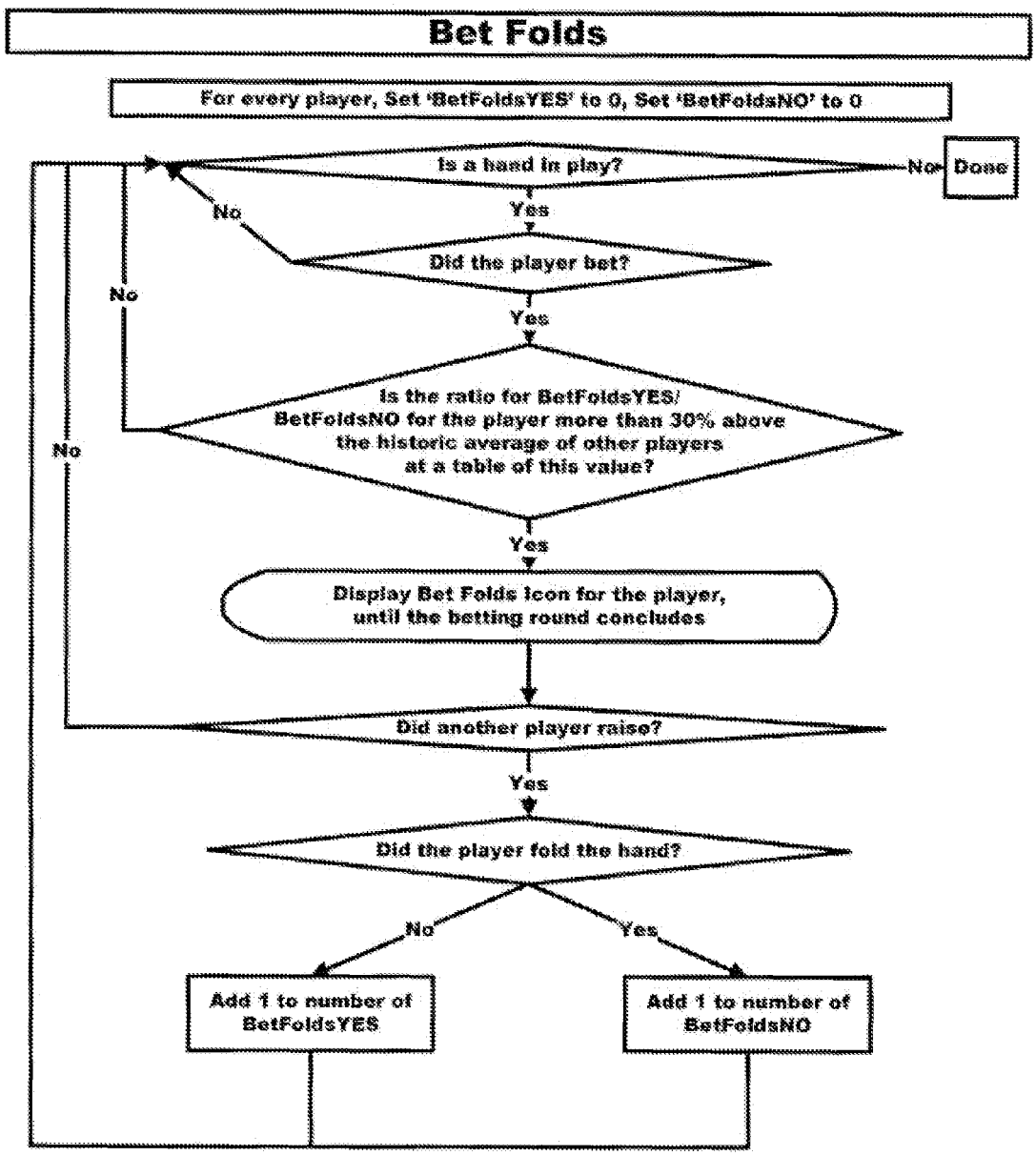

Feature 14 is 'Bet Folds'—an icon is displayed in the placard of a player who has shown that he often bluffs by betting but then folds to a re-raise. This is valuable information for a selected player to have because it suggests that a raiser may fold if his bet is re-raised. The flow chart showing how it is determined that the 'Bet Folds' characterization applies to a player is shown in FIG. 12.

At the top of the Figure it will be seen that two variables for each player—'BetFoldsYES' and 'BetFoldsNO'—are initially set to 0. This step is performed only once for each player as these variables are running totals. They are therefore not strictly part of the flow chart that applies to continuous game play. A similar initial setting of variables is to be found in many of the other flow charts that also involve maintaining running totals.

The processing begins with a determination that a hand is being played. The first step inquires into whether the player for whom it is being determined that he 'Bet Folds' made a bet. If he did not, a return is made to the initial question whether a hand is being played. If a hand is not being played, the processing is 'done.' If a hand is in progress, the loop is followed until the player eventually makes a bet.

The basic algorithm is to increment BetFoldsYES whenever the player bets and then folds to a re-raise, and to increment BetFoldsNO whenever the player bets and then does not fold to a re-raise. The ratio of the two is formed; the higher the value, the more likely it is that the player will fold to a re-raise following his bet. The main test is whether his ratio is 30% above the historic average of the same ratio for other players at tables of this value. If it is, as shown in the big decision box of the flow chart, the Bet Fold icon is shown for the player until the betting round concludes.

The ratio will eventually be updated depending on whether or not the bettor folds to a re-raise, but as soon as the player makes a bet the selected player should be told that the player may fold to a re-raise. So even before the other players have responded to the bet, the current value of the ratio is tested and the Bet Folds icon is displayed if it is appropriate (see third decision box in the flow chart).

After the decision is made whether to display the icon, as shown in the middle of the flow chart, the system determines whether another player raised. This is the prerequisite for incrementing one of the two counts. In the absence of a raise, the processing returns to the beginning—on this betting round there was no re-raise so neither count should be incremented. On the other hand, if the answer to whether another player raised is yes, then it has to be determined whether the player folded as a result. As shown at the bottom of the flow chart, one of the two counts is incremented. The processing then returns to the beginning—if the player makes another bet and there is a re-raise, one of the two counts will be incremented again.

There is a feature in the process of FIG. 12 that is not shown but is common to many of the processes. Referring to the top of the figure it will be seen that two variables are initially set to zero. The ratio of the continuously incremented variables BetFoldsYES and BetFoldsNO for each player determines not only whether a player of interest bets and fold to a re-raise, but it provides historic averages for all players so a departure from the norm can be determined. Many of the flow charts have a box at the top showing initialization of one or more variables in this manner. While initialization may occur only once, the counts are not incremented indefinitely. The reason for this is that player habits may change and what happened a year ago may not represent a player's current dispositions. For this reason counts such as those in FIG. 12 rely on a sliding window approach—counts or averages or any other metric depend on only the most recent measures. For example, if a player's propensity to bet and then fold to a re-raise is deemed to be reflected most accurately in the last 250 instances in which the situation arose, then only the last 250 'events' are taken into account. In the case of FIG. 12, for example, a record would be maintained of the last 250 events. When event 251 occurs, the oldest event is checked to see which of the two counts was incremented. That count is now decremented, in effect cancelling the effect of the 'ancient' event. One of the two counts is incremented depending on the action taken in the most recent situation. In this way the ratio is determined only by the 250 most recent applicable events. Preferably, the foregoing count levels are maintained for each type of table at which the player plays. Information concerning his conduct at a $1/$2 limit table, is preferably not amalgamated with information concerning his conduct at a $10/$20 table.

There is another point that should be understood about FIG. 12 as well as all the other flow charts, unless clearly inapplicable. Some processes require execution only once per hand, or even less frequently. Others, such as the process of FIG. 12, require continuous execution. A process that requires continuous execution does not occupy the processor full time or else nothing else could be accomplished. As is known in the art, the game server, in this case Analytics Processor 106 of FIG. 1, executes processes concurrently as needed. Thus while a process may be shown as being executed continuously, it is to be understood that each process gets only its fair share of processing time on an as-needed basis. Sufficient processors are provided to enable all processes to be executed as often as is necessary for them to accomplish their respective functions.

Figure 13:
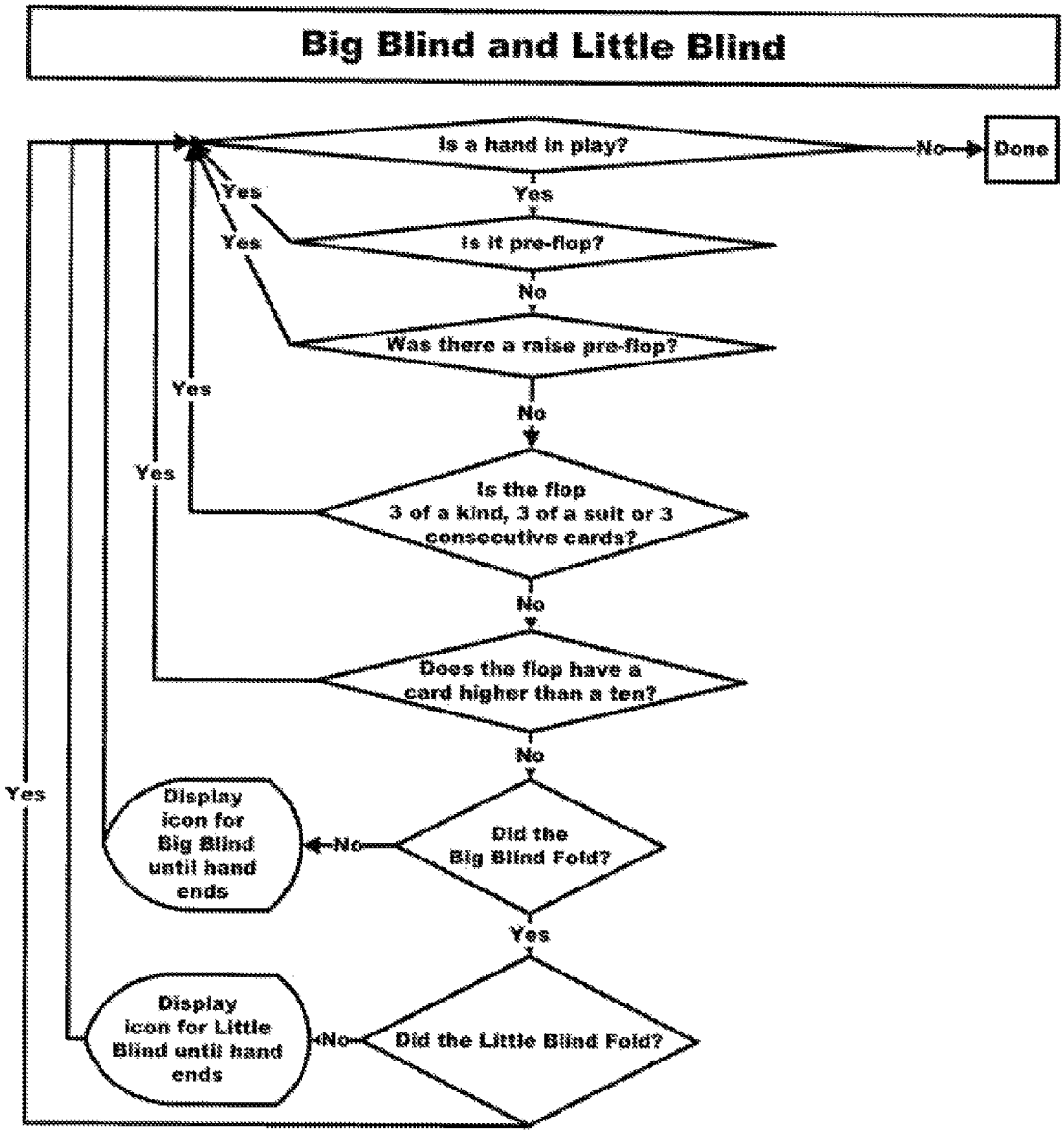

FIG. 13 is a flow chart that shows how it is determined to display the icons of both features 15 and 16. It will be recalled that the Big Blind icon is displayed for the player in the big blind position if the board is a particularly weak or unusual board (e.g., 338 flop), and there was no pre-flop raise. For this icon to apply, every card must be a 10 or less, and the cards cannot be 3 of a kind, cannot be 3 of a suit, and cannot be in sequence. The weak board probably did not help players with strong hands. But an opponent in a big blind position (who bet because he had to) may have had a weak hand and now may have fallen into a good hand with the weak flop. Thus a warning is given. The same remarks apply to a player in the small blind position.

The processing is straight-forward. The first few tests establish that a hand is in play, it is after the pre-flop stage, and there was no pre-flop raise. These are the criteria that must be established before two tests are performed to see if the board is particularly weak. If it is decided that the board is weak, the questions are whether either or both of the blinds stayed in. If they did, the respective warning icon is displayed as shown.

Figure 14:
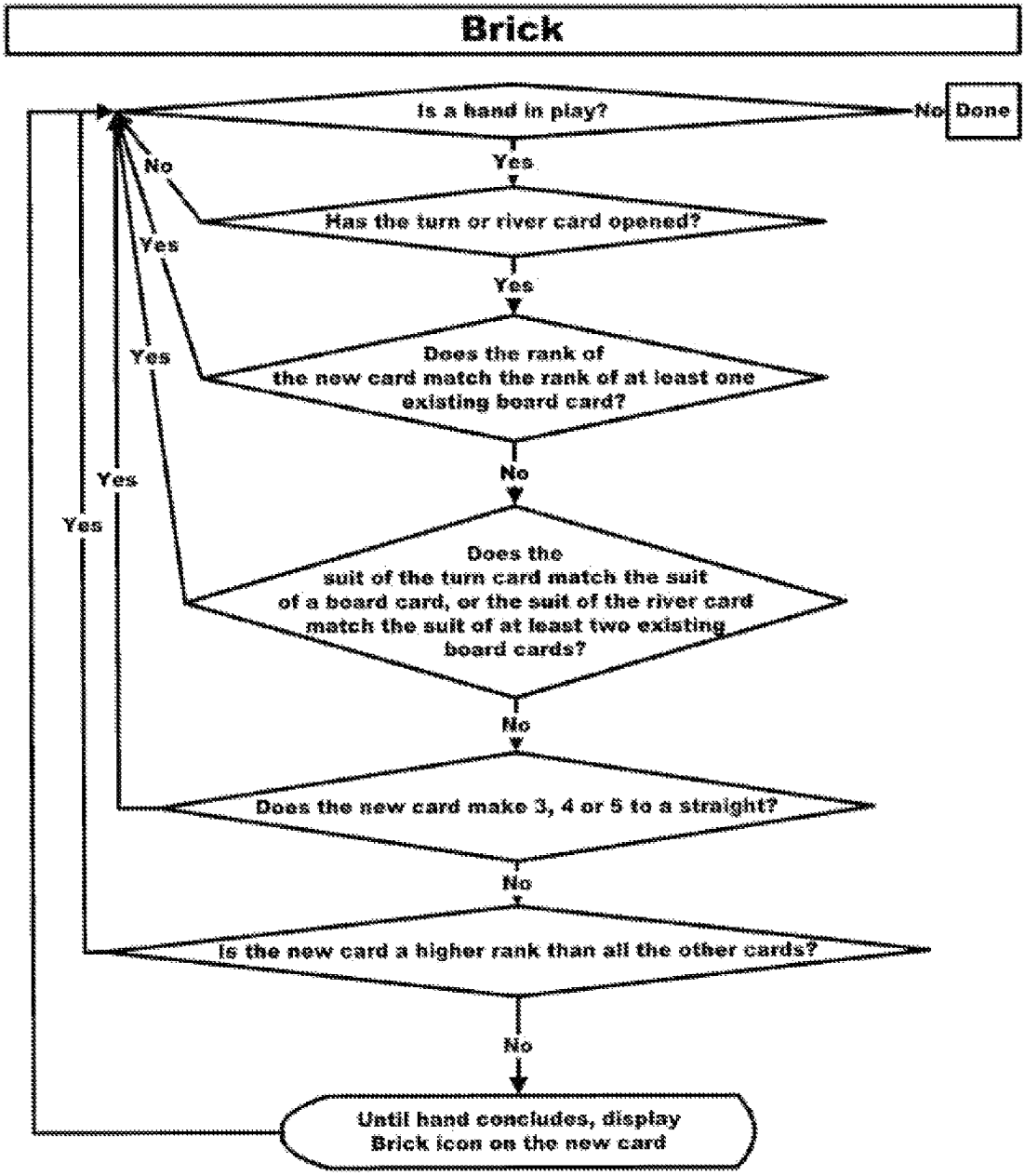

The 'Brick' (feature 2) flow chart is shown in FIG. 14. It will be recalled that an image of a brick appears on the turn or river card if either card is apparently useless in terms of creating likely new better hands. This lets a player know that there is likely nothing new. If he has a made hand or wants to bluff, he may bet somebody out who appears to be on a draw hand. In the process of FIG. 14, the first thing determined is whether the turn or the river card has opened. If not, the testing for the current hand stage is finished. If yes, it has to be determined whether the card has apparently contributed nothing to the creation of better hands.

The first substantive test is whether the new card matches the rank of an earlier community card. If it does, e.g., a King or a two was previously opened, and another King or two has now been dealt, a Brick should not be displayed because the potential for priority hands has improved. But if the rank of the new card is different from those of all open cards, then a test is performed to determine whether the new card can give rise to a flush? If it is the turn card that has just opened and if it matches the suit of at least one previously opened card, then a flush may become possible. If it is the river card that has just opened, and if it matches at least two of the earlier board cards, then a flush is possible and a Brick is not displayed on the card.

If flush possibilities have not improved, then the next step is to see if straight possibilities have improved. If the new card and two hole cards could constitute a straight, then a Brick is not displayed on the card since there has been an improvement.

Finally, if there has been no improvement from the point of view of pairing the board or flushes or straights, a test is performed to see if the new card is higher in rank than all of those previously opened. If it is not, the Brick is displayed on the new card to indicate that it could not have helped anyone insofar as board cards are concerned. (However, the card could have given a player a pair or even a set.)

Figure 15:
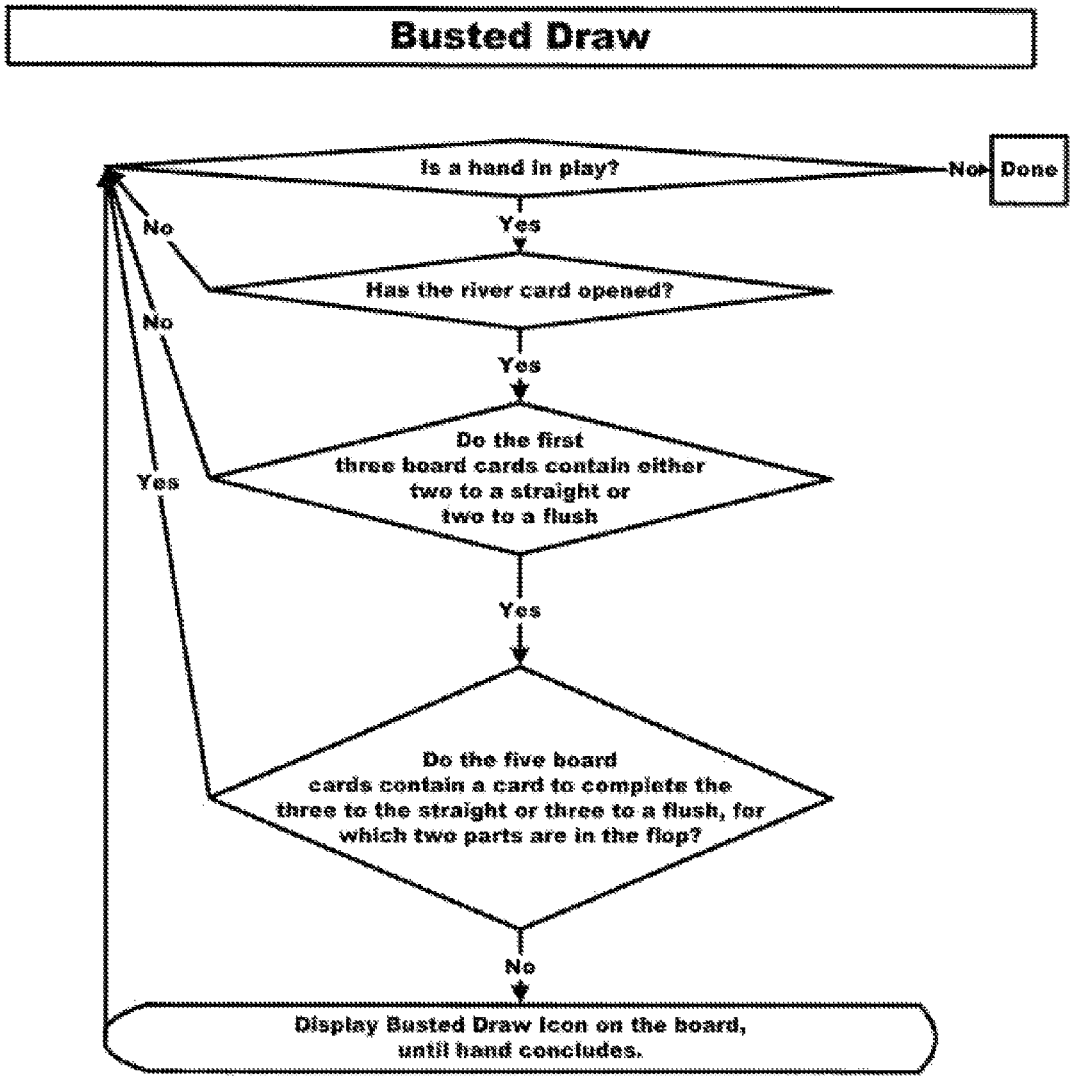

The flow chart for the Busted Draw icon of feature 3 is shown in FIG. 15. This icon appears on the board only after the river card opens, and shows that the likely draw hand from the flop, which an opponent may have been chasing, failed to happen (e.g., flop—2h, 7h, Js; turn—4d; river—Qs: no third Heart opened to permit a Heart flush). This lets a player know that there is likely nothing new. He should bet if he has a made hand or wants to bluff, as he may bet somebody out who appears to be on a draw hand.

As shown in the flow chart, if the river card has opened the first question to be answered is whether the flop included two cards to a straight or two cards to a flush. The Busted Draw icon is displayed if a player may have been looking for a flush or a straight from the flop on, with the flop including at least two cards to help make up the flush or the straight. Only if the flop could have aided a player this way, followed by a busted draw, is the icon displayed.

If the flop did include two cards to a straight or two cards to a flush, then the question is whether with the river card all five board cards now allow a player to have a flush or a straight. (The test shown excludes the possibility of only one card in the flop, and the turn and the river, together with a player's two cards, making up a flush or a straight. It is not assumed that a player was betting on a flush or straight possibility if with the flop he had only three cards to a flush or a straight.) If the answer is in the negative, the Busted Draw icon is displayed.

Figure 16:
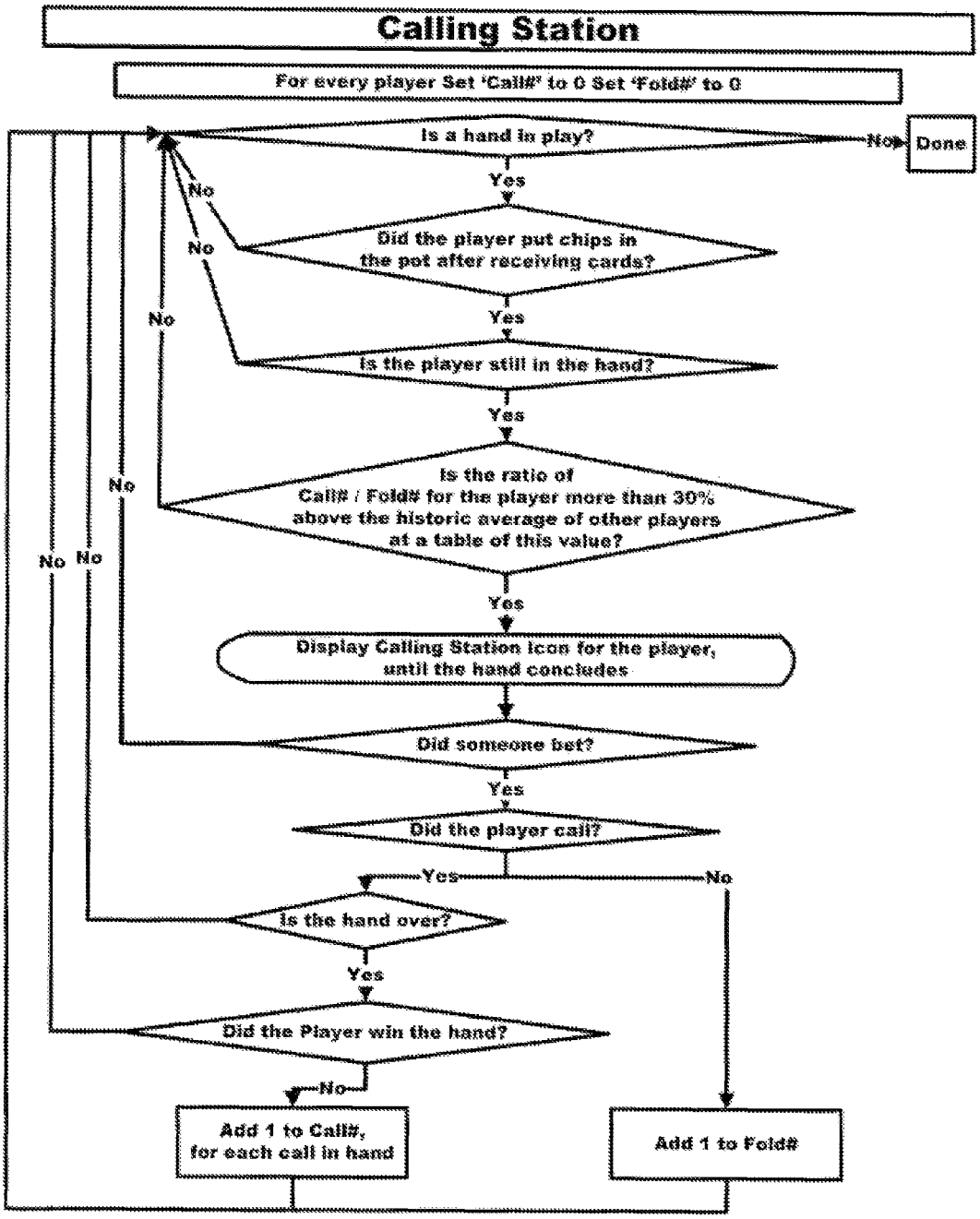

A 'Calling Station' is the name given to a player who has shown that he calls often. Strong hands should be bet against him, but bluffs may be ineffective. The flow chart for deriving the information applicable to this feature 18 is shown in FIG. 16. The variables that are initialized are Call# and Fold#, the ratio of which represents the frequency with which the player of interest calls other players' bets.

For a hand in play, the first question is whether the player of interest put chips in the pot after receiving cards. (The flow chart depicts the process applicable to every individual player who is at the table.) If he did not, there is no interest in whether he usually calls often. But if he did put chips into the pot, and he is still in the hand, then it will be helpful to a selected player to know if the particular player is a Calling Station.

After the ratio test is performed and the icon is displayed if appropriate, it is determined whether either of the two variables should be incremented. If someone bet, the question is whether the player of interest called the bet. If he did not, Fold# is incremented because we have an instance where the player did not call. On the other hand, if he did call, Call# is not necessarily incremented This count is incremented (once for each call he made in the hand) only if the player of interest lost the hand. If he won, his call was hardly foolhardy and there is no need to increment the count that represents his propensity for calling when it is not warranted.

The Check Fold icon of feature 19 applies at the flop, turn and river to a player who has checked before the selected player, if the checker has shown that he either bets his hand on strength or often folds to bettors in instances where he has checked. The reason for displaying the icon is that it suggests that trying to bluff this opponent may be advisable. He may fold, since he signaled weakness by not betting.

Figure 17:
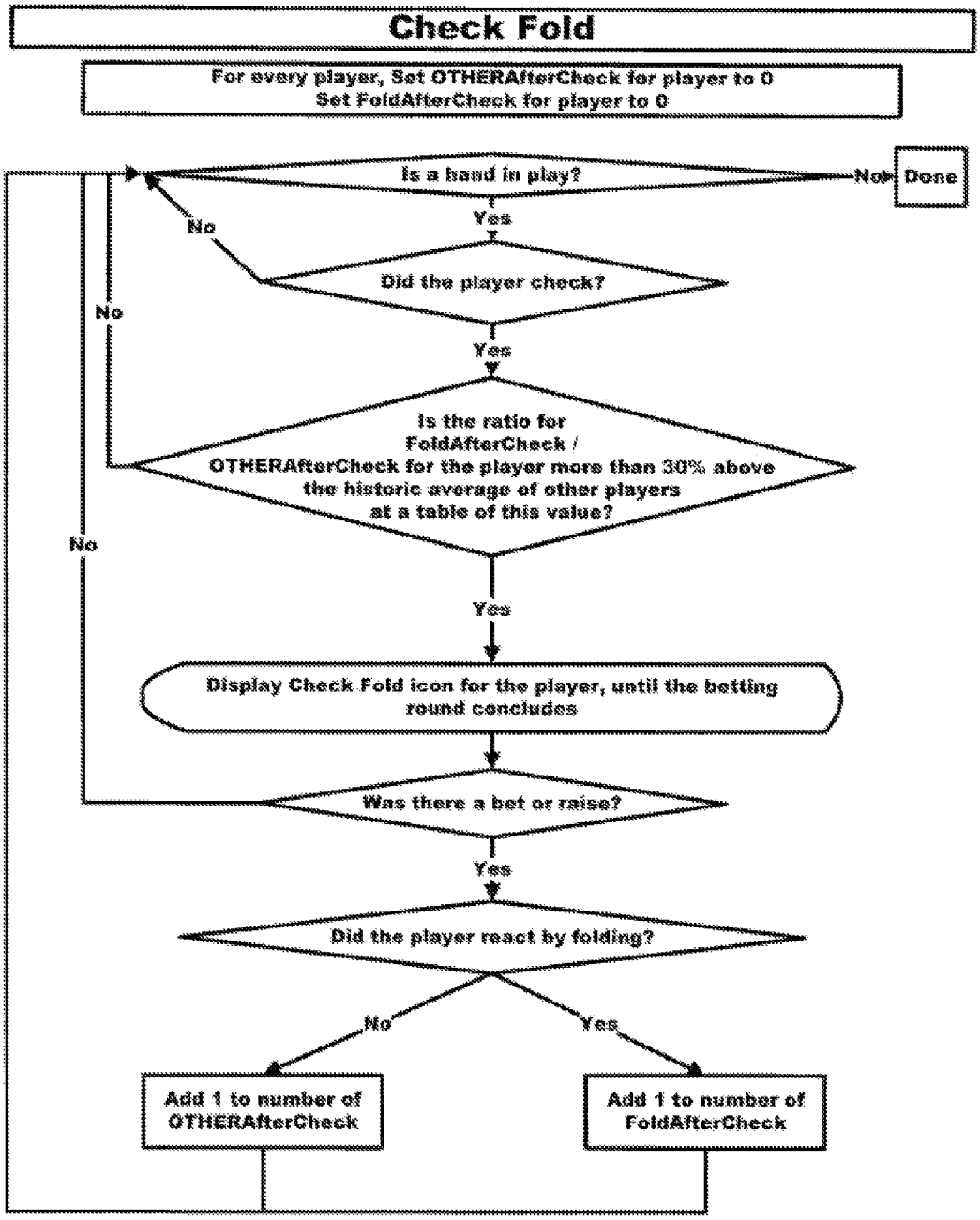

As shown on the flow chart of FIG. 17, two variables are initialized for each player at the poker site. What is important here are the number of folds after a check compared with the number of other actions (bets, raises or calls) after a check. The first variable is the number of other actions after a check by the player, OTHERAfterCheck. The other variable is the number of folds after a check, FoldAfterCheck, for the player.

For a hand that is in play the process first determines if the player of interest checked in the hand. If he did, the Check Fold icon may be appropriate for display. The usual ratio test is performed, this time on the two variables that are applicable to a fold following another's bet, and the icon is displayed if the player of interest folds often after checking. After the icon is displayed, it is decided whether one of the two variables should be incremented. It has already been determined that the player checked. Now it is determined whether there was a bet or raise and whether he reacted by folding. Depending on what he did, one of the two relevant variables is incremented. Notably, circumstances which arise during play may cause more than one count to be incremented (a circumstance which results in incrementing OTHERAfterCheck in the instance of a call here, may also result in incrementing Call# in connection with the previously described Calling Station).

Figure 18:
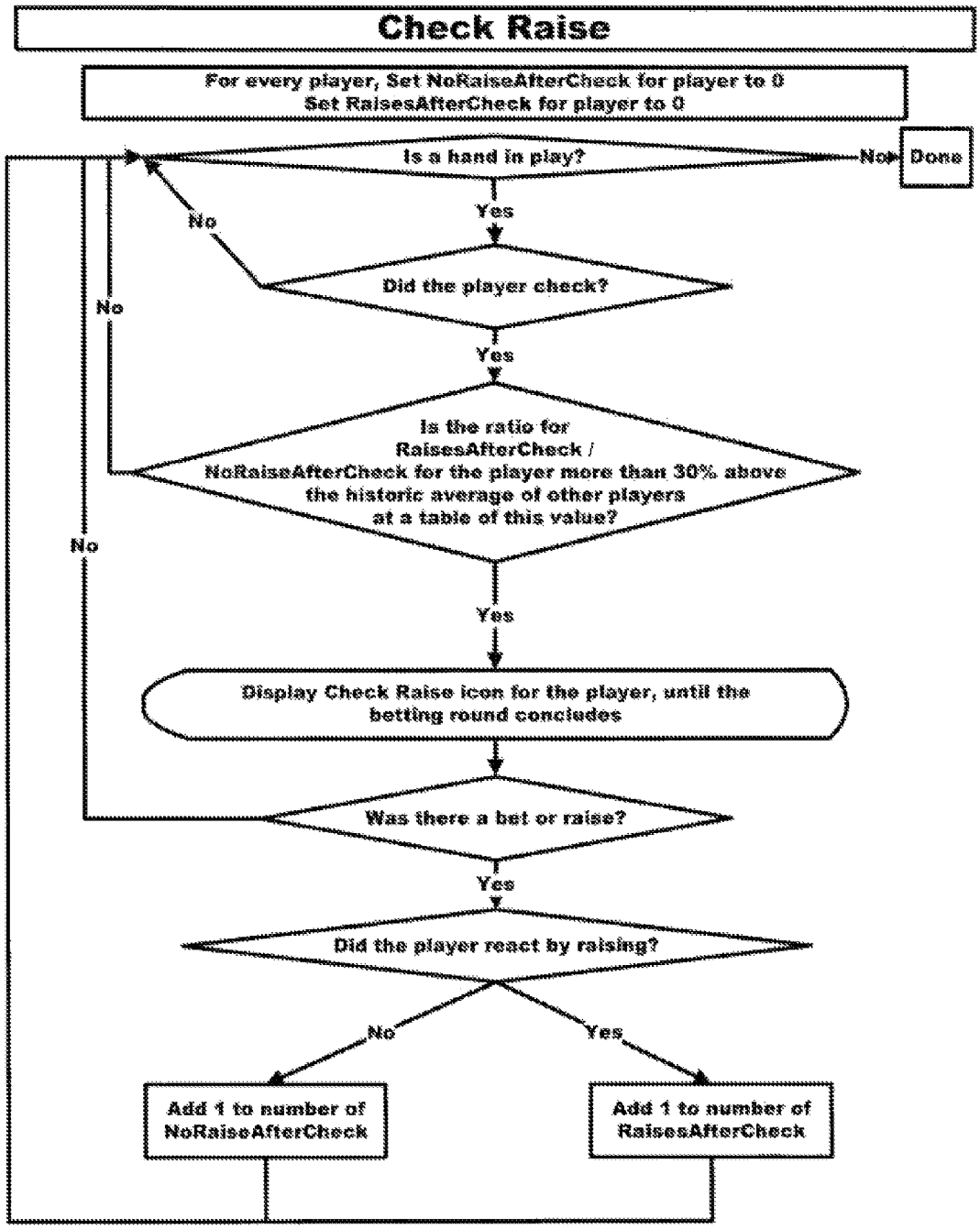

The Check Raise flow chart of FIG. 18, corresponding to feature 20, is basically the same as the flow chart of FIG. 17. The main difference is that while one flow chart applies to a fold after a check, the other applies to a raise after a check.

Figure 19:
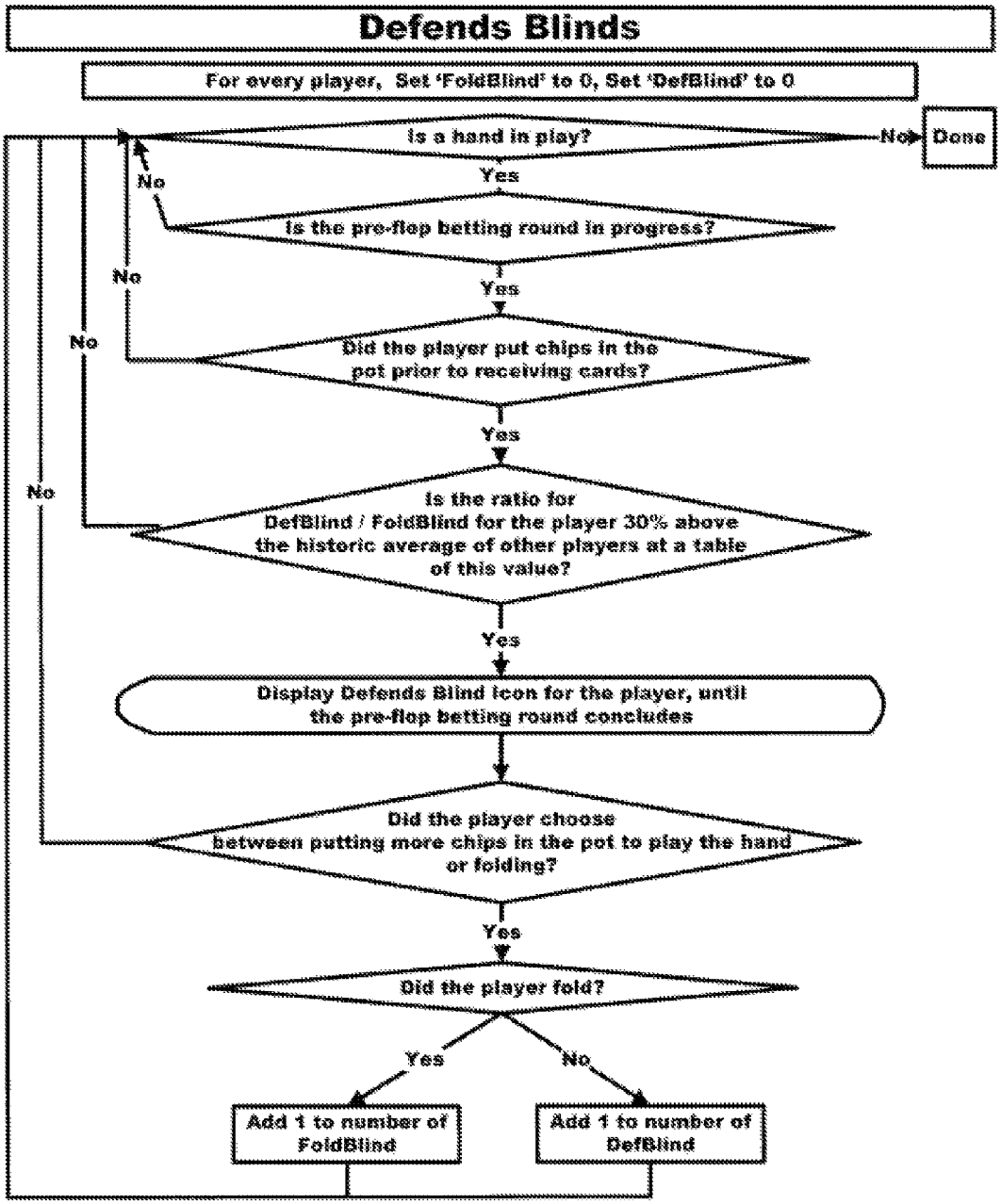

The flow chart of FIG. 19 applies to the Defends Blinds feature 24. The icon is applied to a player in a small or large blind position who often defends his blinds. The icon on a player's placard suggests to the selected player that this opponent will likely call a raise pre-flop. With a strong hand that a selected player wants to play, a raise will get action. If he only has a draw hand that he wants to play (e.g., suited connector 8h,9h), he should not raise.

As for many of the items of information, two variables for each player at the poker site are initialized just once, FoldBlind and DefBlind. The former is a count of the number of times that a player folded after betting (also known as "posting a blind"), when he was one of the two blinds, and the latter is a count of the number of times the player put more chips into the pot (when he called a raise) in the pre-flop round. The software first determines if a pre-flop betting round is in progress. If it is, the next question is whether the player is one of the blinds, i.e., did he put chips into the pot even before he received any cards. If he is, the round is one in which it may be appropriate to display the Defends Blinds icon. The usual ratio test is performed, this time using the two variables applicable to defending blinds.

As shown in the middle of the Figure, the icon is displayed if it is appropriate only during the pre-flop round because that is the only stage of play in which the information represented by the icon is useful.

At the end of the pre-flop betting round, one of the two variables is up-dated if appropriate. The question of up-dating does not arise unless the player had an occasion to defend his blind, i.e., another player bet and a decision had to be made whether to put more chips into the pot or to fold. If there was no need to make such a decision, neither variable is incremented. Otherwise, one of the two counts is increased, depending on whether the player folded or called.

The Folds Blinds feature 25 is the converse of the Defends Blinds feature just considered. The Folds Blinds icon is applied to a player in a small or large blind position who often folds to a raise. The icon suggests to a selected player that this opponent will likely fold to a raise pre-flop, unless he has a good hand (which is statistically unlikely). If a selected player has anything but a very strong hand, a raise will likely win the blinds, if no one else is in. If he has a very strong hand that he wants to play (e.g., Ah, As), he should not raise as he may win more from the opponent on later bets, if the opponent catches a lower pair on the flop.

Figure 20:
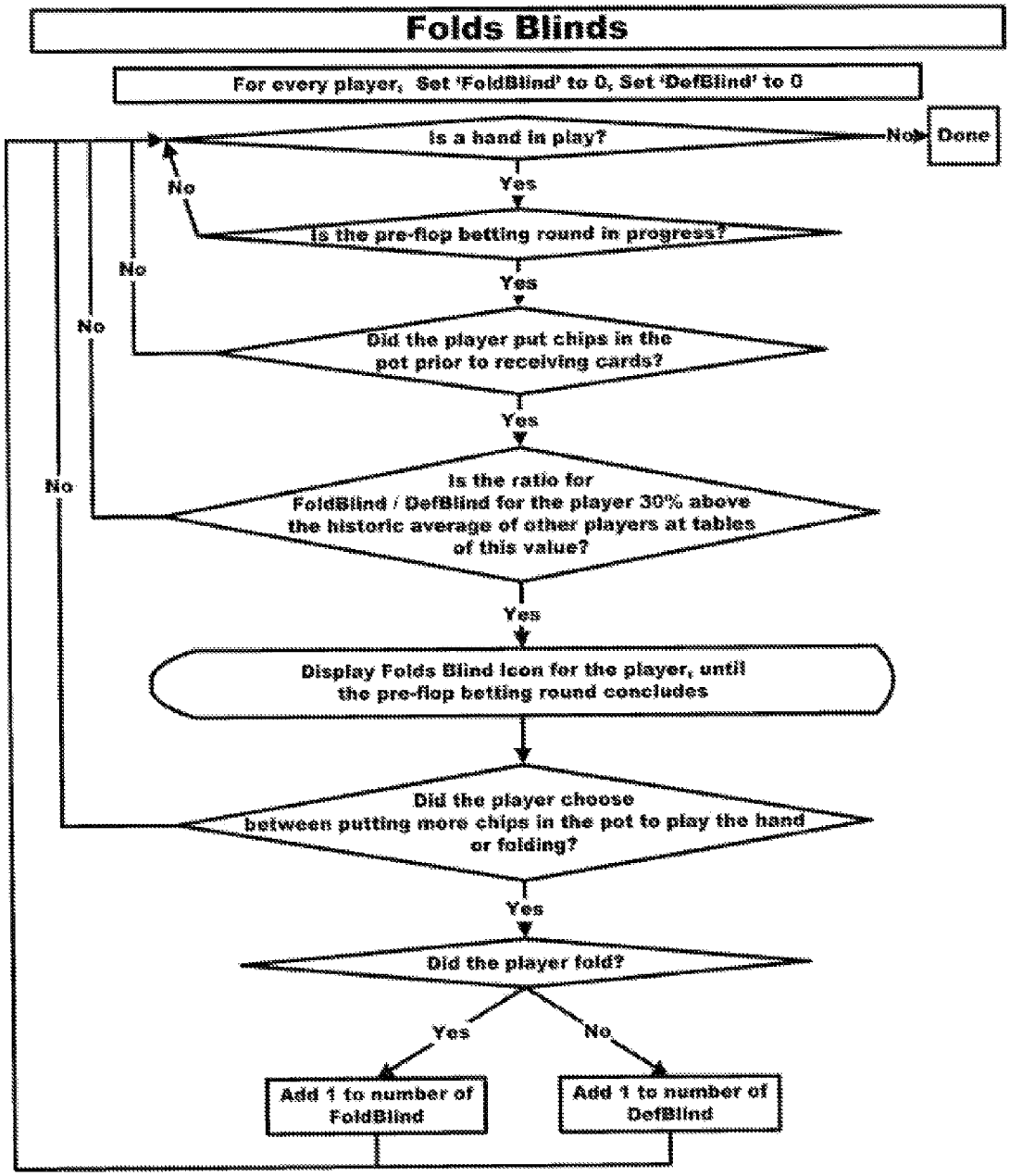

The Folds Blinds flow chart of FIG. 20 is the same as that of FIG. 19 except that the ratio is reversed in the main decision box, and the icon which is displayed is different. Otherwise, the logic is the same in the two cases.

Figure 21:
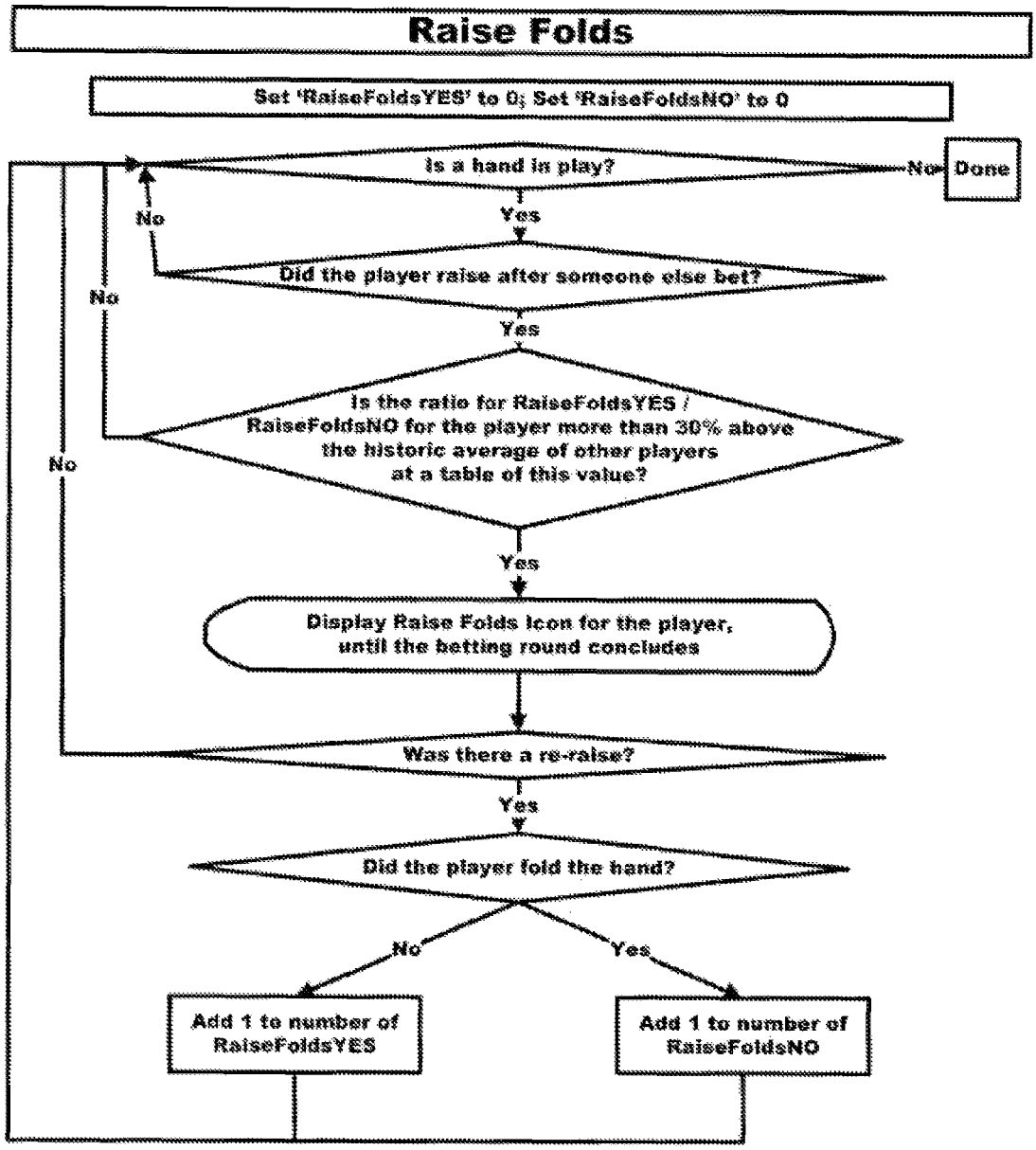

The Raise Folds icon of feature 35 identifies a player who has shown that he often bluffs by raising, but then folds to a re-raise. This suggests that an opponent may fold to a re-raise. The two applicable variables for each player at the poker site are RaiseFoldsYES and RaiseFoldsNO. As shown in FIG. 21, the basic question to be answered is whether the player of interest raised after another player first bet. If he did, then the applicable icon is displayed for him if his ratio of folds (after raises) to no-folds (after raises) is considerably higher than the ratios for other players at tables of the same value.

After the icon is displayed, the software checks whether there was a re-raise. If there was, then one of the two variables is incremented depending on whether the player of interest folded or not.

Figure 22:
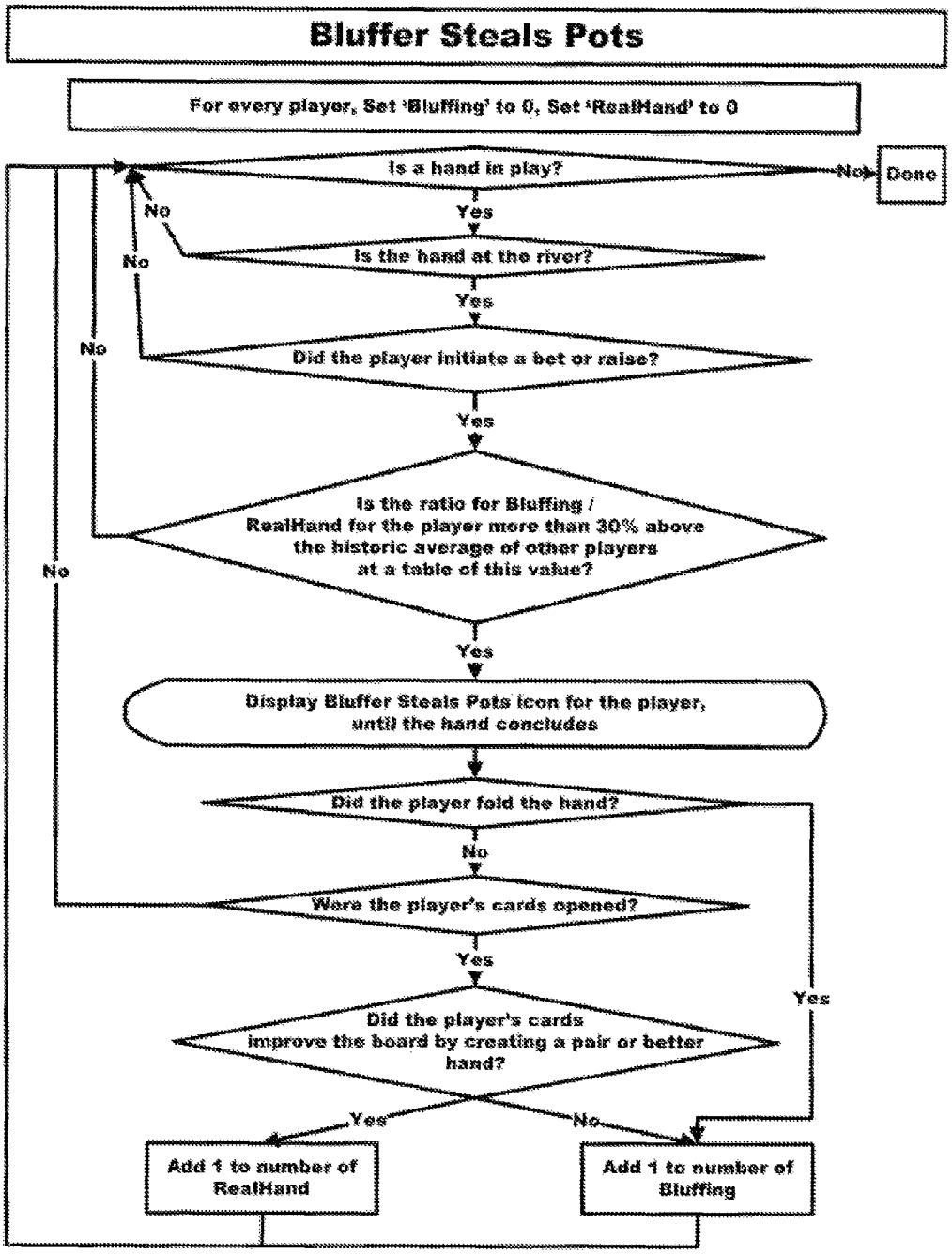

Whether the Bluffer Steals Pots icon of feature 17 is displayed or not is determined by the process of FIG. 22. There are players who often bluff on the river card. The icon appears by such a player who often bets the river card after which it was seen that he had no quality hand. The icon suggests that this opponent's betting on the river may be a bluff, and not a demonstration of strength. A call should be considered, even if a player has only a high card hand.

The two applicable variables for each player are Bluffing and RealHand, both of which are initially set to zero. (As discussed above, they—like most of the like variables used in the icon processing—are incremented based on events that occur in a sliding window, which is why a count is decremented when an 'old' event is no longer considered important due to its age.) It is not sufficient to determine that a player initiated a bet or raised. That does not signal a bluff because the player may have bet or raised because he had a good hand. The increment phase of the processing is therefore a bit more complicated than those considered thus far.

First, however, comes that phase of the processing during which it is decided whether to display the icon. As shown in FIG. 22, if the player initiated a bet or a raise during the river phase of play, then the usual ratio test is performed. The numerator represents the frequency of his bluffs while the denominator represents the frequency of his 'legitimate' raises in the sense that he had hands of value. If his ratio is 30% higher than the average ratio of other players at this type of table, then the 'Bluffer Steals Pots' icon is displayed.

The phase of the processing for incrementing one of the two counts begins with a question—did the player fold the hand (to someone who later re-raised)? If he did, then his raise was probably a bluff and the Bluffing count is incremented. But if he did not fold, a decision to increment the RealHand count is not automatic—he might or might not have been bluffing. There is no way to tell unless his hole cards were opened at the end of the hand. If they were opened (so that the software can read his cards and determine whether he was bluffing), then the question is whether his cards improved the five cards on the board by creating at least a pair. If his cards did improve the board, then the supposition is that he was not bluffing, and the RealHand count is incremented. But if his cards did not improve the board by creating at least a pair, the Bluffing count is incremented. (The reason that the RealHand count is incremented is that it is assumed that the usual player bluffs at least occasionally; a propensity to bluff depends on how often a bluff is attempted by raising compared to how often a raise is made that is not a bluff.)

It should be noted that in the illustrative embodiment of the invention, the cards of a player who stays in to the end are always opened. Before the pre-flop action of the next betting round the system shows the opponents' cards the selected player has been playing against, their 'Mucked' cards (see FIG. 8). So the step in FIG. 22 that asks whether the player's cards were opened encompasses two circumstances—first, where others have not called the bet and therefore the bettor's cards never opened, and second, to show that it is necessary in the instance of a rule variation where mucked cards are not uniformly opened.

Figure 23:
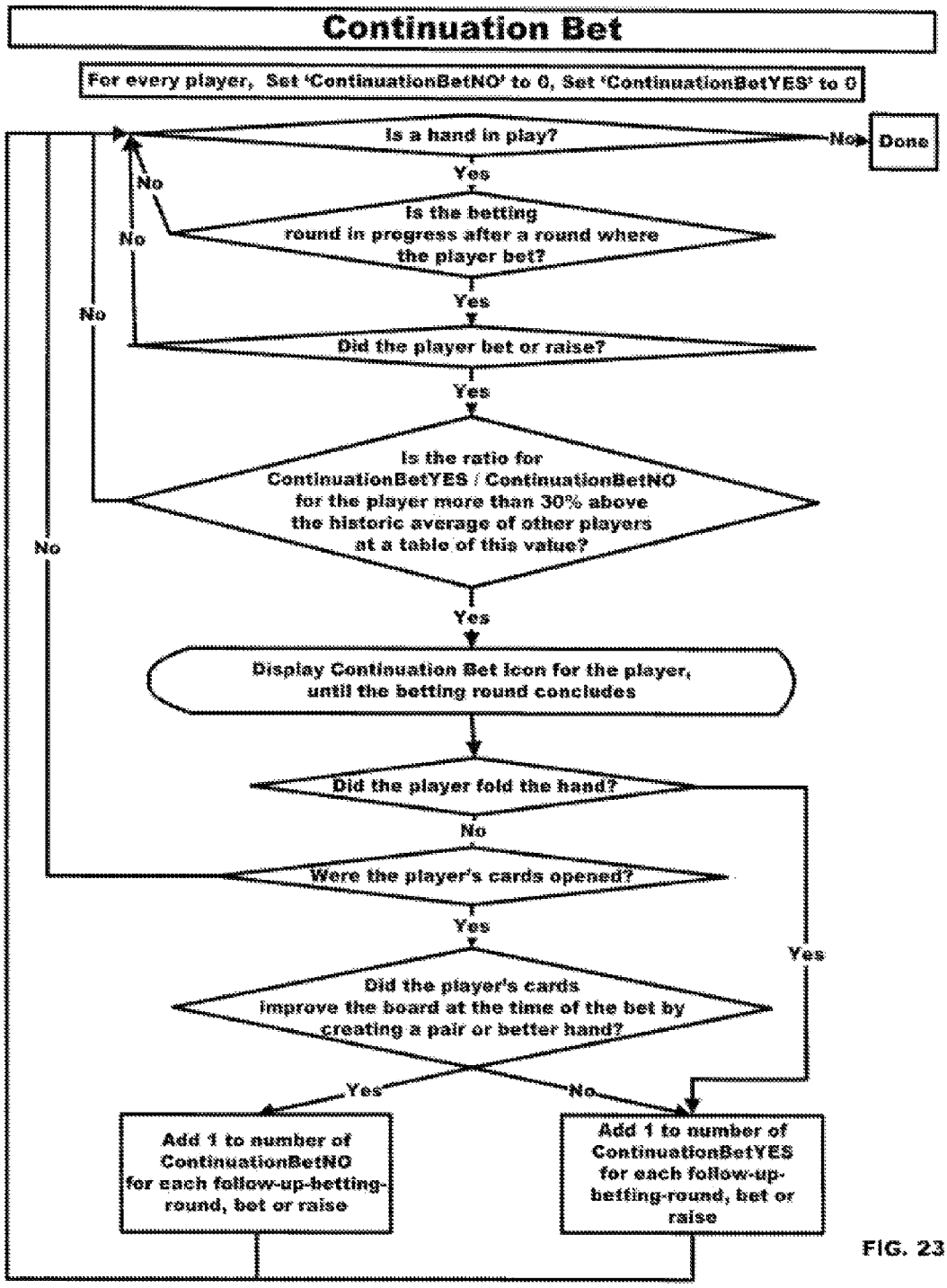

At the flop, turn and river, the Continuation Bet icon identifies a player who often follows up a bet he made at an earlier hand stage, regardless of whether he connected. Calling or raising after this opponent's bet may be advisable because his bet may have been a bluff. The first question to be answered, therefore, as shown in FIG. 23, is whether the current round of betting follows a round during which the player bet. If the player bet in the earlier round and he bet or raised in the current round, then the icon should be displayed if the player often bets or raises after he bet in an earlier round. The usual ratio test is performed.

The variables are ContinuationBetNO and ContinuationBetYES, and their ratio is an indication of the player's propensity to follow up a bet he made at an earlier stage. The processing is similar to that of FIG. 22. If the player folded, then it is assumed that his earlier bet or raise was attributable to his habit of making continuation bets, and the ContinuationBetYES count is incremented. But if he did not fold, whether a count is incremented depends on whether his cards improved the board at the time of the bet. If his cards were not opened (they may not be since the Continuation Bet processing occurs even before the river stage, and the folding later on by all remaining players may result in the selected player not learning the hole cards of the player of interest), then no decision can be made and a return is made to the start of the processing. But if his cards were opened, then a test is made to see whether his cards improved the board at the time the bet or raise was made. If they did, he bet not because of a habit to continue betting, but because he had a hand that deserved a bet, so the ContinuationBetNO count is increased. But if his cards did not improve the board, then the ContinuationBetYES count is incremented.

Figure 24:
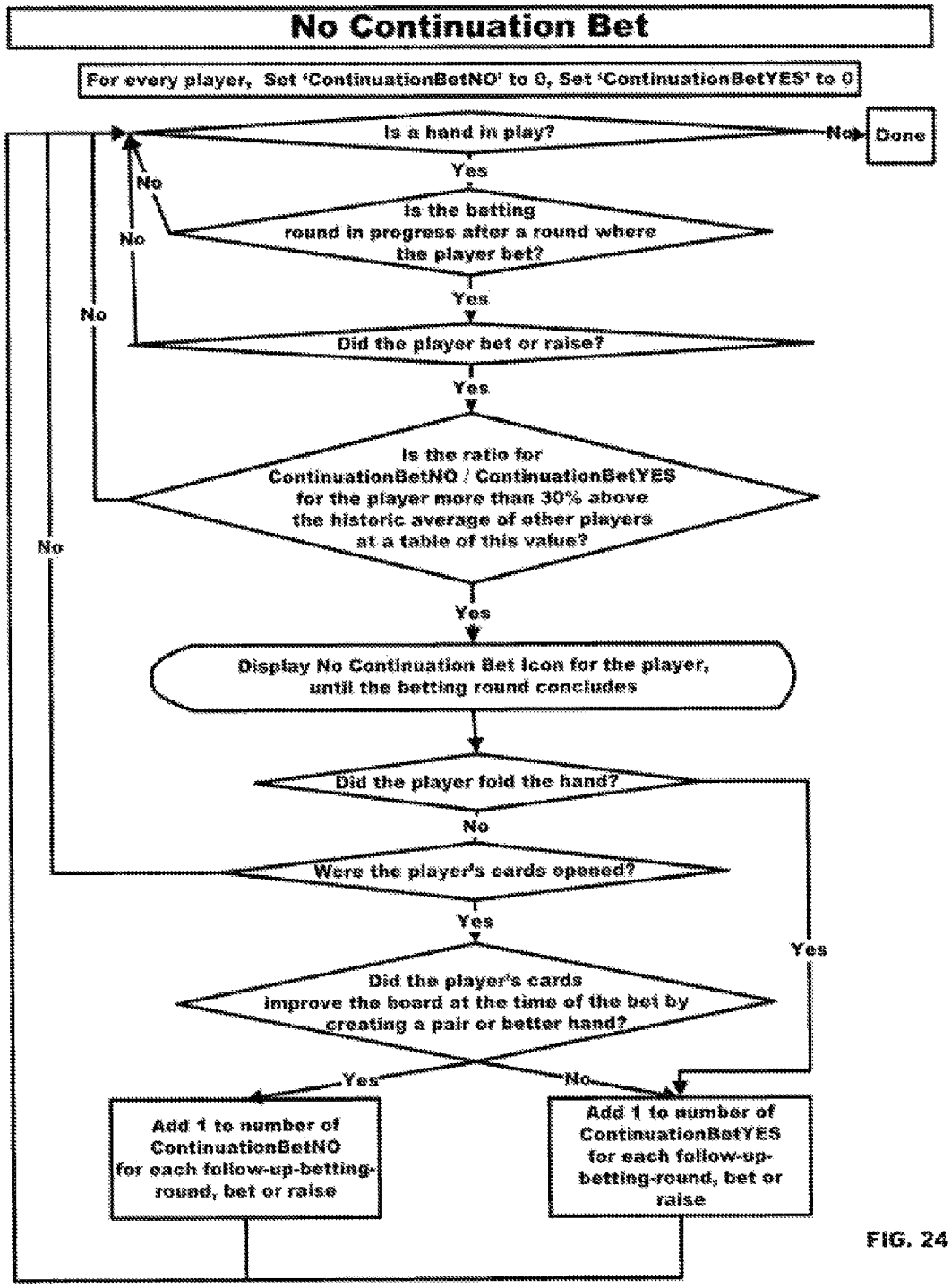

The processing for the 'No Continuation Bet' icon (feature 22) is shown in FIG. 24 and it is readily understood in light of FIG. 23. At the flop, turn and river, the No Continuation Bet icon identifies a player who has just bet or raised, and who often does not follow up his bet unless he still has a good hand. Unless the selected player has a very strong hand, folding, or not raising, after a bet by this opponent may be best. His bet likely indicates strength.

The same variables used in the processing of FIG. 23 are used in the processing of FIG. 24. The only differences are that the ratio test in FIG. 24 is the inverse of that in FIG. 23 (since the test results are in effect opposites of each other), and the icon that is displayed is different. Otherwise, the logic and the processing is the same.

The 'Pot Committed, Likely Caller' icon (feature 33) identifies a player who is pot committed (e.g., someone who bet 80% of his table chips is highly unlikely to fold to a raiser who forces him to bet his remaining chips). The opponent will likely call a bet so bluffing is not advised and a bet should be made only on a likely winning hand. Conversely, the 'Pot Committed, But May Fold' icon (feature 34) identifies a player who seems pot committed, but who has shown a tendency to ignore pot odds and may fold. Such an opponent may not call a bet at this stage, even though he should, and a bluff should be considered. As is to be expected, the processing in respective FIGS. 25 and 26 is very similar.

The variables used for each player at the site are CallerNO and CallerYES. In each flow chart, it is first determined whether the betting round in progress is one in which the player of interest (the player for whom it is to be determined whether one of the two icons is to be displayed) is pot committed. Referring to the 'pot committed' definition at the bottom of each flow chart, a pot committed player is one who has so much in the pot already that most players in such a situation would call a bet, or he is a player who, if he stays in to the end, will not have to put in much more than he already has, or he is a player who has already made bets or calls in five instances (calling the blind amount, a raise and a re-raise pre-flop constitutes three instances). For the 'Pot Committed, Likely Caller' icon to be displayed, the applicable ratio for the player of interest simply has to be greater than the historic average for all players at a table of the value of the table at which the selected player is playing. For the 'Pot Committed, But May Fold' icon to be displayed, the applicable ratio for the player of interest has to be 20% greater than the historic average for all players at a table of the value of the table at which the selected player is playing. (The 'Pot Committed, Likely Caller' test does not look for a 20% change in the applicable ratio, unlike most of the other tests. This is because the 'Pot Committed, Likely Caller' test is looking for typical behavior, not atypical behavior as in the other cases.)

In either case, one of the two icons may be displayed. A test is then performed to see if either of the two counts should be incremented. If another player bet or raised, then the question is whether the player of interest folded. If he did, the CallerNO count is incremented. If he did not, the CallerYES count is incremented.

There are players who when they have a strong hand deliberately take a significantly longer time to act during a betting round (this delay is likely several seconds, due to the speed of play online). Such a player believes that other players will mistakenly think he has a weak hand and is therefore taking a long time to make up his mind. On the other hand, there are players who really do take excessive time to make up their minds when they have weak hands. Thus delaying for some players is a sign of weakness (feature 42) and for others is a sign of strength (feature 41). (In the illustrative embodiment of the invention, any time longer than 4 seconds is considered significant. Among the options that a player may be given is the option to adjust the time threshold that defines a 'significant' time.)

Each player is given two variables, LongTimeGood and LongTimeBad. Whenever a player takes a significant time (more than 4 seconds) to act and his hole cards improved the board, his LongTimeGood count is incremented. Conversely, if he folded after taking a significant time to act, or he did not fold but the circumstance over which he agonized did not help him, then his LongTimeBad count is incremented. The usual ratio test is employed (30% above the historic average of other players) to determine if the player of interest should have an icon displayed that equates a significant decision time with weakness or whether he should have an icon displayed that equates a significant decision time with strength. As with many of the other routines, there are two flow charts that are basically the same except for the main decision boxes and the icons that are displayed.

Figure 27:
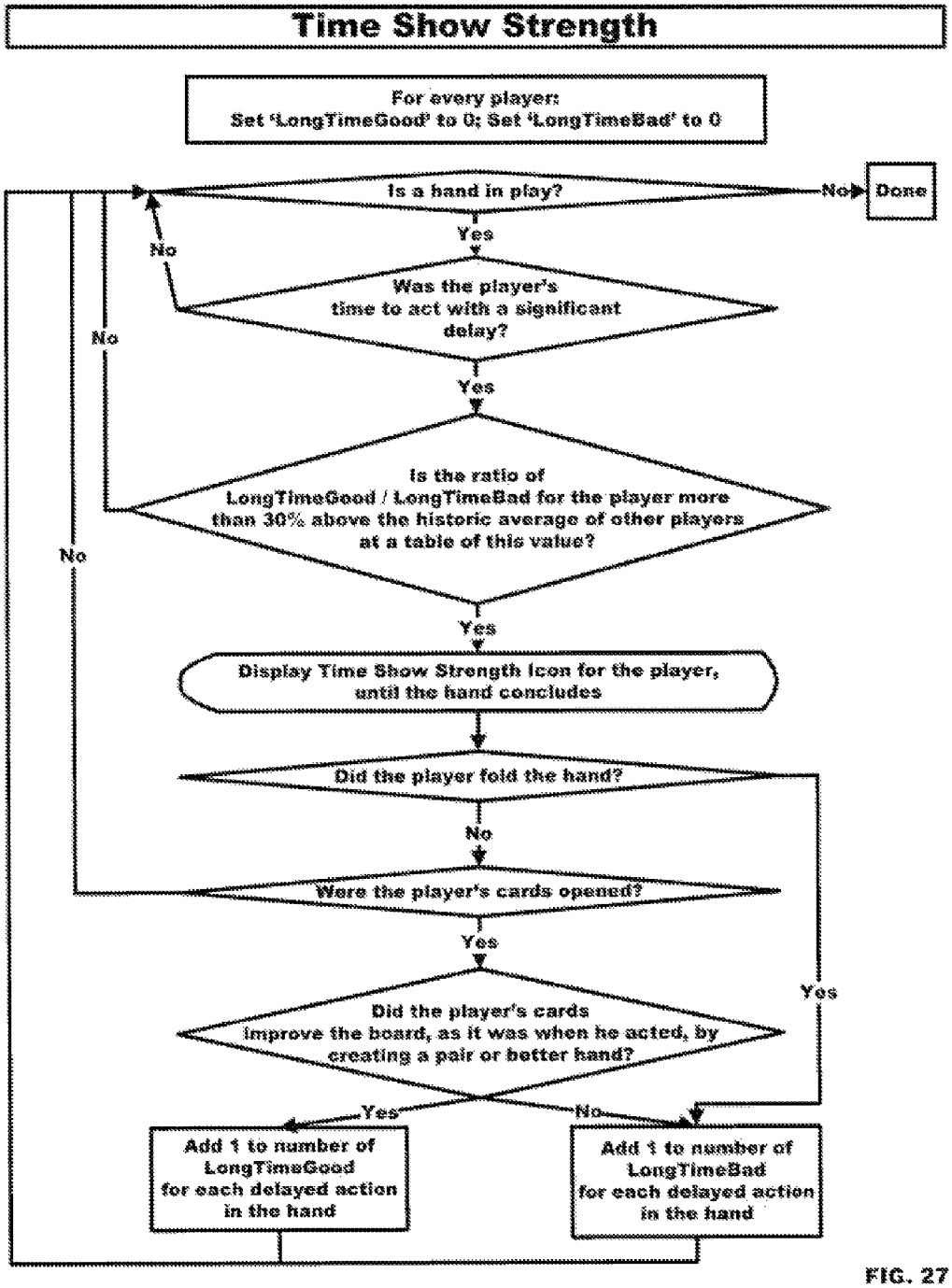
Figure 28:
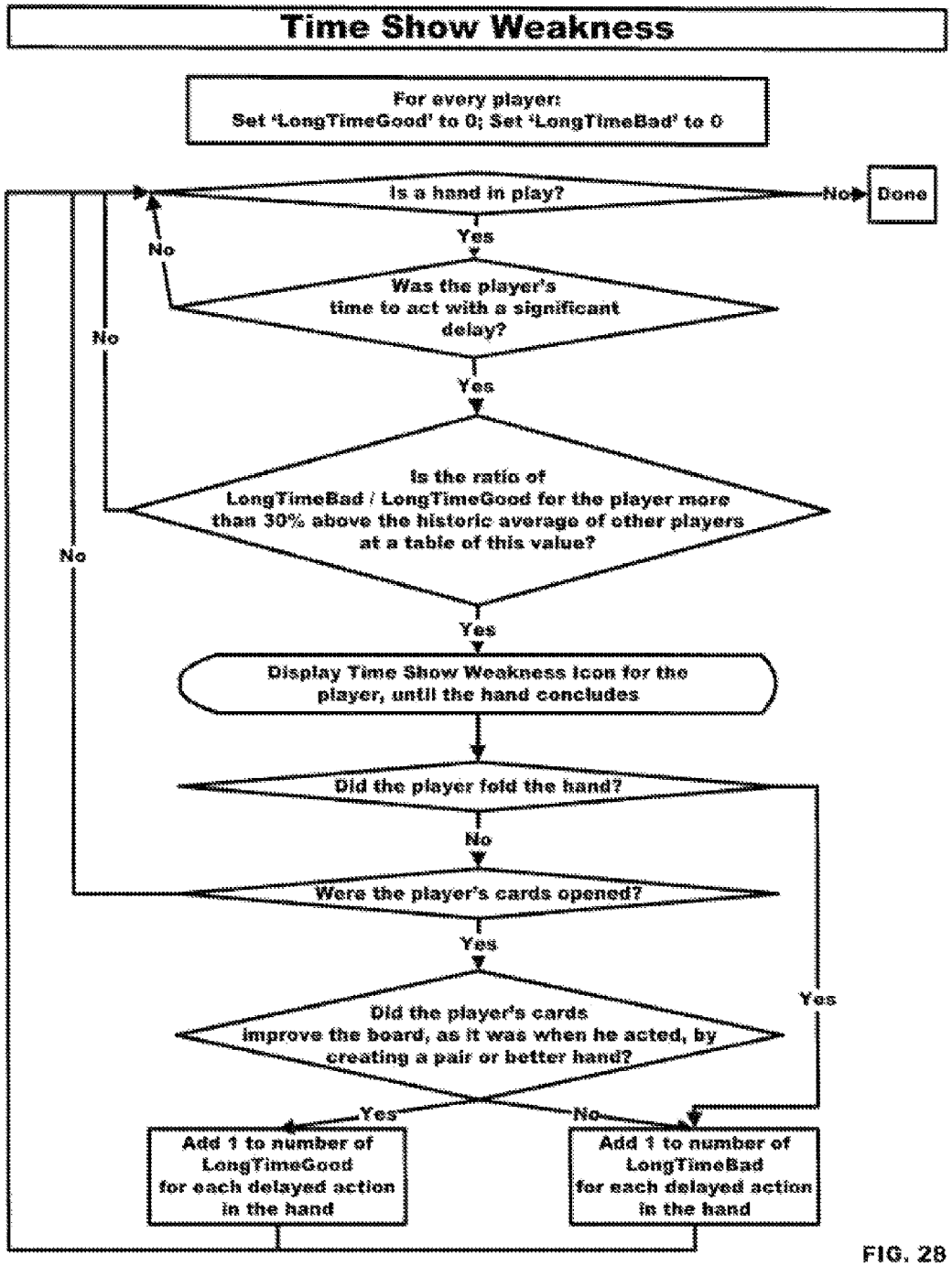
Figure 29:
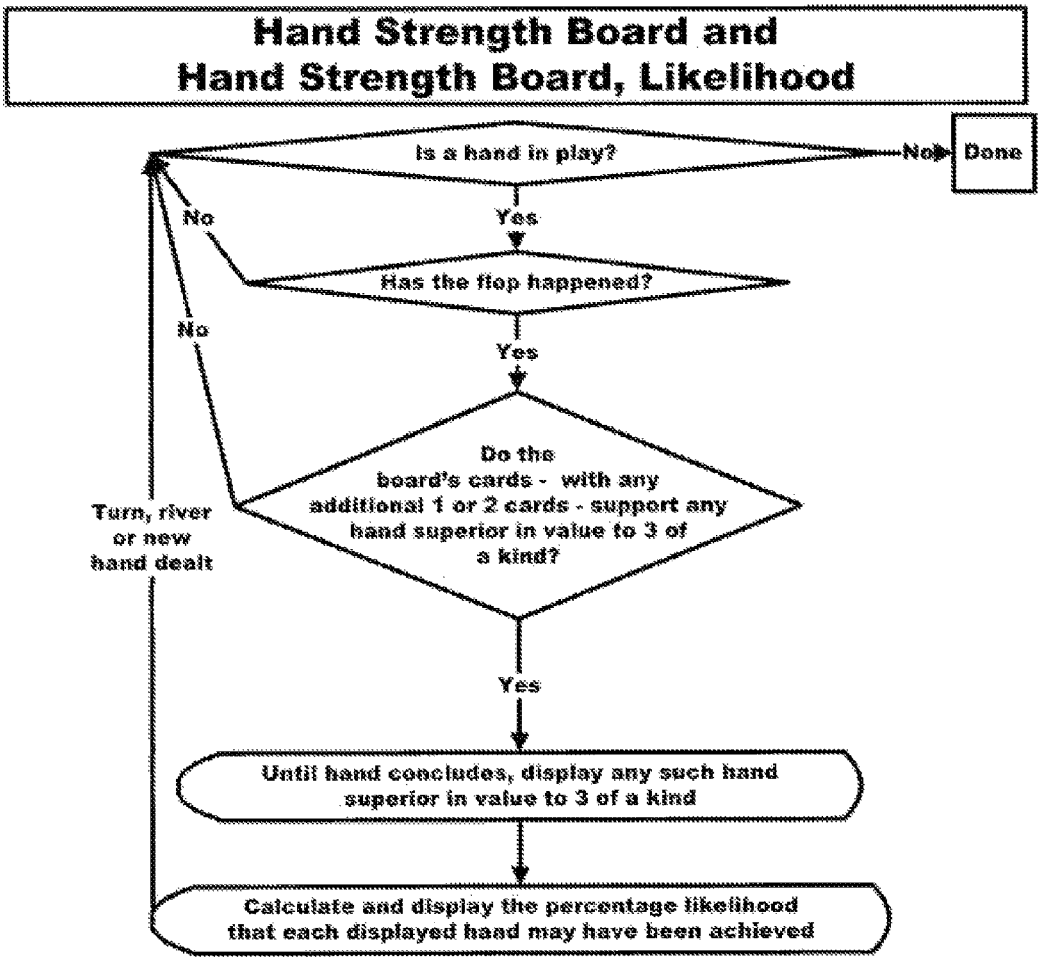

In each of FIGS. 27 and 28 it is first determined whether the player of interest took a significant time to act. If he did, a respective ratio (with the numerators and denominators switched) is calculated to determine if the ratio is 30% above the historic average of the ratios for other players at tables of the same value. If the ratio test is passed, then the appropriate icon is displayed.

In each flow chart the same tests are then performed to possibly update one of the two counts for the player of interest. If he folded, then it is assumed that he had a bad hand and the significant time he took to act is indicative of his taking a long time to decide what to do when he has a weak hand; thus his LongTimeBad count is incremented. If he did not fold, the question is whether his hole cards were opened. (If he took a significant time to act in an early round of betting and later folded, his hole cards remain unknown and his LongTimeBad count can be incremented.) If his hole cards were opened, which count is incremented depends on what his hand was during the betting round when he took a significant time to act. If his cards improved the board, his LongTimeGood count is incremented. If his cards did not improve the board, his LongTimeBad count is incremented.

Referring back to FIGS. 5-8, it will be recalled that the Hand Strength Board feature 5 is the one by which the best possible hands derived from the cards which have opened are shown near the board's cards to inform the selected player about what possible hands might beat him. Related feature 11 is the probability of hitting each of these possible hands. Both features are shown in the flow chart of FIG. 29. (The flow chart does not show how to rank the hands, but that is at the heart of every Internet poker site and is common knowledge. Similarly, it is common knowledge how to calculate the odds of getting each hand.) The significant point is that only hands better than three of a kind are displayed.

The Sheriff icon of feature 9 is placed on a turn card or a river card that creates a new possibility of a high hand (e.g., after a flop of 2d,6d,7d, a flush possibility, a new Sheriff card on a turn of 7h signals opening of the possibility of quad 7s and full houses). This icon lets a player know when straights and better hands are possible. An opponent may have been waiting for the card that opened, and now that he has made his hand he will bet or raise. The flow chart of FIG. 30 shows that the processing is relatively straight-forward.

It is first established that the turn or the river card has opened. If it has, the Sheriff icon is displayed if the new card is necessary for a 'Better Hand' than has been possible thus far. Three conditions must be satisfied for a 'Better Hand' to have been made possible, as shown by the definition of 'Better Hand' in the drawing. The first condition is obvious—the new card, together with the earlier opened board cards and any hypothetical optimal hole card or cards must be better than the best possible hand comprised of the earlier opened board cards and any hypothetical optimal hole card or cards. The second condition is that the 'Better Hand' is better than three of a kind—the Sheriff icon should not be displayed if there is just a new high card (e.g., a flop of 2d,6h,7s and a turn of Qc does not warrant a Sheriff icon). The third condition is another way of saying that the five cards on board cannot comprise the best possible hand. (There is no need to generate a warning that a new high hand possibility has arisen if the highest possible hand is already on the board so that all players, including the selected player, hold it).

The Sheriff Deputy feature 10 involves similar processing, as shown in FIG. 31. But there is an extra step. The Sheriff Deputy icon represents that the card that opened creates a new possibility for another hand that is lower than an already possible hand (e.g., after a flop of Jc,4c,7c (a flush possibility), a new Sheriff Deputy card on a turn of 8d signals opening of the possibility of a straight if an opponent has a 5,6 hand). The icon lets a player know that straights and better hands are possible. If there are many players still in the hand, one of them may have been waiting for the card that just opened, in which case he has made his inferior hand. For the Sheriff Deputy icon to be displayed, a 'Better Hand' must be possible, and the same test shown in FIG. 30 is employed to determine this. The extra test condition is whether a '2ndPremiumHand' exists. This is simply a hand that is inferior to the 'Better Hand' but is nevertheless better than 3 of a kind.

The flow chart for the Collusion Alert feature 21 is shown in FIG. 32. The Collusion Alert icon is applied to each of a pair or greater number of players at the same table who often play together, if their play has certain indicia of collusion. The reason the icon is important is obvious—the selected player might be smart to choose another table at which to play.

The crux of the processing is in the four criteria any one of which suggests collusion: (1) Players who play with each another 60% more frequently than typical players at the type of table being played; (2) Players who play with each other over 25% more frequently than typical players at the type of table being played and raise one another over 30% more frequently than typical players at the type of table being played; (3) Players who play with each other over 25% more frequently than typical players at the type of table being played and fold to one another after all other players have folded 20% more frequently than typical players at the type of table being played; or (4) Players who play with each other over 25% more frequently than typical players at the type of table being played and raise one another on the river card 30% more frequently than typical players at the type of table being played, with one of the players holding a hand that is inferior to a hand with a pair of the top card on the board (e.g., if the board included a King and the highest card in one of the bettor's hand is a 9, giving him a hand which using the board is a pair of nines, he probably had no reason to raise unless he wanted to increase the size of the pot for his partner).

Some of the same type of identifiers used in the processing of FIG. 32, (2) to (4) above, are used in the processing of FIG. 40, the flow chart for X-plosive Alert, with the change that there the frequency is lower and is "Players who play with each other 125% or less frequently than typical players." When the tendencies are present at the lesser frequency, it is suggestive of chemistry between the adversaries, rather than collusion. The same players, as to each other, can never be identified with both Collusion Alert and X-plosive Alert.

Figure 33:
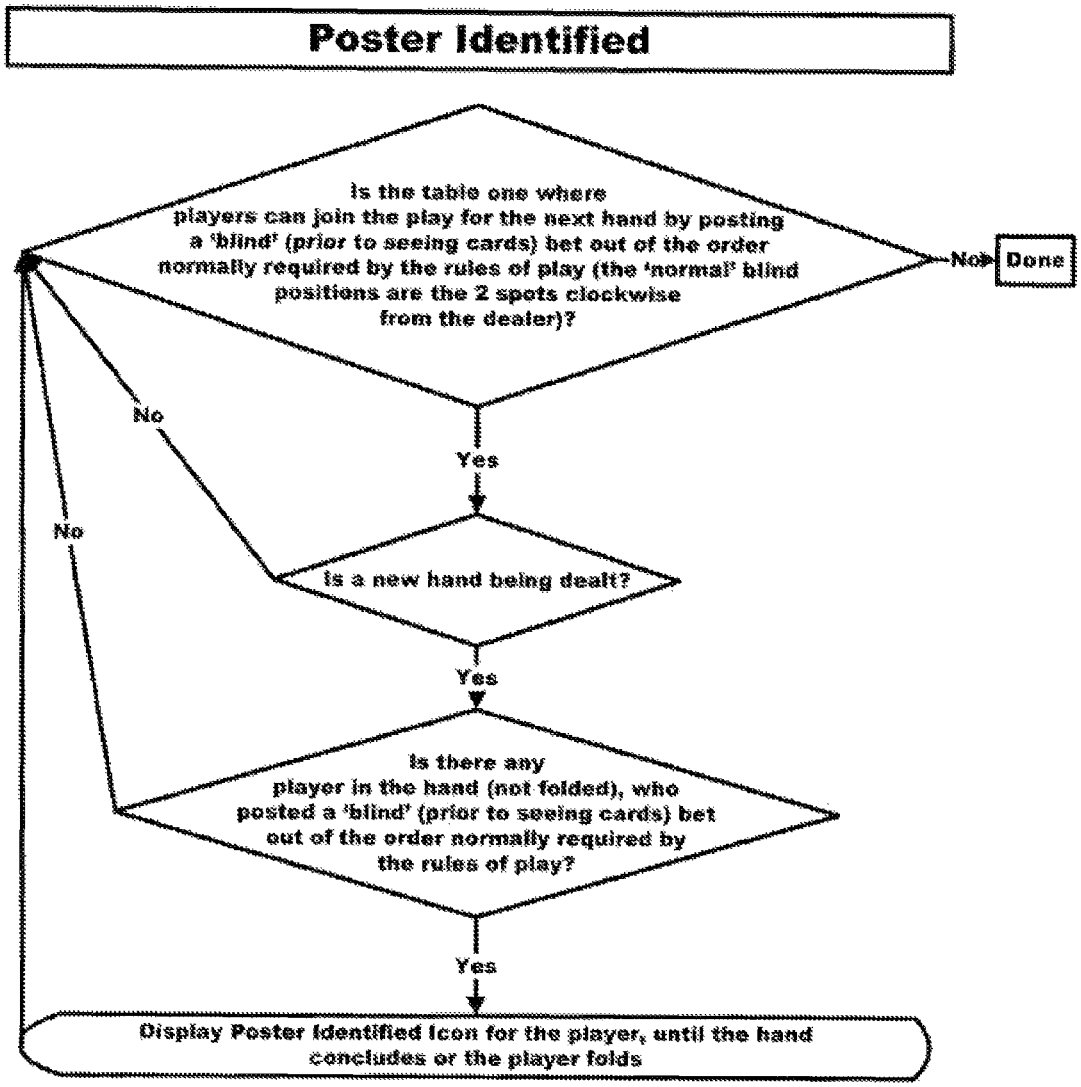

The word 'poster' is placed near the hand of an opponent who posted a blind out of order (e.g., joined a table's play from the 9-seat). This Poster Identified icon of feature 32 decreases the chance of misunderstanding an opponent's likely card quality. The particular opponent may be treated as a big blind. Not all tables allow a player to post a blind this way so the first test in the flow chart of FIG. 33 is whether the table is one where posting a blind out of regular sequence is allowed. If it is and a player has posted a blind out of order in order to join, then the appropriate icon is displayed until the hand concludes or the player folds.

Feature 4 (and feature 45 for the selected player) is 'Draw % Board Possibilities.' As shown on FIGS. 5 and 6, on the right side of the board, draw hands are displayed with their percentage probabilities (e.g., in the pre-turn screen shot of FIG. 5, the possibility of a flush is 39%). In the probability calculations, 5-card hands that may already exist when taking into account the two hidden cards of each player are not counted. The draw hand probabilities, shown only at the flop and turn stages, relate to 5-card hands that may result when further community cards are opened. This information, on whether a player may make his hand, or an opponent may call expecting to make his hand, suggests whether the player should 'bet for value,' if he feels his hand will be 'made,' or to try and bet in the hope of forcing others to fold.

Figure 34:
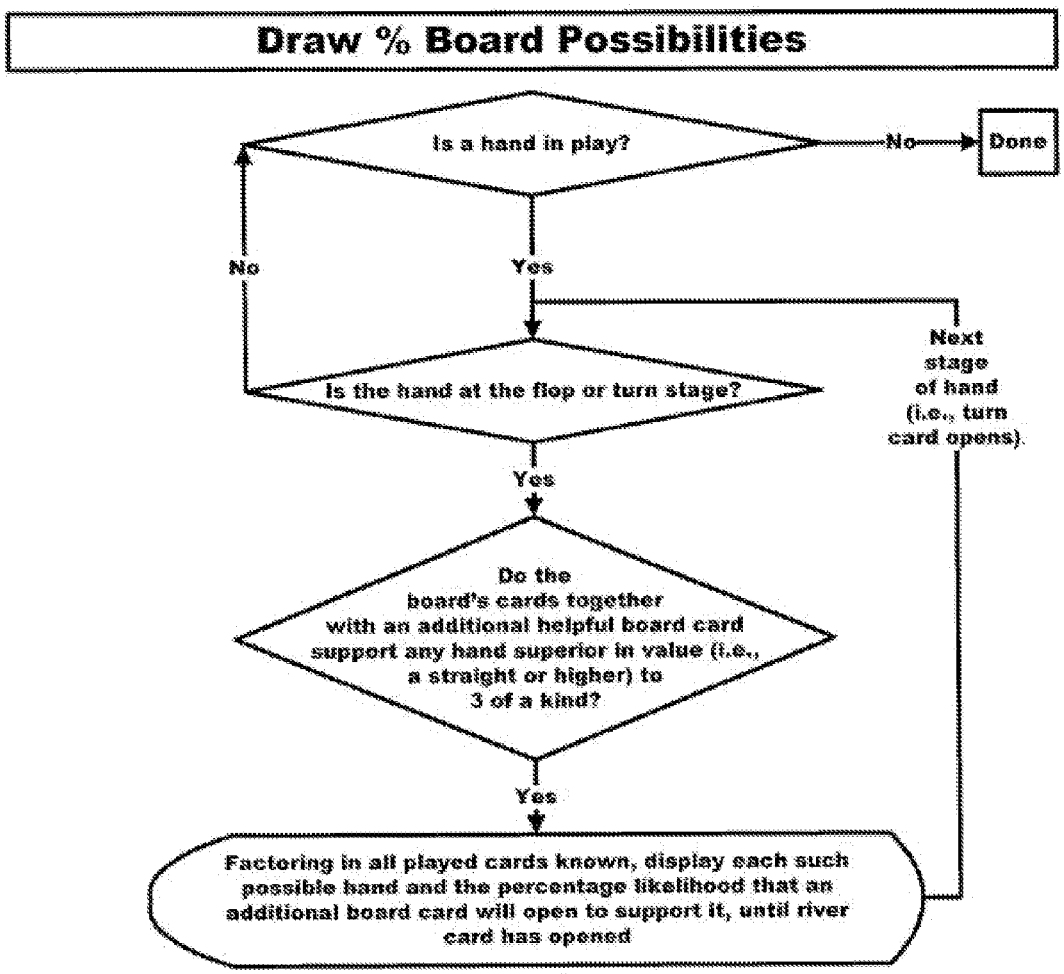
Figure 35:
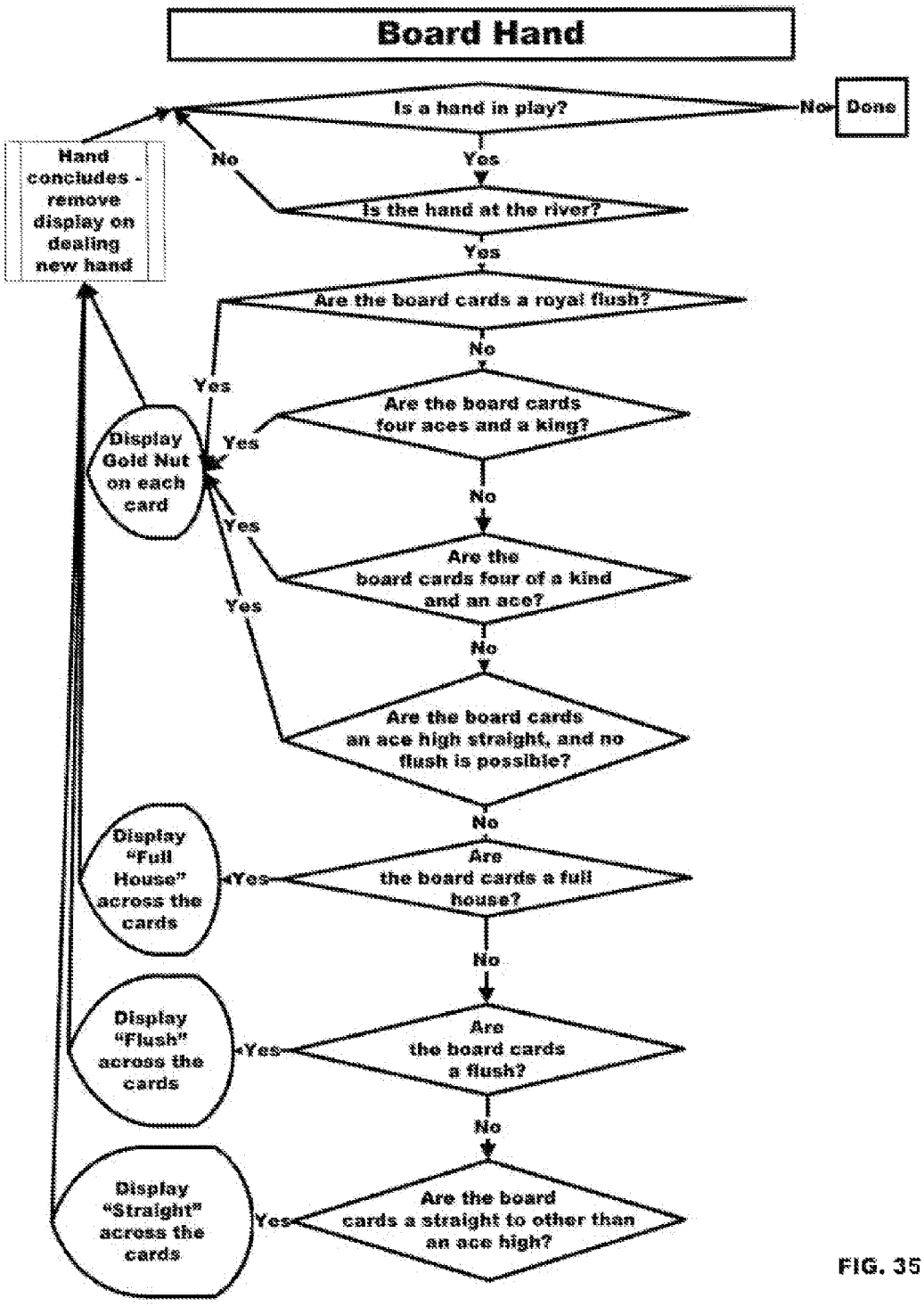

The flow chart of FIG. 34 is straight-forward. If the hand is at the flop or turn stage, the five highest hands possible with turn or river cards yet to be opened are shown. Only possible hands higher than three of a kind are shown. As can be seen from FIGS. 5 and 6, the information is shown for both the table and the selected player, referred to as 'Me' in the drawing. In general, the five highest possible hands are not necessarily the same for the selected player as they are for other players at the table because the software knows the hole cards of the player and not the hole cards of the other players. (The software obviously knows the hole cards of all players when it is the poker site itself that is providing all information, but a selected player is given only information that can be gleaned from his cards and cards that have been publicly disclosed.) In the event that one or more of the highest possible hands is no longer possible for the selected player (since his hole cards are known), the table box shows a nil percentage for the selected player. When the turn card opens, as shown in the flow chart, the probabilities change to reflect the up-dated situation. When the river card opens, the display is blanked—draw possibilities no longer exist since the last card has been played The first feature in the feature list is Board Hand If the board is a complete hand (straight, flush or full house), the board has the word 'STRAIGHT,' 'FLUSH' or 'FULL HOUSE' across its cards. Further, when the board cannot be improved, the gold nut (indicating the 'best' hand) is placed on each of the cards to signify that the board is the nut hand for all players. (This does not apply for quads, as there is a kicker. For example, if the board is AAA,A,4[AAA on the flop, A on the turn, and 4 on the river] a player with Q2 beats a player with 78.) The flow chart for determining whether the board constitutes a complete hand is shown in FIG. 35.

As shown by the decision box near the top of the flow chart, a Board Hand is displayed only after the river card has been opened. The Gold Nut determination should be noted. There are only four possible hands that deserve the 'best' Gold Nut symbol. These are four hands that cannot be beaten. A hand that is four of a kind, unless it is one of the two shown, is not necessarily the highest because the fifth card, if it is not a king with four Aces or an Ace with four of a kind, may not be the highest depending on what the players' hole cards are.

The last three tests if passed do not deserve Gold Nuts because there can be hands that are higher when taking into account the players' hole cards. So the notations "Full House," "Flush" and "Straight" are displayed if applicable without Gold Nuts.

Figure 36:
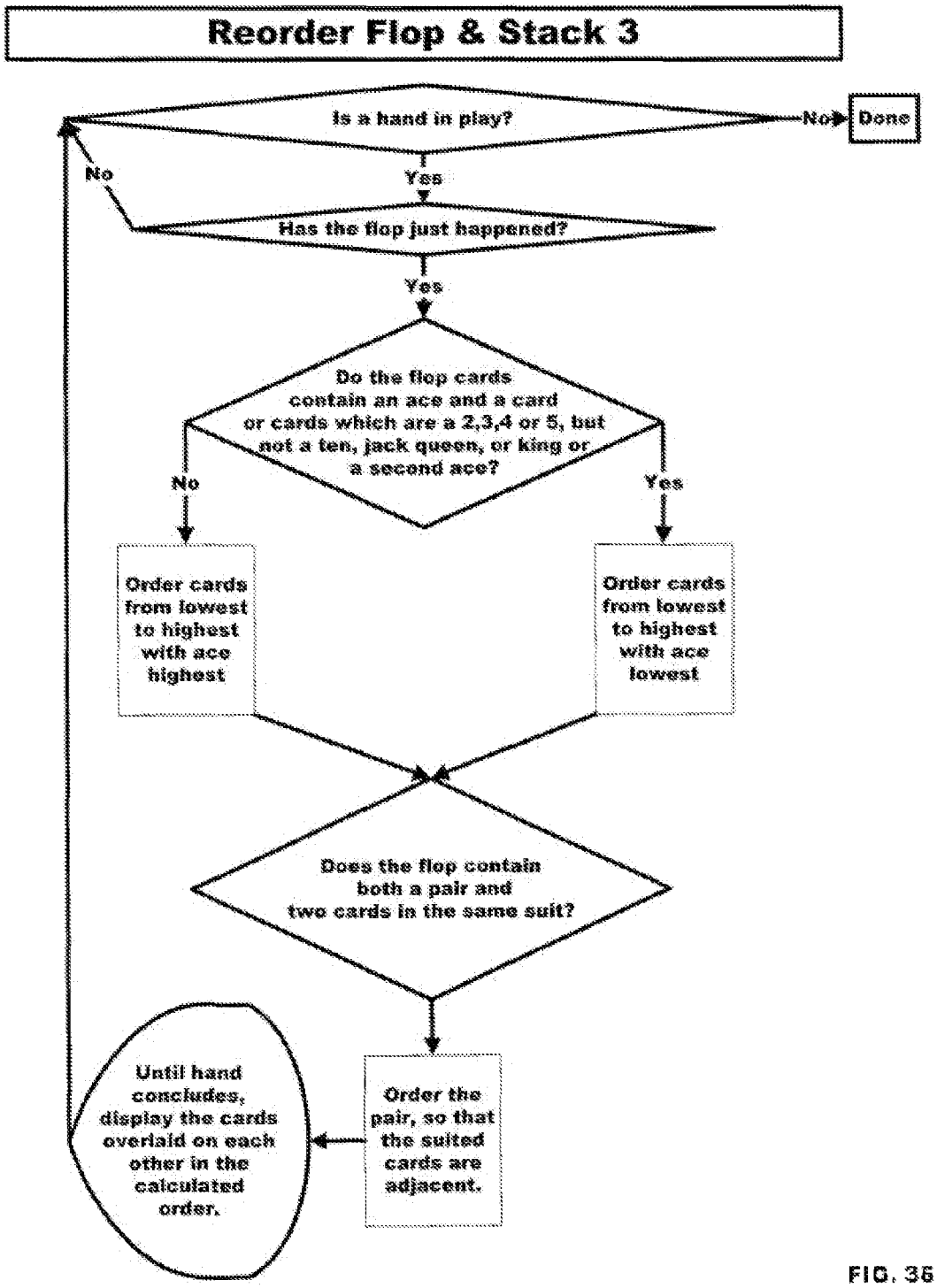

Feature 7, 'Reorder Flop & Stack 3,' is designed to enhance a selected player's understanding of the cards he is playing and whether the flop supports any made hands or likely draw hands. The flop is shown with the three flop cards put in ascending order. An Ace will be the lowest if there is a 2,3,4 or 5 and no T,J,Q or K. Also, if the ascending order can be maintained, suited cards will be beside each other (e.g., randomly generated 5h,5d,7h will appear 5d,5h,7h). The cards are overlaid on each other to make it obvious how the board's five cards opened. The flow chart for the feature is shown in FIG. 36.

The processing is in two stages after it is first determined that the flop cards have just been dealt. (It is understood that, as with every legitimate on-line poker site, a random number generator is used to deal the cards.) First, the cards are ordered for display, with lowest to highest going from left to right. If the flop includes an Ace, the Ace can be made the lowest or highest card depending on what the other cards are. (The ordering is based on the way most poker players order their cards when they have an Ace together with low or high cards.) After the initial ordering, the second stage looks for both a pair and two cards in the same suit. If so, the cards are ordered so that the two cards of the same suit are adjacent each other. The cards are then displayed in the calculated order.

Figure 37:
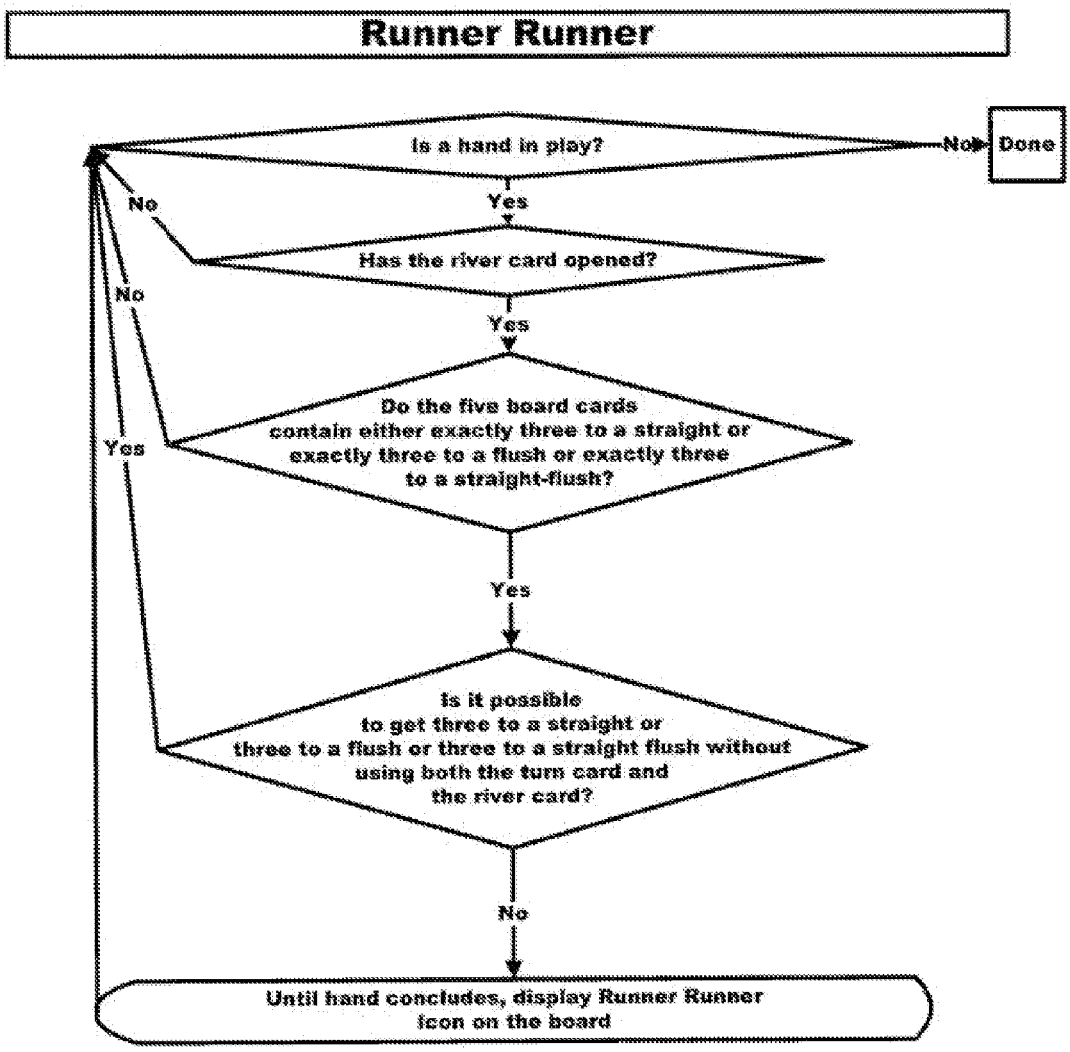

The 'Runner Runner' feature 8 emphasizes the likelihood that another player just made a hand that was unlikely at the time of the flop. The words "Runner, Runner" go across the turn card and the river card if the best-hand possibility is the result of the turn and river cards (e.g., one diamond on the flop, another diamond as the turn, and a final diamond as the river makes a diamond flush possible). The processing for determining whether the legend should be displayed is shown in FIG. 37.

If the river card opened, the question is whether both of the last two cards (the turn and the river) are necessary for a straight, a flush or a straight-flush. First, a determination is made whether the board has three cards that, with two hole cards, could make one of the three hands of interest. If the answer is yes, it is still necessary to verify that both the turn and the river cards are necessary to make the hand. If they are both not necessary, then the 'River, River' legend is not displayed because both of the last two cards were not required to make the hand. The two tests together ensure that three and only three cards on the board, including one from each of the flop, the turn and the river, may make a straight, flush or straight-flush together with a player's two hole cards.

A Tilt Alert icon (feature 40 and feature 57, Tilt Alert, Self) identifies a player (this can be an opponent or the selected player) who has changed his play style prior to the hand in play by playing more hands than usual (i.e., that he did not fold before the flop cards were dealt, but only in instances where he put chips into the pot after receiving his hole cards [disregarding blind hands without raises]). Any hand played which is among the top 25 hands in strength, or that he won, does not count toward calculating tilt, because the player probably stayed in the hand because of strength. The purpose of the alert, when it is shown on an opponent, is to inform the selected player that it will be difficult to bluff this opponent, but a quality hand should be played aggressively. Conversely, with a bad hand, folding without delay should be considered. The purpose of the alert, when it is shown on the selected player, is to inform him that he has changed his play style and may be playing too recklessly.

Figure 38:
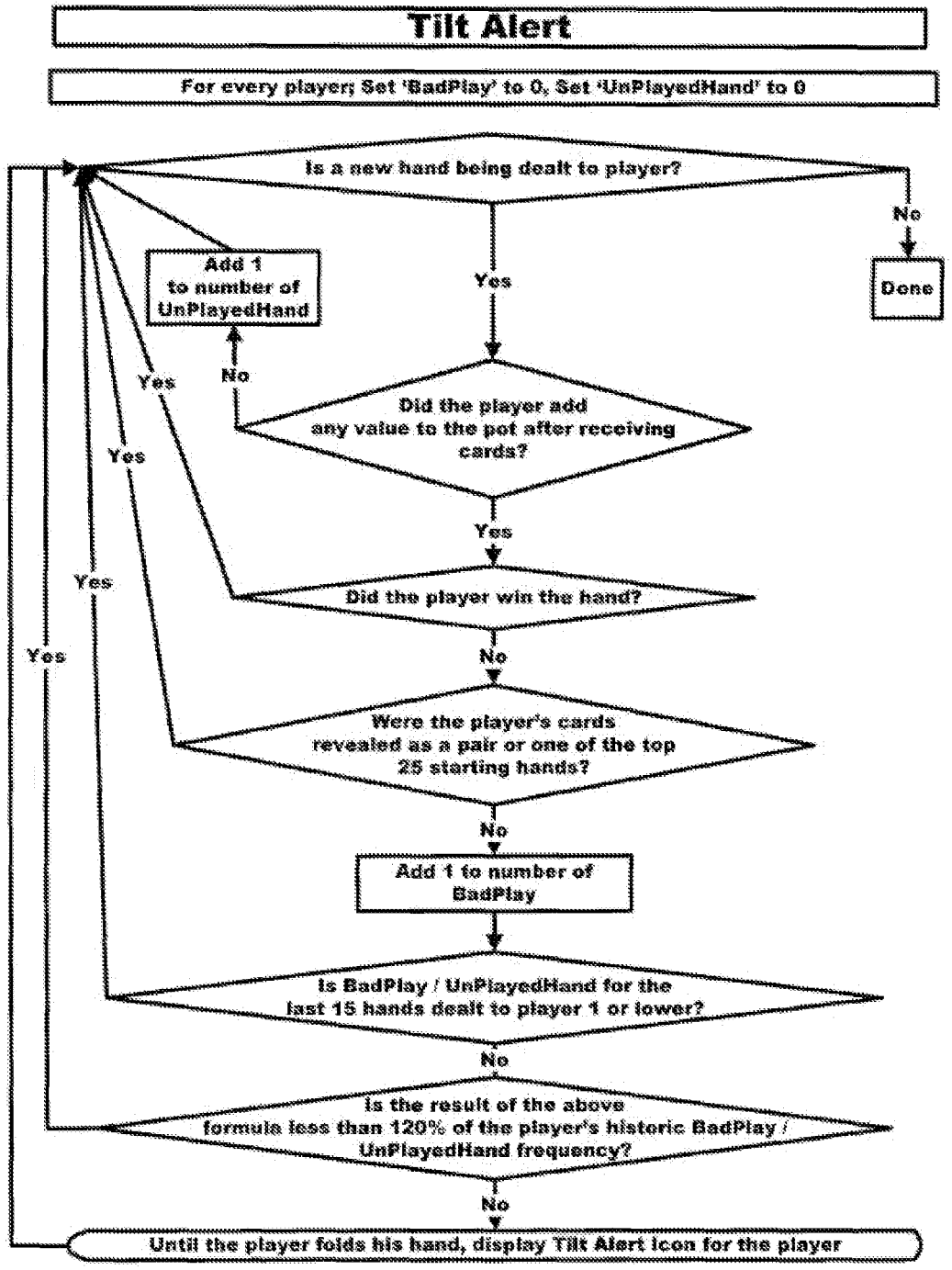

The flow chart for the feature is shown in FIG. 38. The two variables are BadPlay and UnPlayedHand. There are three kinds hand classifications in this routine. A BadPlay hand is one that appears to have been played recklessly. An UnPlayedhand is one that was not played. The third type of hand is a hand that was won. Such a hand does not count in the calculations. What counts is the number of recklessly played hands compared with the number of hands that were not played and which therefore seemingly exhibit prudent play. Hands that won or that were quality pre-flop cards, are not indicative of reckless play but are not evidence of prudent play either.

The first test is whether the player added value to the pot after receiving cards. If he did not, the UnPlayedHand count is incremented. The next two tests exclude from reckless characterization any hands that were won or that were good (a pair, or one of the top 25 starting hands). If the hand was not won and was not good, and yet it was played, the BadPlay count is incremented.

The test for a Tilt Alert is now performed. Two criteria must be satisfied. The first is that the number of recklessly played hands must be greater than the number of unplayed hands. The last 15 hands are examined (obviously, such data must be recorded and maintained for each player at the poker site) and the ratio BadPlay/UnPlayedhand is formed. If the ratio is not less than one, it is an indication of reckless play.

However, this is not sufficient for a Tilt Alert. The selected player can tell if the player of interest is a poor player by looking at the player's placard and seeing how much he loses per hour. The Tilt Alert icon is displayed when a player has suddenly started to play recklessly in a deviant manner. So what is done is to compare the BadPlay/UnPlayedHand ratio for the last 15 hands with the historic ratio for the player. If the current ratio is 120% or greater than the historic ratio for the player, it means that the player has recently started to play more recklessly than he previously played. This is the new information of value that is conveyed by the Tilt Alert icon that is now displayed.

An UnTilt/Cowed icon (feature 44 and feature 58, UnTilt/Cowed Alert, Self) identifies a player (this can be an opponent or the selected player) who has changed his play style prior to the hand in play by playing fewer hands than usual. (i.e., he folded more often before the flop cards were dealt). The purpose of the alert is to inform the selected player that the player may fold his blind if it is raised. Conversely, his playing may indicate great strength so a fold may be advisable without a good hand or draw chance. The purpose of the alert, when it is shown on the selected player, is to inform him that he has changed his play style and may be playing too timidly.

Figure 39:
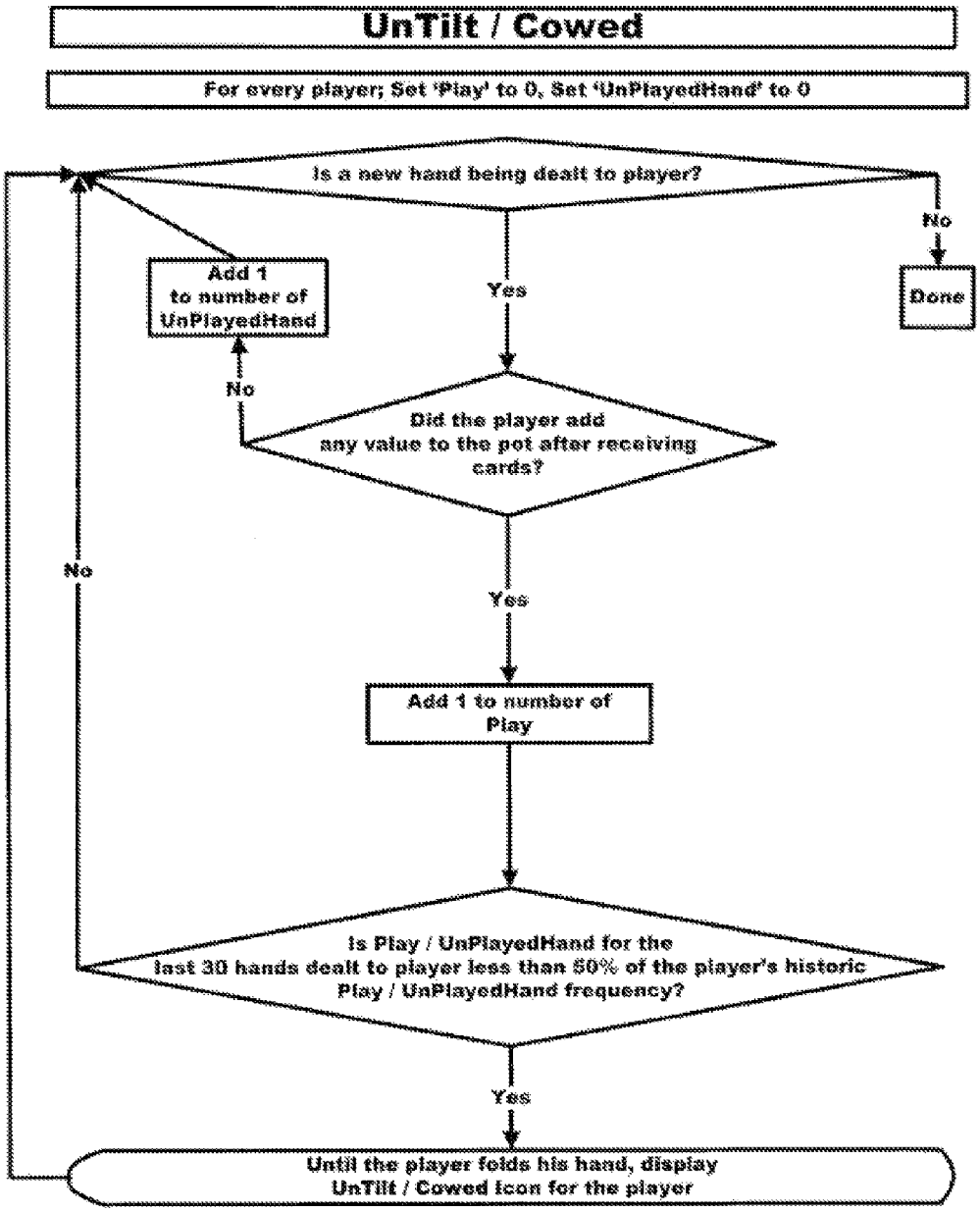

The variables used in the processing of FIG. 39 are a subset of the variables used in the processing of FIG. 38. The differences are removal of the inquiries specific to hands won and the top 25 starting hands, as these are inapposite to the non-play focus of this feature, the utilization of a Play/UnPlayed-hand analysis, and the icon that is displayed. Otherwise, the logic and the processing is similar.

The flow chart for the X-plosive Alert feature 45 is shown in FIG. 40. The X-plosive Alert icon is applied to each of a pair or greater number of players at the same table who often play together, if their play has certain indicia of reactive aggressive play. The reason the icon is important is obvious—the selected player might be smart to choose to play fewer speculative hands when these players are possibly going to mix it up, but quality hands should be played aggressively against these players.

The crux of the processing is in the three criteria any one of which suggests collusion: (1) Players who play with each other 125% or less frequently than typical players at the type of table being played and raise one another over 30% more frequently than typical players at the type of table being played; (2) Players who play with each other 125% or less frequently than typical players at the type of table being played and fold over 20% more frequently than typical players at the type of table being played; or (3) Players who play with each other over 125% or less frequently than typical players at the type of table being played and raise one another on the river over 30% more frequently than typical players at the type of table being played, with one holding less than the top pair supported by the board.

Flow charts have not been included for features whose implementations are obvious or standard in on-line poker games. For example, feature 6, the display of the pot amount prior to the betting round in progress as well as display of the total amount currently in the pot hardly require only the basic step of addition. Features 12 and 47, which show the average strengths of hands played by an opponent and a selected player, simply require adding up the hand strengths of all hands played by a player (using the 169 rankings given above) and taking the average. The Bet/Call Notes for Opponent (feature 13) and for a selected player (feature 44) simply entail displays of the actions at each hand stage for players still in the hand, and for players who folded but who had initiated bets, as depicted in several screen shots of the drawing. The Disconnect Protect Alert warning icon of feature 26 is applied to a player with a higher than average use of disconnect protects. (A disconnect protect allows a player to avoid being folded from an on-line game if the game server perceives that he has been disconnected.) What is considered 'higher than average' is typically 30% as shown in many of the flow charts. The Disconnect Protect Alert feature simply requires maintaining a percentage for each player at the site that reflects the frequency of his disconnects, calculating the average for all players, and comparing it to the percentage for the player of interest. (The 30% figure does not apply to all features. For example, while it applies to feature 37, it does not apply to feature 38.)

It is also to be understood that the system records and maintains the data that is needed for the various features. For example, if an opponent three bets (raises after a first raise and the blind bets), with feature 39 (Three Bet Pre-flop) the display will show what the opponent held, or what transpired if he folded, the last several times when he three bet (e.g., "88, TT, Fold (AJQ flop), KK, Fold (KQT flop)"). Obviously, in order to provide this information the system must record and maintain a database of the most recent opened hole cards of any player who three bet, and of the flop in instances where he folded.

Although the invention has been described with reference to particular embodiments, it is to be understood that these embodiments are merely illustrative of the application of the principles of the invention. For example, it is contemplated that a selected player may be given the option of customizing not only the types of information that he is given, but also how it is determined, e.g., by changing threshold values. Thus it is to be understood that numerous modifications may be made in the illustrative embodiment of the invention and other arrangements may be devised without departing from the spirit and scope of the invention.

In the following claims it is to be understood that references to 'betting' encompass all possible types of betting conduct, e.g., checking, betting, raising, re-raising and folding. Similarly, references to 'chips' encompass all possible betting objects, e.g., poker chips, real money, and play money.

The invention claimed is:

1. A computer-controlled method of providing information to each of a plurality of selected players participating in an on-line poker game with other players in which the players observe table play on display units and make bets by operating data entry devices comprising the steps of:

(a) maintaining a database of information pertaining to the play styles of players, the database containing information gathered during both play in previous poker games and play in the poker game in progress, (b) continuously analyzing during the poker game in progress both cards as they are dealt and play of the players, and continuously updating the database as the game progresses, and (c) providing information for display on the display unit of a selected player that pertains to predicted continued play of the hands in the poker game in progress as they develop, predicted betting of the other players in the poker game in progress, advantageous betting by said selected player in the poker game in progress, on-going play of the poker game in progress, or on-going successive poker games played at the table, the information provided being derived from the database that includes updates that are made as the game progresses.

2. A computer-controlled method of providing information to a selected player participating in an on-line poker game in accordance with claim 1 wherein said database of information pertains to the ways players at the table have played both at the table at which they are now playing and tables at which they played in the past with other players.

3. A computer-controlled method of providing information to a selected player participating in an on-line poker game in accordance with claim 2 wherein the game in progress is analyzed and information is provided both when closed cards are dealt to the players before community cards are exposed, and when community cards are subsequently exposed.

4. A computer-controlled method of providing information to a selected player participating in an on-line poker game in accordance with claim 2 wherein the selected player to whom information is provided is a player who has paid a subscription fee to obtain the information.

5. A computer-controlled method of providing information to a selected player participating in an on-line poker game in accordance with claim 1 wherein some of the information provided pertains only to the cards dealt and is independent of player play styles.

6. A computer-controlled method of providing information to a selected player participating in an on-line poker game in accordance with claim 1 wherein at least some of the exposed cards displayed on the monitor of said selected player are arranged in ascending order even if they were not dealt in that order.

7. A computer-controlled method of providing information to each of a plurality of selected players participating in an on-line poker game with other players in accordance with claim 1 wherein the information that is displayed is changed automatically as the game situation changes without intervention by a selected player.

8. A computer-controlled method of providing information to each of a plurality of selected players participating in an on-line poker game with other players in which the players observe table play on display units and make bets by operating data entry devices comprising the steps of:

(a) maintaining a database of information pertaining to the playing habits of players, the database containing information pertaining to the ways players at the table previously played even when they played at tables at which no selected player was playing, (b) continuously analyzing during the poker game in progress both cards as they are dealt and the play of the players, and (c) providing information for display on a selected player's display unit that pertains to predicted continued play of the poker game in progress, predicted betting of the other players in the poker game in progress, advantageous betting by a selected player in the poker game in progress, on-going play of the poker game in progress, or on-going successive poker games played at the table, the information provided being derived from the database that includes updates that are made as the game progresses.

9. A computer-controlled method of providing information to each of a plurality of selected players participating in an on-line poker game with other players in which the players observe table play on display units and make bets by operating data entry devices comprising the steps of:

(a) maintaining a database of information pertaining to the playing habits of players, the database containing information gathered during play in at least previous poker games, (b) continuously analyzing during the poker game in progress both cards as they are dealt and the play of the players, and (c) providing advantageous betting recommendations for display on the display unit of a selected player that are based on cards dealt in the game in progress and playing habits of other players at the table as represented by information in the database.

10. A computer-controlled method of providing information to each of a plurality of selected players participating in an on-line poker game with other players in which the players observe table play on display units and make bets by operating data entry devices comprising the steps of:

(a) maintaining a database of information pertaining to the playing habits of players, the database containing information gathered during play in at least previous poker games, (b) continuously analyzing during the poker game in progress both cards as they are dealt and the play of the players, and (c) providing for display on the display unit of a selected player information that is indicative of how at least one other player at the table played a number of times in the past when the games in which said other player was playing had situations similar to the current situation at the table.

11. An apparatus that provides information to players participating in an on-line poker game with other players comprising a display, a data processor, a data entry device and a communication line over which data representing poker play by said player and entered on said entry device is transmitted to a remote server that controls the on-line poker game, said data processor operating to process information received from said remote server over said communication line and to form an information-conveying screen on said display, said information being derived from a database pertaining to the playing habits of players, the database containing data gathered during both play in previous poker games and play in the poker game in progress, the database being continuously updated during the poker game in progress as a function of both cards as they are dealt and the play of the players, the apparatus providing information for display on the display of said player that pertains to predicted continued play of the poker game in progress, predicted betting of the other players in the poker game in progress, advantageous betting by said player in the poker game in progress, on-going play of the poker game in progress, or on-going successive poker games played at the table.

12. An apparatus that provides information to players participating in an on-line poker game with other players comprising a monitor, a data processor, a data entry device and a communication line over which data representing poker play by said selected player and entered on said entry device is transmitted to a remote server that controls the on- line poker game, said data processor operating to process information received from said remote server over said communication line and to form an information-conveying display on said monitor, said information being derived from a database pertaining to the playing habits of players, the database containing data pertaining to the ways players at the table previously played even when they played at tables at which no selected player was playing, the database being continuously updated during the poker game in progress as a function of both cards as they are dealt and the play of the players, the apparatus providing information for display on the display of the player that pertains to predicted continued play of the poker game in progress, predicted betting of the other players in the poker game in progress, advantageous betting by said player in the poker game in progress, on-going play of the poker game in progress, or on-going successive poker games played at the table.

13. An apparatus that provides information to players participating in an on-line poker game with other players comprising a monitor, a data processor, a data entry device and a communication line over which data representing poker play by said player and entered on said entry device is transmitted to a remote server that controls the on-line poker game, said data processor operating to process information received from said remote server over said communication line and to form an information-conveying display on said monitor, said information being derived from a database pertaining to the playing habits of players, the database containing information gathered during play in at least previous poker games, the apparatus displaying on the display advantageous betting recommendations for said player that are based on cards dealt in the game in progress and playing habits of other players at the table as represented by information in the database.

14. An apparatus that provides information to players participating in an on-line poker game with other players comprising a monitor, a data processor, a data entry device and a communication line over which data representing poker play by player and entered on said entry device is transmitted to a remote server that controls the on-line poker game, said data processor operating to process information received from said remote server over said communication line and to form an information-conveying display on said monitor, said information being derived from a database pertaining to the playing habits of players, the database containing information gathered during play in at least previous poker games, the apparatus displaying on the display information that is indicative of how at least one other player at the table played a number of times in the past when the games in which said other player was playing had situations similar to the current situation at the table.

15. A data stream containing information for players participating in an on-line poker game with other players in which the players observe table play on displays and make bets by operating data entry devices, the data stream being derived from a database of information pertaining to the playing habits of players, the database containing information gathered during both play in previous poker games and play in the poker game in progress and the database being continuously updated during the poker game in progress in accordance with an analysis of both cards that are dealt and play of the players, said data stream containing information for display on the display of a player that pertains to predicted continued play of the poker game in progress, predicted betting of the other players in the poker game in progress, advantageous betting by said player in the poker game in progress, on-going play of the poker game in progress, or on-going successive poker games played at the table.

16. A data stream containing information for players participating in an on-line poker game with other players in which the players participate in table play on displays and make bets by operating data entry devices, the data stream being derived from a database of information pertaining to the playing habits of players, the database containing information pertaining to the ways players at the table previously played even when they played at tables at which no selected player was playing, the database being continuously updated during the poker game in progress in accordance with an analysis of both cards that are dealt and play of the players, said data stream containing information for display on the display of the player that pertains to predicted continued play of the poker game in progress, predicted betting of the other players in the poker game in progress, advantageous betting by the player in the poker game in progress, on-going play of the poker game in progress, or on-going successive poker games played at the table.

17. A data stream containing information for players participating in an on-line poker game with other players in which the players participate in table play on displays and make bets by operating data entry devices, the data stream being derived from a database of information pertaining to the playing habits of players, the database containing information gathered during play in at least previous poker games, said data stream containing information for display on the display of player that pertains to advantageous betting recommendations that are based on cards dealt in the game in progress and playing habits of other players at the table as represented by information in the database.

18. A data stream containing information for players participating in an on-line poker game with other players in which the players participate in table play on displays and make bets by operating data entry devices, the data stream being derived from a database of information pertaining to the playing habits of players, the database containing information gathered during play in at least previous poker games and being continuously updated during the poker game in progress in accordance with an analysis of both cards that are dealt and play of the players, said data stream containing information for display on the display of player that is indicative of how at least one other player at the table played a number of times in the past when the games in which said other player was playing had situations similar to the current situation at the table.

19. A method to be practiced on a data processor for determining which of a plurality of display elements desired to be displayed on a display device should be displayed when the display of all such desired elements would require more space than is available, the display elements being associated with an on-going process having multiple stages and the display elements varying in relative importance from stage to stage, comprising the steps of: (a) assigning ranks to respective display elements for each of said stages, the relative ranks varying from stage to stage, and (b) examining the relative ranks for the current stage of the process and displaying the top ranked elements in the order of their ranks until the display space has been filled with display elements.

20. A method to be practiced on a data processor for determining which of a plurality of display elements desired to be displayed on a display device should be displayed when the display of all such desired elements would require more space than is available, the display elements being associated with an on-going process having multiple stages and the display elements varying in relative importance from stage to stage, comprising the steps of: (a) establishing for each stage of the process a hierarchical structure for the display elements, and (b) using the applicable hierarchical structure at each stage of the process to determine which desired display elements should be displayed.

* * * * *